US011117064B2

(12) United States Patent
Choi

(10) Patent No.: US 11,117,064 B2
(45) Date of Patent: Sep. 14, 2021

(54) DRIVING TOY AND PLAYING DEVICE USING THE SAME

(71) Applicant: CHOIROCK CONTENTS FACTORY CO., LTD., Seoul (KR)

(72) Inventor: Jong-Ill Choi, Seoul (KR)

( * ) Notice: Subject to any disclaimer, the term of this patent is extended or adjusted under 35 U.S.C. 154(b) by 0 days.

(21) Appl. No.: 16/321,546

(22) PCT Filed: Aug. 18, 2017

(86) PCT No.: PCT/KR2017/008999

§ 371 (c)(1),
(2) Date: Jan. 29, 2019

(87) PCT Pub. No.: WO2018/034529

PCT Pub. Date: Feb. 22, 2018

(65) Prior Publication Data

US 2019/0160387 A1 May 30, 2019

(30) Foreign Application Priority Data

Aug. 18, 2016 (KR) ..... 10-2016-0105087
Oct. 7, 2016 (KR) ..... 10-2016-0129975

(51) Int. Cl.

| | |
|---|---|
| ***A63H 18/00*** | (2006.01) |
| ***A63H 18/08*** | (2006.01) |
| ***A63H 18/02*** | (2006.01) |
| ***A63H 17/14*** | (2006.01) |

(Continued)

(52) U.S. Cl.

CPC ..... *A63H 18/005* (2013.01); *A63H 17/14* (2013.01); *A63H 17/262* (2013.01); *A63H 17/264* (2013.01); *A63H 18/02* (2013.01); *A63H 18/021* (2013.01); *A63H 18/026* (2013.01);

(Continued)

(58) Field of Classification Search

None

See application file for complete search history.

(56) References Cited

U.S. PATENT DOCUMENTS 3,209,491 A 10/1965 Roeper
3,552,322 A * 1/1971 Clowes ..... A63H 18/14 104/172.3

(Continued)

FOREIGN PATENT DOCUMENTS

GB 2 389 805 B 8/2005
GB 2 445 857 A 7/2008

(Continued)

OTHER PUBLICATIONS

International Search Report dated Nov. 23, 2017 in corresponding International Application No. PCT/KR2017/008999 (2 pages in English, 3 pages in Korean.

(Continued)

*Primary Examiner* — Kevin Y Kim

(74) *Attorney, Agent, or Firm* — Lewis Roca Rothgerber Christie LLP

(57) ABSTRACT

The purpose of the present invention is to provide a driving toy and a playing device using same, the driving toy being provided with auxiliary wheels for guiding the driving toy to travel along a track, and capable of travelling on various tracks by allowing the auxiliary wheels to be installed by changing the positions thereof according to the type of tracks.

2 Claims, 54 Drawing Sheets

(51) Int. Cl.
*A63H 17/26* (2006.01)
*A63H 18/10* (2006.01)

(52) U.S. Cl.
CPC ..... *A63H 18/028* (2013.01); *A63H 18/08* (2013.01); *A63H 18/10* (2013.01)

(56) References Cited

U.S. PATENT DOCUMENTS

| | | | | | |
|---|---|---|---|---|---|
| 3,670,115 | A * | 6/1972 | Munzing | A63H 19/10 | 191/45 R |
| 3,688,436 | A | 9/1972 | Wakimura | | |
| 3,705,387 | A * | 12/1972 | Stern | A63H 18/12 | 446/460 |
| 3,896,735 | A * | 7/1975 | Fischer | A63H 21/04 | 104/23.2 |
| 4,045,908 | A * | 9/1977 | Ensmann | A63H 17/00 | 446/441 |
| 4,151,679 | A * | 5/1979 | Tanaka | A63H 18/08 | 446/445 |
| 4,152,867 | A * | 5/1979 | Ogawa | A63H 17/00 | 446/445 |
| 4,330,127 | A * | 5/1982 | Brand | A63H 18/005 | 324/177 |
| 4,493,669 | A * | 1/1985 | Neuhierl | A63H 18/025 | 446/103 |
| 6,173,654 | B1 * | 1/2001 | Ngai | A63H 18/02 | 104/295 |
| 2007/0197127 | A1 | 8/2007 | Ostendorff et al. | | |
| 2014/0206256 | A1 | 7/2014 | Chan et al. | | |

FOREIGN PATENT DOCUMENTS

| | | | |
|---|---|---|---|
| JP | 7-492 | U | 1/1995 |
| JP | 9-308774 | A | 12/1997 |
| JP | 3089847 | U | 11/2002 |
| KR | 10-2002-0076372 | A | 10/2002 |
| KR | 2002-0076372 | A | 10/2002 |
| WO | WO 2009/100599 | A1 | 8/2009 |

OTHER PUBLICATIONS

Extended European Search Report dated Nov. 16, 2020 in counterpart European Patent Application No. 17841711.9 (8 pages in English).

* cited by examiner

FIG. 42
(a)
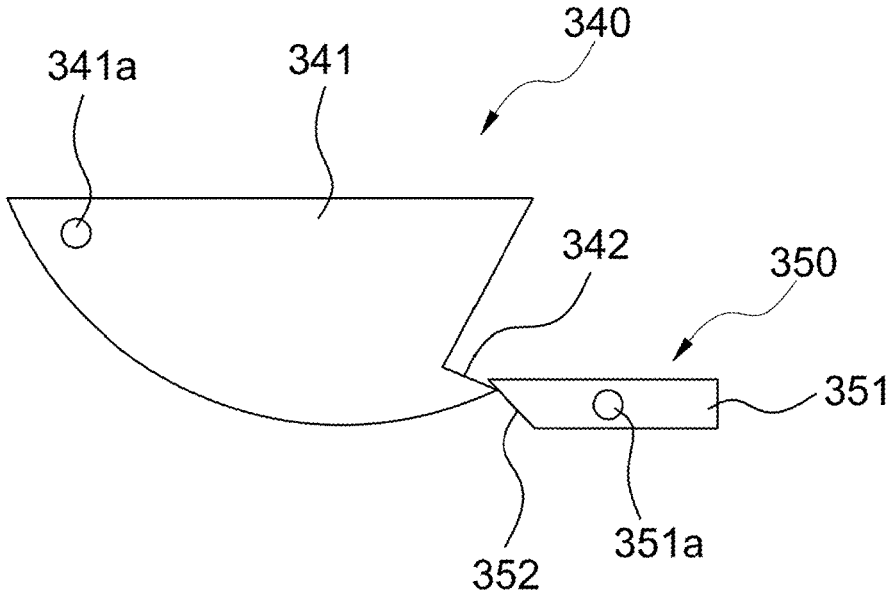
(b)
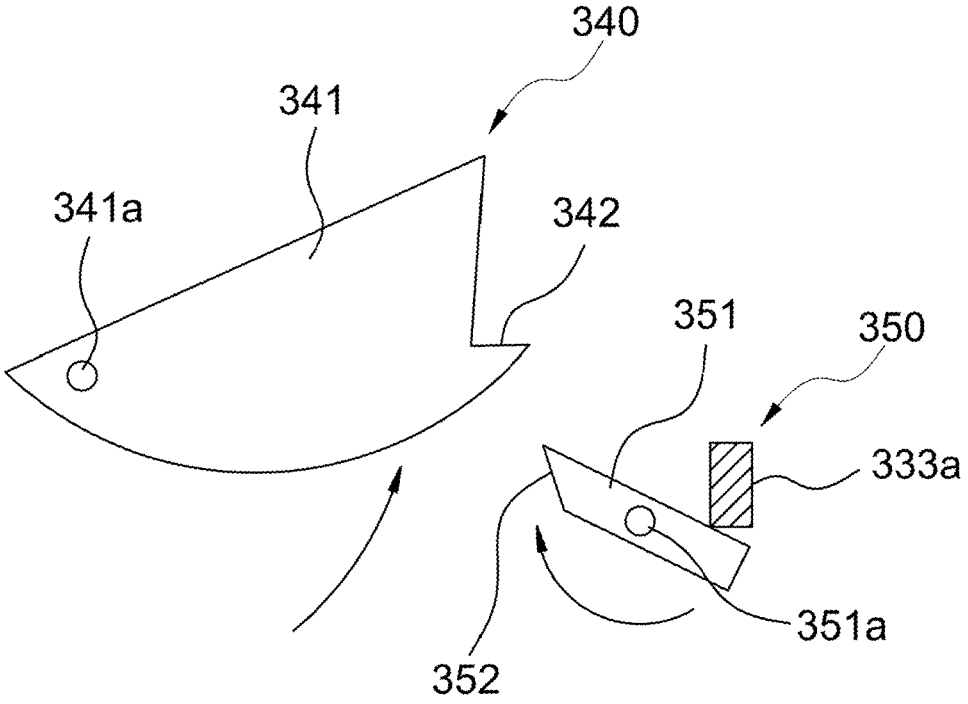

【FIG. 43】
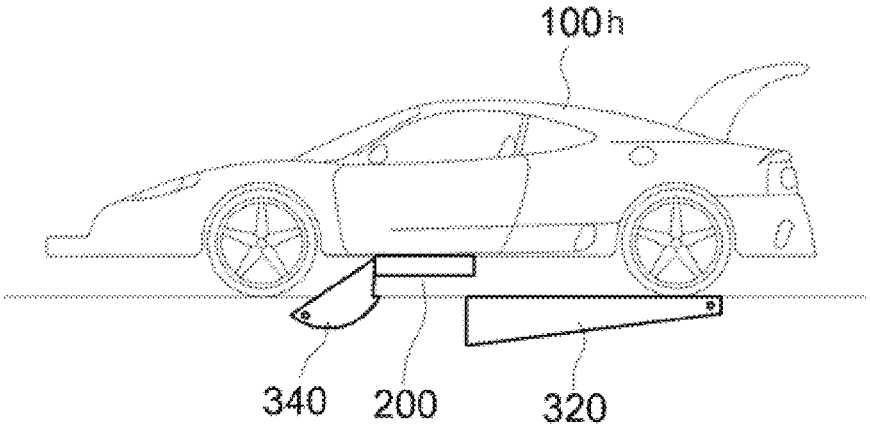

【FIG. 44】
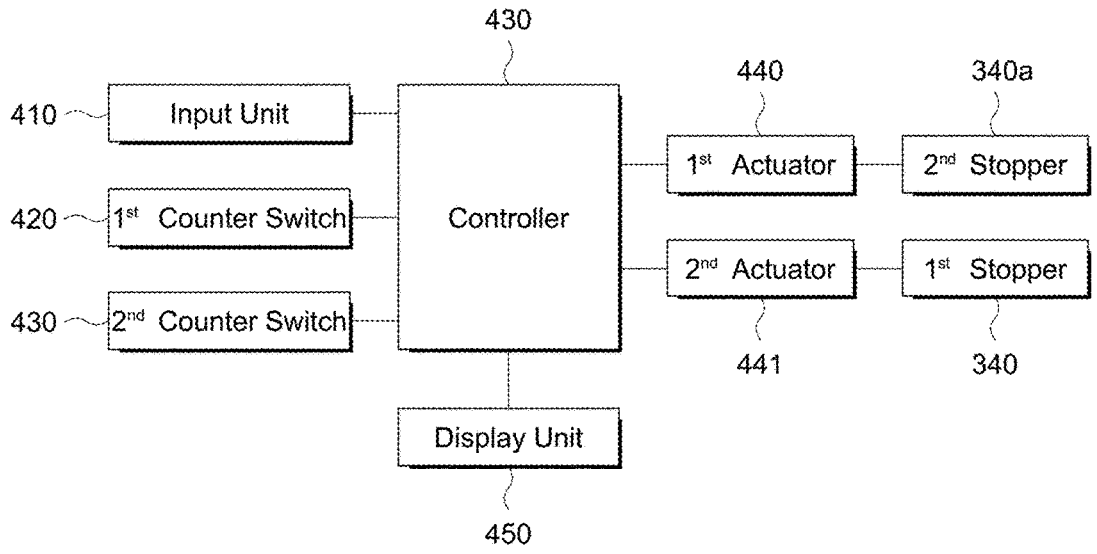
【FIG. 45】
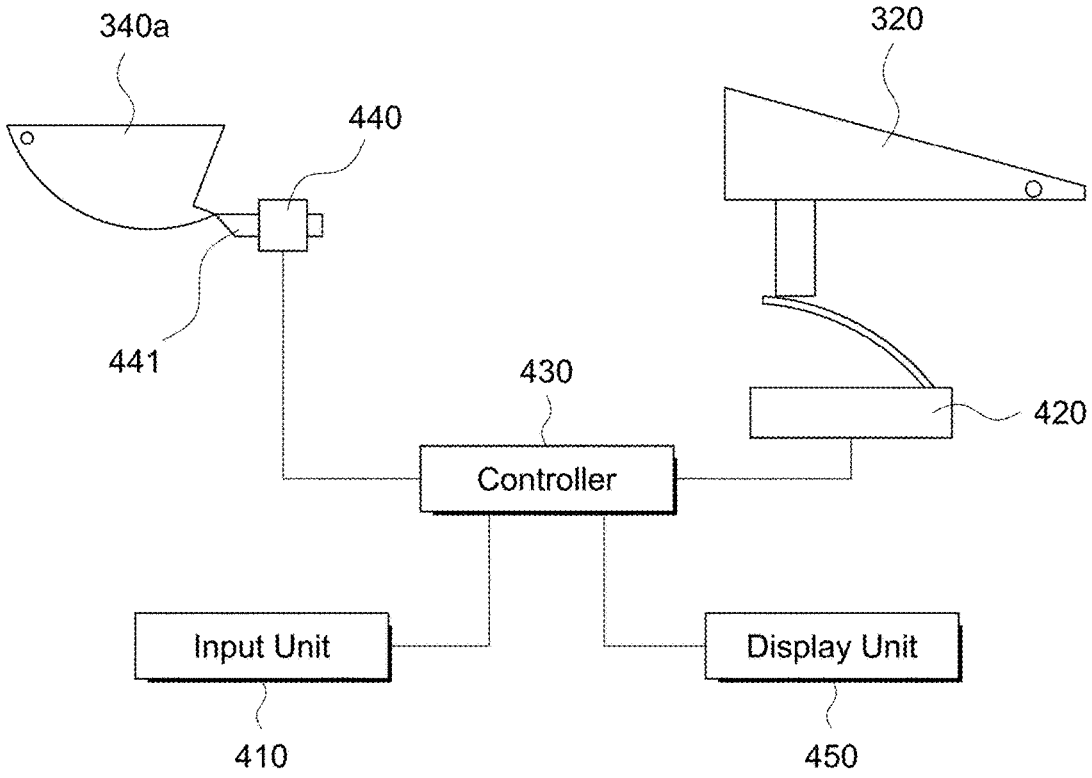

【FIG. 46】
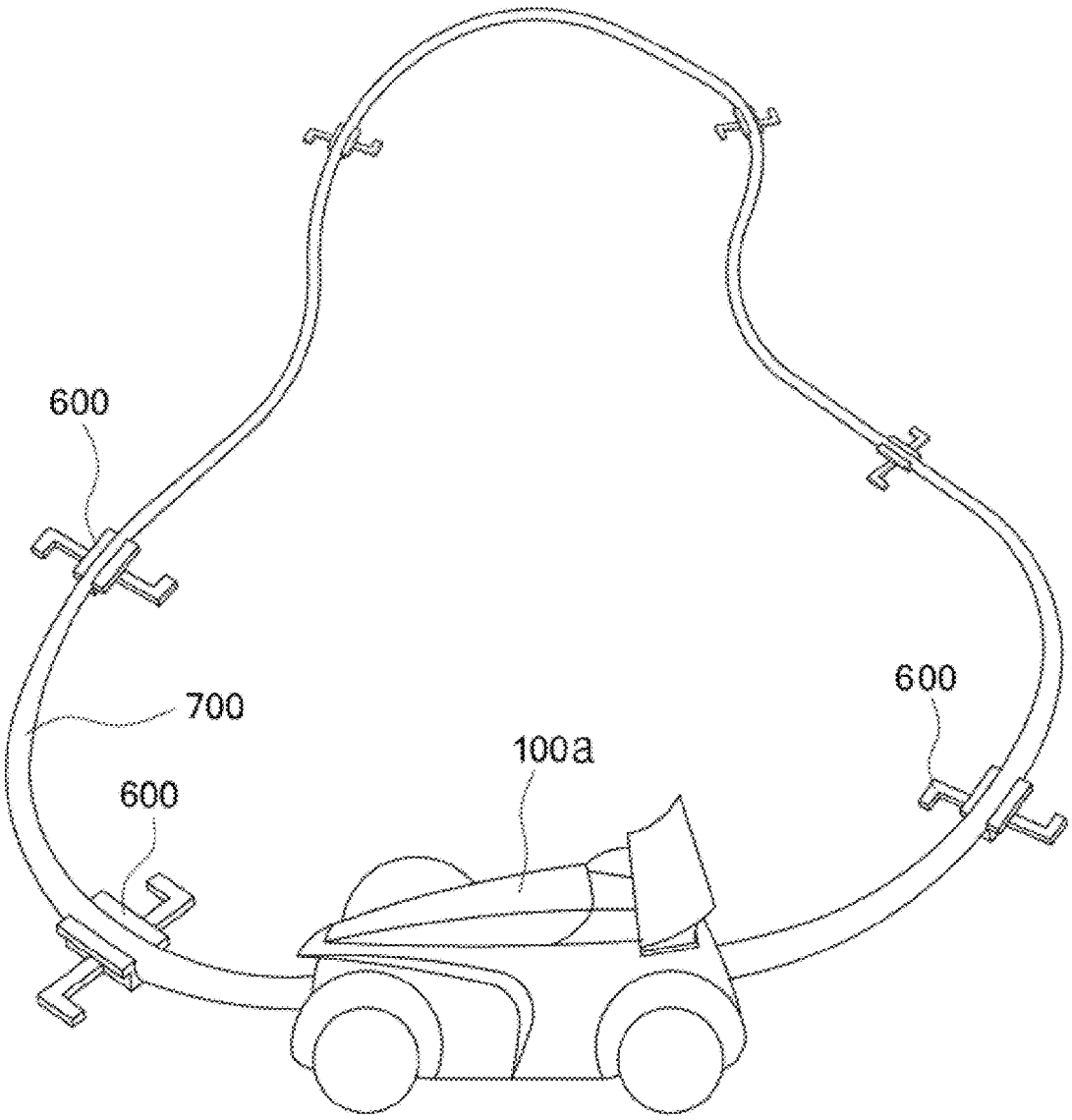

【FIG. 47】
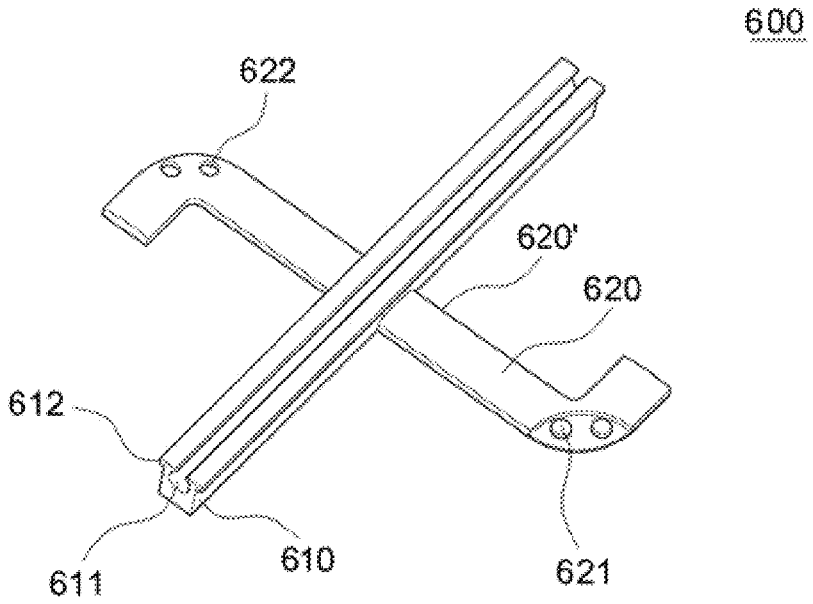
【FIG. 48】
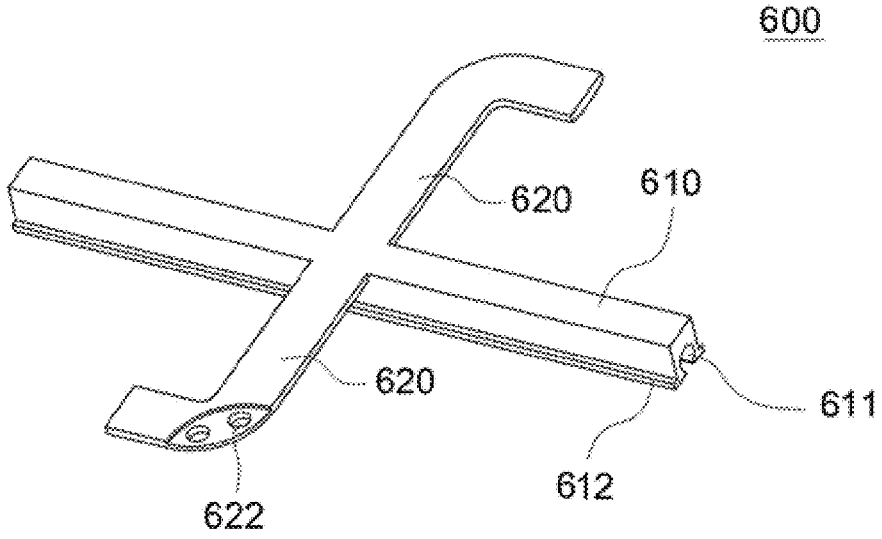

【FIG. 49】
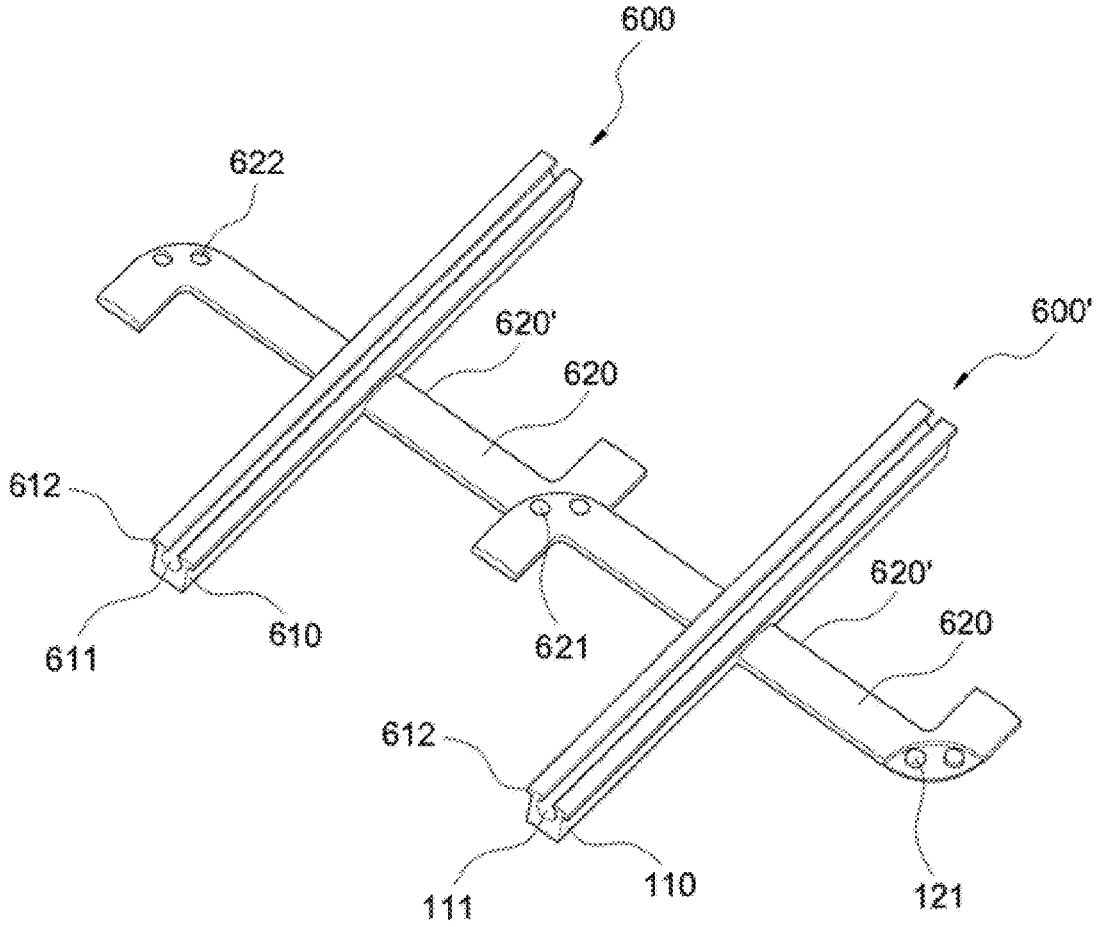

【FIG. 50】
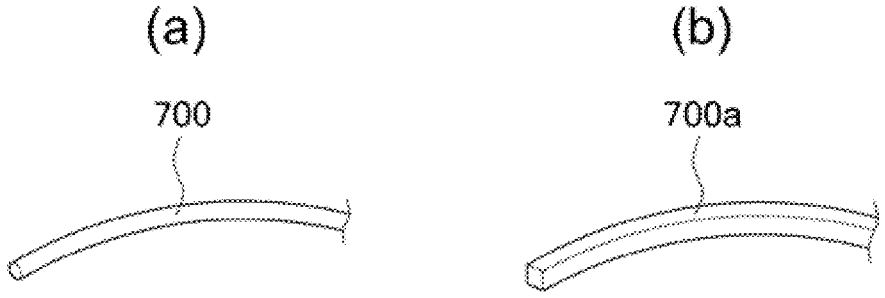

【FIG. 51】
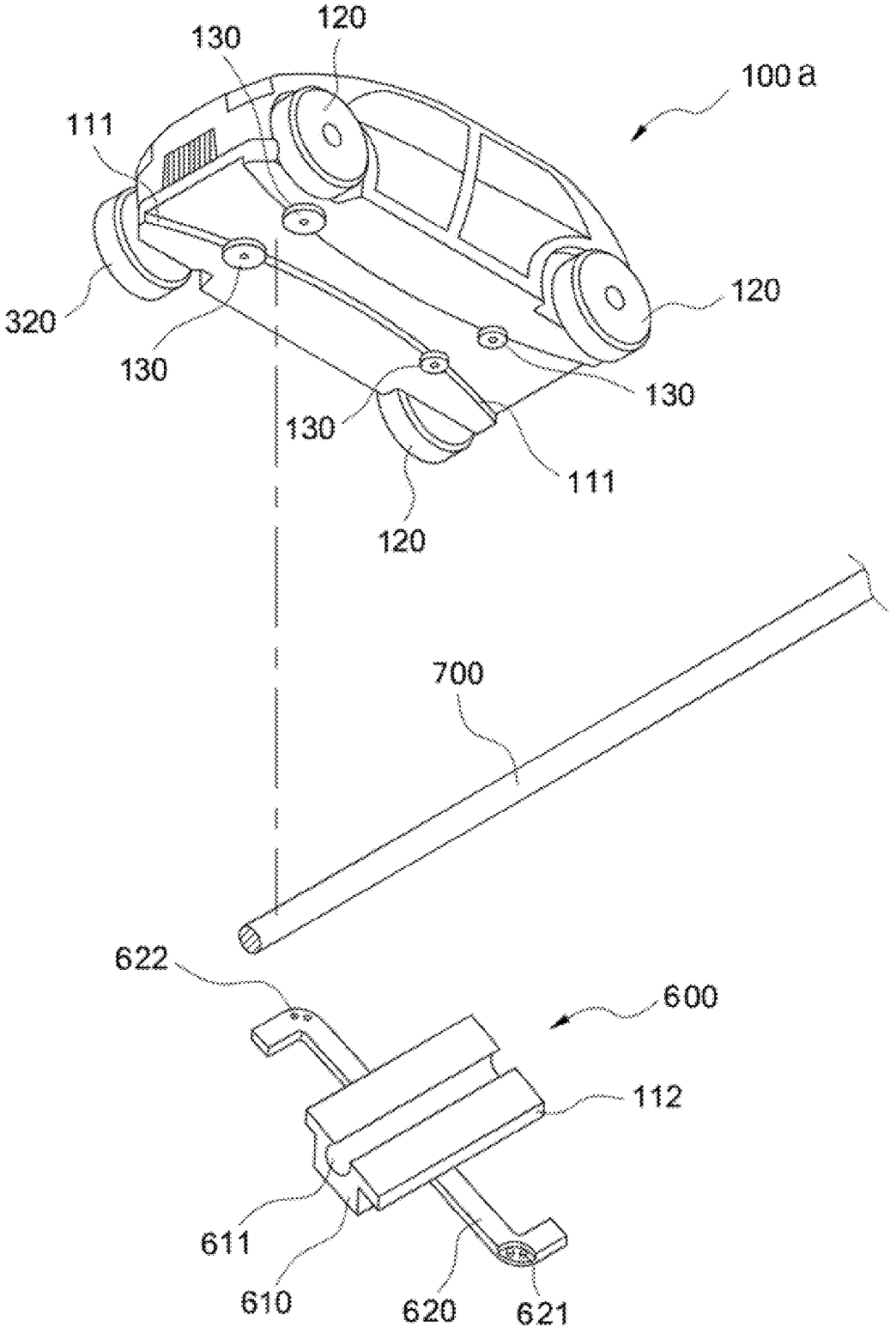

【FIG. 52】
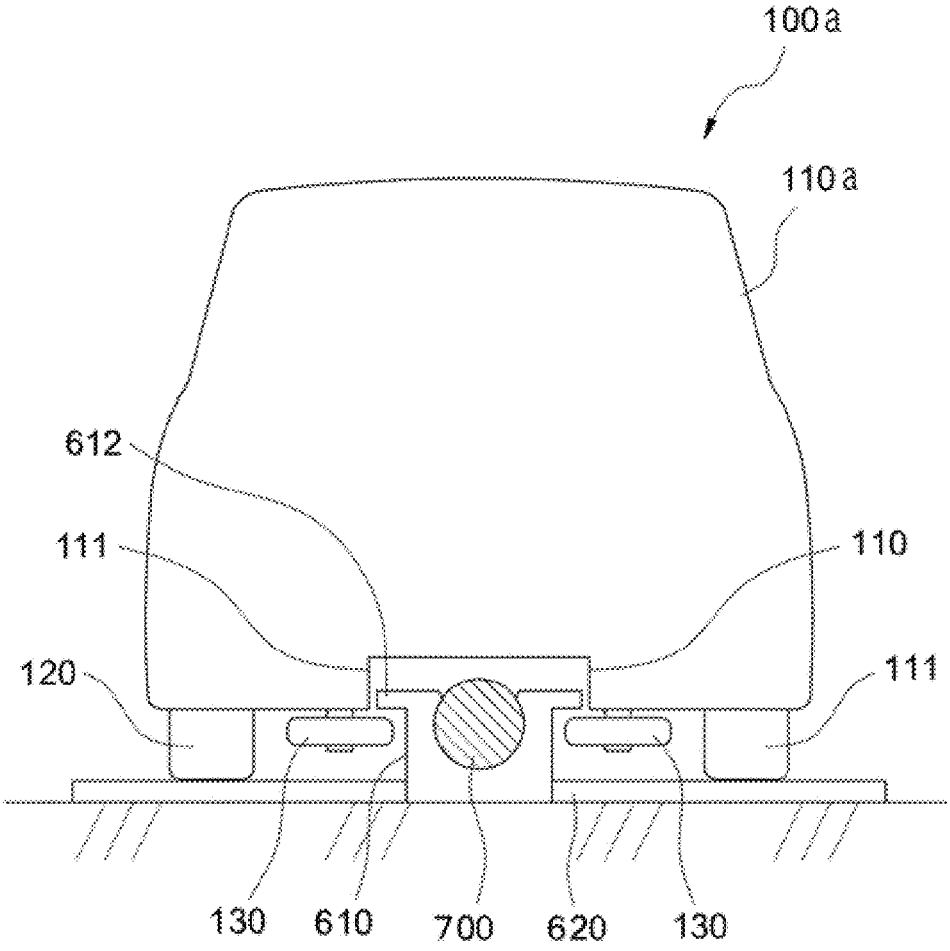

【FIG. 53】
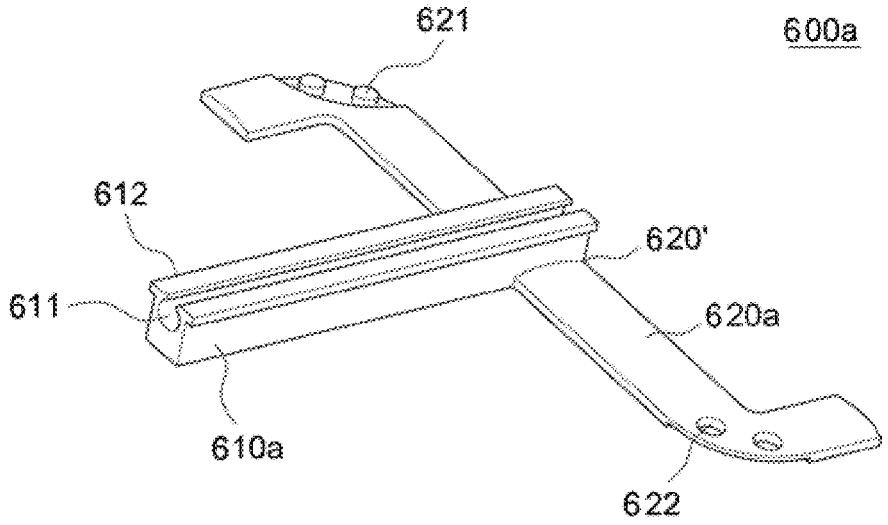
【FIG. 54】
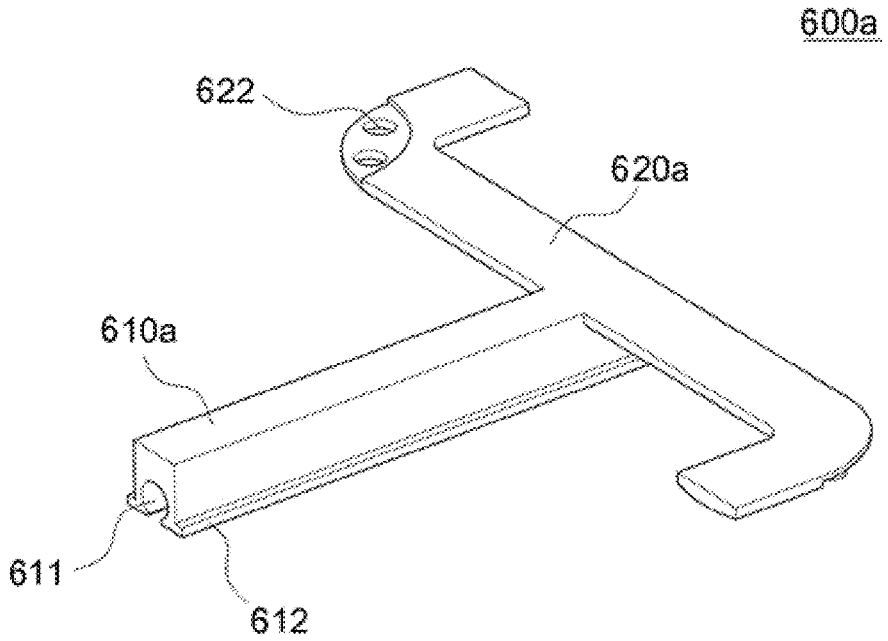

【FIG. 55】
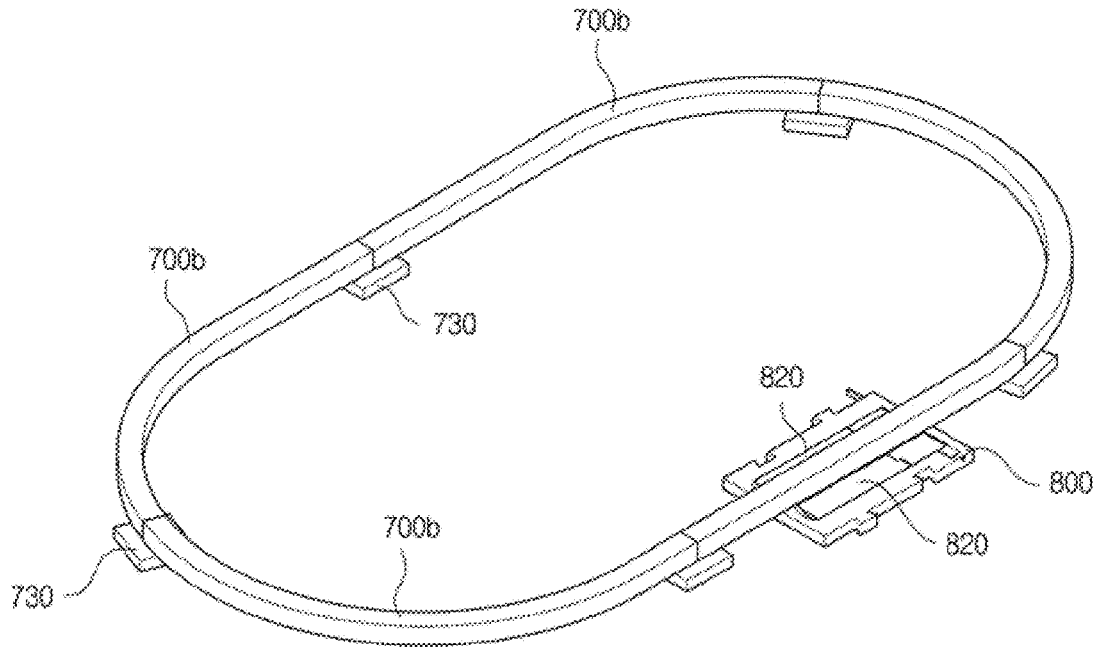
【FIG. 56】
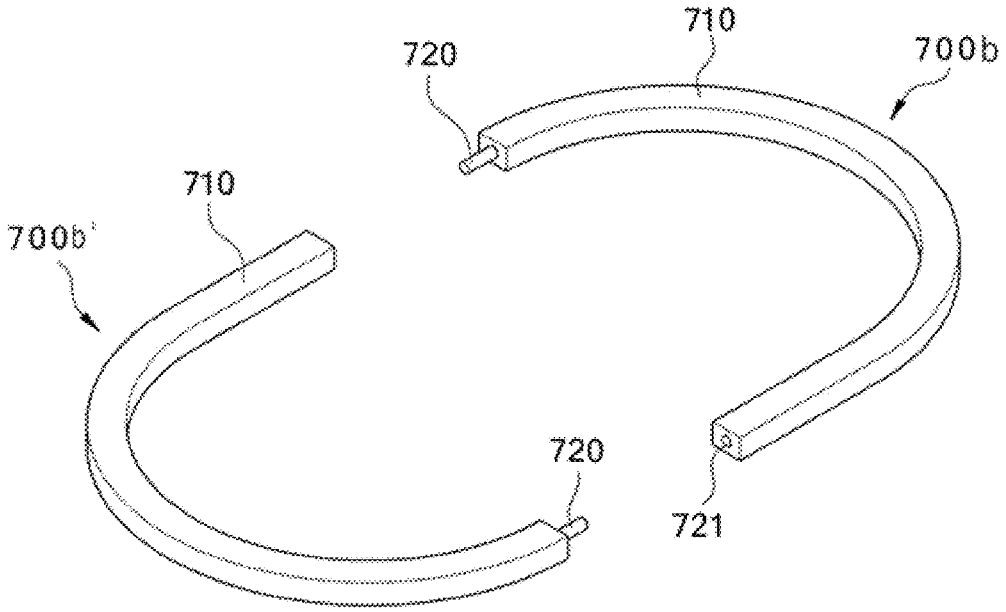

【FIG. 57】
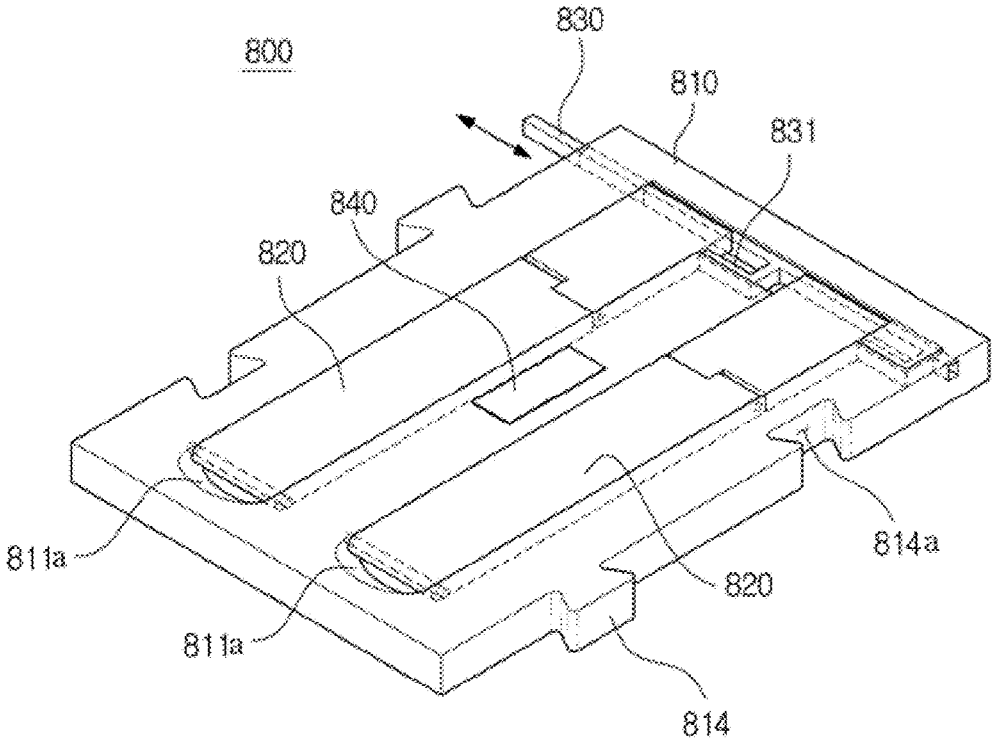
【FIG. 58】
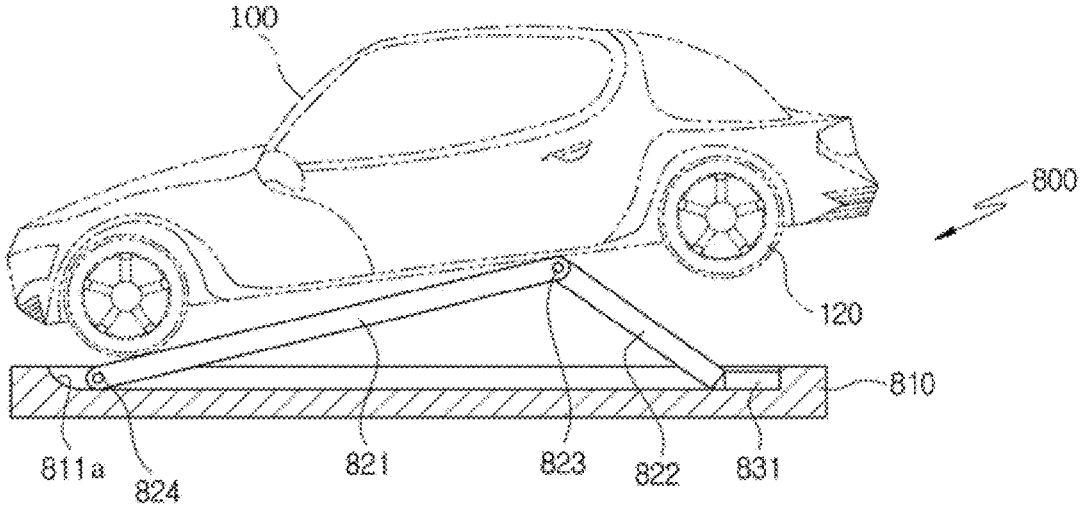

【FIG. 59】
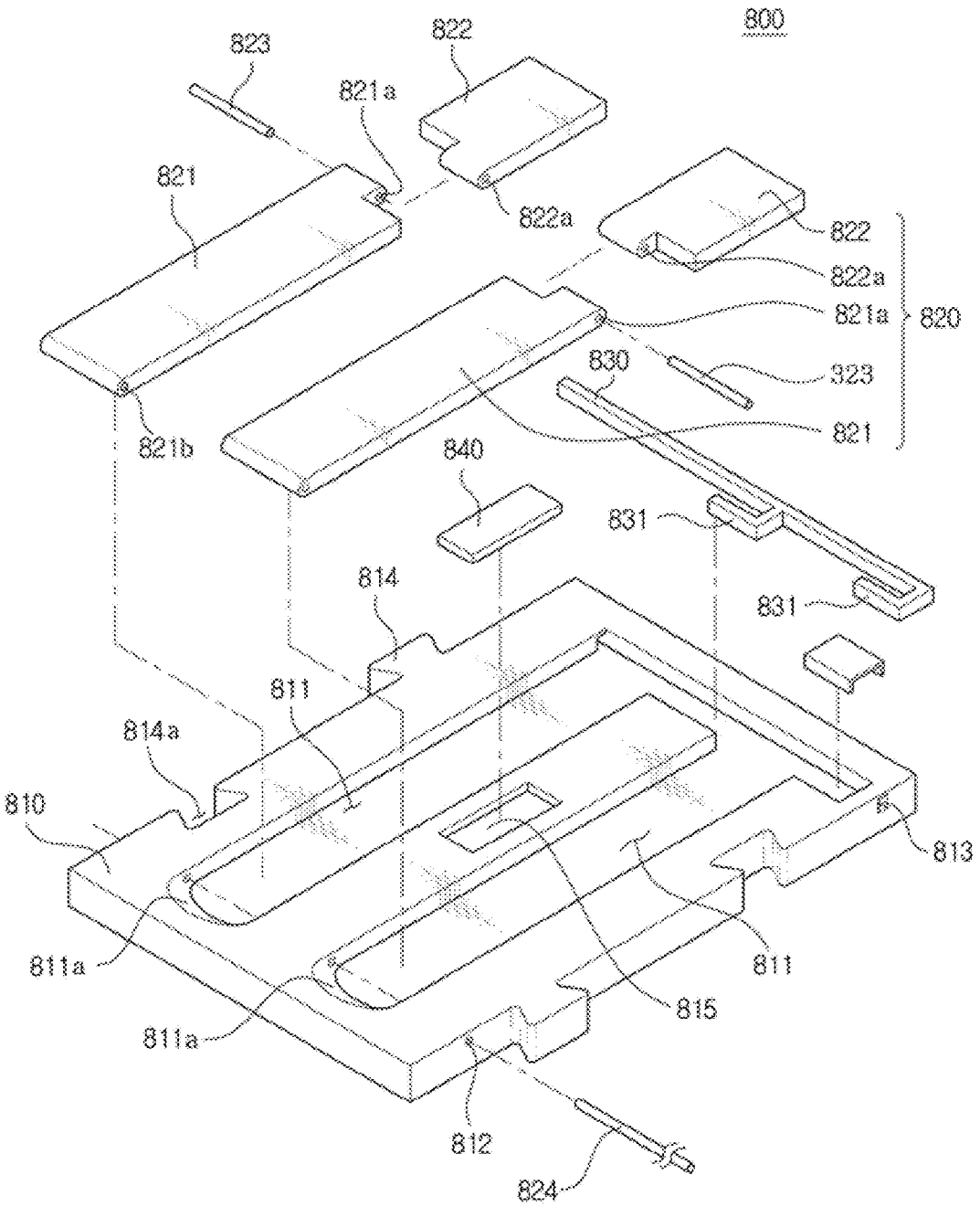

DRIVING TOY AND PLAYING DEVICE USING THE SAME

CROSS REFERENCE TO RELATED APPLICATIONS

This application is a U.S. National Stage Application of International Application No. PCT/KR2017/008999, filed on Aug. 18, 2017, which claims the benefit under 35 USC 119(a) and 365(b) of Korean Patent Application No. 10-2016-0105087 filed on Aug. 18, 2016 and Korean Patent Application No. 10-2016-0129975 filed on Oct. 7, 2016, in the Korean Intellectual Property Office.

TECHNICAL FIELD

The present disclosure relates to a traveling toy and a play apparatus using the same. More specifically, the present disclosure relates to a traveling toy, which is provided with an auxiliary wheel that guides the traveling toy to travel along a track and is capable of traveling on various tracks by changing the position of auxiliary wheel depending on the types of tracks, and a play apparatus using the traveling toy.

BACKGROUND ART

Generally, toys for children include various types of toys capable of traveling, and car-shaped toys are representative of the toys capable of traveling.

Such traveling toys include powered traveling toys and non-powered traveling toys, and the powered traveling toys include a motor that is driven using power supplied from a battery.

In addition, racing traveling toys, which use a high-speed motor, may be used for playing a game through a race with a racing opponent on a racing track set.

FIG. 1 is a perspective view of a racing traveling toy according to the prior art. As shown in FIG. 1, a racing traveling toy 10 includes a main body 11, wheels 12 configured to rotate using power supplied through a battery and a motor mounted in the main body 11, and auxiliary wheels 13 configured to guide, through contact with the track, the traveling toy 10 to change the traveling direction while the traveling toy 10 travels on the track.

FIG. 2 is a plan view of a racing track according to the prior art. As shown in FIG. 2, a track 20 includes a start track 21 in which traveling toys start, a straight track 22, a curved track 23, and a course change track 24 that allows the traveling toys to change the traveling routes from the in-course to the out-course or from the out-course to the in-course.

The conventional racing toy 10 has a problem in that the racing toy 10 is limited in configuration design because the auxiliary wheels 13 are fixed to the front and rear sides of the toy 10 such that the toy travels along the track 20.

The conventional track 20 has a problem in that the track 20 becomes large since the auxiliary wheels 13 exposed to the outside of the racing toy 10 travel along the side walls of the track 20.

In addition, the conventional track 20 has a problem in that the volume thereof is relatively increased since the racing track is formed by connecting multiple blocks having a U-shape in cross section.

Furthermore, there are problems in that it is inconvenient to assemble and use plural blocks since the track is formed by assembling the plural blocks, and in that it is difficult to disassemble the track after use and to store the multiple disassembled blocks.

DETAILED DESCRIPTION OF THE INVENTION

Technical Problem

In order to solve the problems described above, the present disclosure aims to provide a traveling toy and a play apparatus using the same. More specifically, the present disclosure relates to a traveling toy, which is provided with auxiliary wheels that guide the traveling toy to travel along a track and is capable of traveling on various tracks by changing the positions of auxiliary wheels depending on the types of tracks, and to provide a play apparatus using the traveling toy.

Technical Solution

In view of the above aspects, a embodiments of the present disclosure may include: a toy body including multiple wheels; and auxiliary wheels installed on the toy body and configured to come into contact with at least one of a rail unit or side wall portions formed in a track such that the toy body moves along the track, in which the auxiliary wheels are installed on at least one of an upper part and a lower part of the toy body.

In addition, according to the embodiments of the present disclosure, the auxiliary wheels are fixedly installed at predetermined positions in the toy body, or are formed in a variable structure in which the auxiliary wheels are separated or moved from the toy body to be shifted from a first position to a second position.

In addition, according to the embodiments of the present disclosure, at the first position, the auxiliary wheels are positioned to be directed inwards to face each other inwards in the lower part of the toy body, and at the second position, the auxiliary wheels are positioned to protrude in forward and rearward directions of the toy body.

In addition, according to the embodiments of the present disclosure, at the second position, the auxiliary wheels protrude beyond a width direction size of the toy body and come into contact with side surface portions of the track.

In addition, according to the embodiments of the present disclosure, the variable structure is configured such that the auxiliary wheels are detached from/attached to the toy body, slide, or rotate about an arbitrary rotary shaft to be displaced.

In addition, according to the embodiments of the present disclosure, the toy body includes a guide portion on a bottom surface thereof, which forms a path through which a rail unit of the track passes.

In addition, according to the present disclosure, the traveling toy includes first auxiliary wheels installed in forward and rearward directions of the toy body to come into contact with the side wall portions of the track.

In addition, according to the embodiments of the present disclosure, the toy body is installed such that an upper body and a lower body are separable from each other so that a toy body having a different shape can be coupled to the lower body instead of the upper body.

In addition, according to the embodiments of the present disclosure, the upper body of the toy body, which is configured to be separable, is provided with an upper fixing portion, a lower fixing portion is formed in the lower part of the toy body, and the upper fixing portion and the lower fixing portion are coupled to each other using press-fitting or a magnetic field of a magnet.

In addition, according to the embodiments of the present disclosure, the traveling toy includes a switch provided with a switching lever configured to perform an ON/OFF operation to supply driving power, and when the switching lever comes into contact with an arbitrary object at an ON position, the switching lever is switched to an OFF position by an elastic force to interrupt power supply.

In addition, according to the embodiments of the present disclosure, an item detachably installed on the traveling toy, and configured to compress the switch to be displaced from the OFF position to the ON position when the item is attached to the lower part of the traveling toy, and when the item is detached from the traveling toy, the switch is returned to the OFF position.

In addition, according to the embodiments of the present disclosure, the item further includes a magnetic body.

In addition, according to the embodiments of the present disclosure, a traveling toy includes: a housing having a fixing protrusion configured to support the item to be in close contact with the traveling toy; and a switch installed in the housing and configured to perform ON/OFF switching such that power is supplied to the traveling toy by being displaced depending on whether the item is detached or attached.

In addition, according to the embodiments of the present disclosure, the housing further includes, on a bottom surface thereof, a guide grove configured to guide an external object to move in a traveling direction of the traveling toy.

In addition, according to the embodiments of the present disclosure, the switch includes: a switching lever configured to be displaced from the OFF position to the ON position by the item attached to the traveling toy so as to connect a first electrode and a second electrode to a power supply unit; a leaf spring configured to cause the first and second electrodes to be electrically connected to the power supply unit depending on a position of the switching lever; and an elastic unit installed on the leaf spring, wherein, when the switching lever is located at the ON position, the elastic unit is compressed and when the item is separated, the elastic unit is stretched to provide an elastic force such that the switching lever is located at the OFF position.

In addition, according to the embodiments of the present disclosure, a traveling toy further includes: a switch including a magnetic switching lever configured to perform an ON/OFF operation to supply driving power. The switch includes: the magnetic switching lever installed on the leaf spring, wherein the magnetic switching lever is configured to be displaced from an OFF position to an ON position by the item, which is attached to the bottom surface of the traveling toy and includes a magnetic body therein, and a magnetic field so as to connect a first electrode and a second electrode such that driving power is supplied; a leaf spring configured to cause the first and second electrodes to be electrically connected to each other depending on the ON/OFF position of the magnetic switching lever; and an elastic unit installed on the leaf spring, wherein, when the magnetic switching lever is located at the ON position, the elastic unit is stretched and when the item is separated, the elastic unit is compressed to provide an elastic force such that the magnetic switching lever is located at the OFF position.

In addition, according to the embodiments of the present disclosure, a traveling toy further includes: a switch unit configured to perform an ON/OFF switching operation such that driving power is supplied to the traveling toy when a side of the switch lever comes into contact with a rail unit installed in the track and another side of the switch lever is displaced.

In addition, according to the embodiments of the present disclosure, a traveling toy further includes: a body switch unit configured to perform the ON/OFF switching operation such that driving power is supplied to the traveling toy according to a user's setting.

In addition, according to the embodiments of the present disclosure, the body switch unit further includes: a body switch lever configured to operate according to the user's manipulation; a first contact configured to be displaced according to the operation of the body switch lever; and a second contact spaced apart from the first contact by a predetermined distance, in which one side surface of the second contact is electrically connected to the first contact depending on a displacement of the first contact.

In addition, according to the embodiments of the present disclosure, the switch unit is disposed on another side of the second contact such that, when another side of the switch unit is displaced, the switch unit is configured to displace the second contact so as to be electrically connected to the first contact.

In addition, a embodiments of the present disclosure includes: a traveling toy; and a track including a finish track including multiple travel courses disposed side by side, wherein, when the finish track is operated such that a detector installed in each travel course counts a number of laps of a traveling toy which travels on the travel course and the number of laps of the traveling toy reaches a preset number of laps, a stopper protrudes in the travel course.

In addition, according to the embodiments of the present disclosure, the finish track includes: a detector installed on each travel course so as to detect whether or not the traveling toy passes therethrough; a counter configured to count the number of laps of the traveling toy, which passes by the detector; a stopper installed at a predetermined distance from the detector, in which, when the counter counts the preset number of laps, the stopper is unlocked to partially protrude to the travel course; and a latch configured to cause the stopper to be locked or unlocked according to an operation of the counter.

In addition, according to the embodiments of the present disclosure, the detector includes: an upper detector body having an upper surface forming an inclined surface; a lower detector body installed under the upper detector body and having a long detector through hole formed in a vertical direction; and a detector spring configured to provide an elastic force such that the upper detector body and the lower detector body maintain a predetermined position.

In addition, according to the embodiments of the present disclosure, the detector includes: a button portion on which a lap number is displayed; a counter body portion extending to a side of the button portion by a predetermined length to pass through the detector, wherein, when the detector operates, the counter body portion is shifted by a predetermined distance; a subsidiary counter body installed on the counter body portion and configured to cause the latch to be locked or unlocked depending on the shift position of the counter body portion; and a counter spring configured to provide an elastic force such that the counter body portion is shifted.

In addition, according to the embodiments of the present disclosure, the counter body portion includes: first engagement protrusions provided at a predetermined interval in a longitudinal direction of the counter body portion and configured to mate with the detector such that the counter body portion maintains a predetermined position; and second engagement protrusions provided opposite the first engagement protrusions and configured to prevent the counter body portion from being shifted by a predetermined distance or more.

In addition, according to the embodiments of the present disclosure, the stopper includes: a stopper body; a stopper engagement protrusion provided at one side of the stopper body; and a stopper spring configured to provide an elastic force such that the stopper body maintains a predetermined position.

In addition, according to the embodiments of the present disclosure, the latch includes: a latch body; and a latch spring configured to provide an elastic force such that the latch body maintains a predetermined position.

In addition, according to the embodiments of the present disclosure, the finish track includes: a detector installed on each travel course so as to detect whether or not the traveling toy passes thereby; an input unit configured to detect the number of laps of the traveling toy from a user; a counter switch installed below the detector and configured to count the number of laps of the traveling toy, which passes through the detector; a controller configured to: detect the number of laps input from the input unit and the number of laps counted by the counter switch, display the counted number of laps, compare the input number of laps and the counted number of laps and control output of an operation signal of an actuator according to a comparison result; the actuator configured to perform an ON/OFF operation according to the operation signal output from the controller; a stopper installed at a predetermined distance from the detector and configured to partially protrude to the travel course by being locked or unlocked according to the operation of the actuator; a latch configured to cause the stopper to be locked or unlocked according to an operation of the counter; and a display unit configured to display the number of laps according to a control signal output from the controller.

In addition, according to the embodiments of the present disclosure, the detector is interlocked with the stopper installed on a neighboring travel course, and when the traveling toy, which has passed through the detector, is a rearmost wheel, the detector causes the stopper of the neighboring travel course to be unlocked.

In addition, a embodiments of the present disclosure may include: a traveling toy; and a track configured to form an arbitrary course along which the traveling toy moves, and formed of a rail unit of a single line.

In addition, according to the embodiments of the present disclosure, the track includes: a rectangular floor unit; a rail unit installed on an upper portion in a longitudinal direction of the floor unit; and fastening units provided at opposite lateral sides of the floor unit to be coupled to a neighboring track so as to increase a length of the track.

In addition, according to the embodiments of the present disclosure, the rail unit of the track is formed in a line shape having a predetermined thickness.

In addition, according to the embodiments of the present disclosure, the track is formed of a flexible material.

In addition, according to the embodiments of the present disclosure, the track includes: a rail unit having a predetermined length; and coupling units provided at opposite ends of the rail unit to be coupled to each other such that the rail unit forms a closed circuit.

In addition, according to the embodiments of the present disclosure, the rail unit has a cross-sectional shape formed in any one of a "⊙" shape, a "○" shape, a "□" shape, a "▽" shape, and a "◇" shape.

In addition, according to the embodiments of the present disclosure, the coupling units include: a track coupling portion provided to extend by a predetermined length from one end of the rail unit; and a track coupling groove provided at another end of the rail unit such that the track coupling portion is inserted into the track coupling groove.

In addition, according to the embodiments of the present disclosure, the track coupling portion is formed of a magnetic body.

In addition, according to the embodiments of the present disclosure, the track further includes a track fixing unit configured to support the rail unit such that the rail unit is fixed while forming an arbitrary course.

In addition, according to the embodiments of the present disclosure, the track includes: a track fixing unit including a flange configured to fixedly support the rail unit and to be mated with a portion of the traveling toy which travels along the rail unit so as to prevent course deviation of the traveling toy; and a rail unit configured to the track fixing unit so as to form the travel course of the traveling toy.

In addition, according to the embodiments of the present disclosure, the track fixing unit includes: a fixing unit body including an insertion groove into which the rail unit is fixedly inserted, and flanges protruding by a predetermined length to the opposite sides of a distal end of the insertion groove; and a support portion provided on a side surface of the fixing unit body and configured to fixedly support the fixing unit body on a ground.

In addition, according to the embodiments of the present disclosure, the support portion is provided in a center or on a side of the fixing unit body, and the support portion forms an inclined surface.

In addition, according to the embodiments of the present disclosure, the support portion includes: a support portion coupling protrusion formed on one side of the fixing unit body; and a support portion coupling groove formed on another side of the fixing unit body.

In addition, according to the embodiments of the present disclosure, the play apparatus further includes: a launcher configured such that a lift unit installed to be movable upwards/downwards moves the traveling toy upwards to space a switch unit, which controls driving power of the traveling toy, apart from the track, thereby causing the driving power to be turned OFF, and when the lift unit moves the traveling toy downwards to bring the switch unit into contact with the track, the driving power is turned ON.

In addition, according to the embodiments of the present disclosure, the launcher includes: a launcher body; the lift unit installed on the launcher body to be movable upwards/downwards, wherein, when the lift unit comes into contact with a bottom surface of the traveling toy and moves upwards, the traveling toy is spaced apart from the track and when the lift unit moves downwards, the traveling toy is brought into contact with the track; and a button unit provided in the launcher body and configured to support the lift unit such that the lift unit, which has moved upwards, maintains a predetermined position.

In addition, according to the embodiments of the present disclosure, the launcher further includes a fixing unit coupled to the track such that the track is fixed on the launcher body.

In addition, according to the embodiments of the present disclosure, the launcher body further includes coupling units one opposite side surfaces thereof to be coupled to a neighboring launcher such that the launcher body is horizontally connected to the neighboring launcher.

Advantageous Effects

The present disclosure is advantageous in that the positions of auxiliary wheels are changed depending on the types of tracks, so that a traveling toy can be driven regardless of the types of tracks.

In addition, the present disclosure is advantageous in that it is possible to solve the problem in design limitation of a traveling toy by providing auxiliary wheels for guiding the traveling toy along the track to the lower part of the traveling toy.

Further, the present disclosure is advantageous in that it is easy to assemble and disassemble a racing track and to provide tracks of various courses.

The present disclosure is advantageous in that the volume of a disassembled track is small and thus it is easy to store the track.

BRIEF DESCRIPTION OF THE DRAWINGS

FIG. 42 is an exemplary view showing a stopper operation process of the finish track according to FIG. 39;

FIG. 43 is an exemplary view showing a process in which a traveling toy stops in the finish track according to FIG. 39;

FIG. 44 is a block diagram showing another embodiment of the finish track in the track using a traveling toy according to FIG. 38;

FIG. 45 is an exemplary view showing a connection structure of the finish track according to FIG. 44;

FIG. 46 is a perspective view showing a rail-type track of a play apparatus using a traveling toy according to the present disclosure;

FIG. 47 is a perspective view showing a rail-type track fixing unit according to FIG. 46;

FIG. 48 is a perspective view showing the rear side of the rail-type track according to FIG. 47;

FIG. 49 is a perspective view showing the state in which the rail-type track fixing units according to FIG. 47 are coupled;

FIG. 50 is a perspective view showing a rail of a rail-type track according to FIG. 46;

FIG. 51 is a perspective view showing the rail-type track and the traveling toy according to FIG. 46;

FIG. 52 is an exemplary view showing an operation process of the rail-type track and the traveling toy according to FIG. 46;

FIG. 53 is a perspective view showing another embodiment of the rail-type track fixing unit according to FIG. 46;

FIG. 54 is a perspective view showing the rear side of the toy track according to FIG. 53;

FIG. 55 is a perspective view showing another embodiment of the rail-type track according to FIG. 46;

FIG. 56 is a perspective view showing a rail structure of the rail-type track according to FIG. 55;

FIG. 57 is a perspective view showing a launcher of the play apparatus using a traveling toy according to FIG. 46;

FIG. 58 is an exemplary view showing an operation process of the launcher according to FIG. 57; and FIG. 59 is an exploded perspective showing the configuration of the launcher according to FIG. 57.

MODE FOR CARRYING OUT THE INVENTION

Hereinafter, a traveling toy according to the present disclosure and a play apparatus using the same will be described in detail with reference to the accompanying drawings.

First Embodiment

Figure 1:
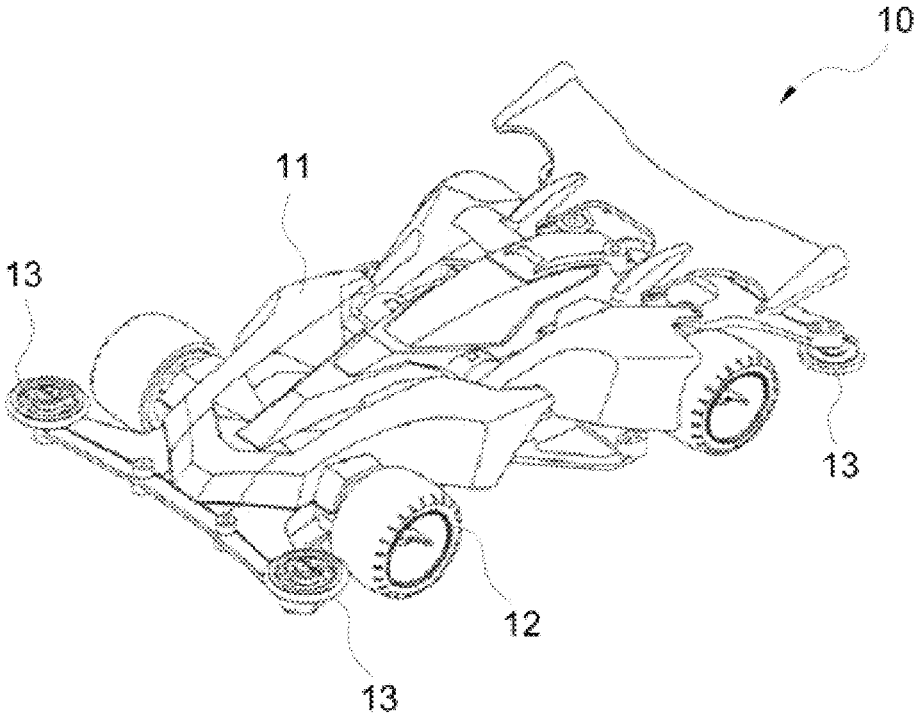
FIG. 1 is a perspective view showing a racing traveling toy according to the prior art.
Figure 2:
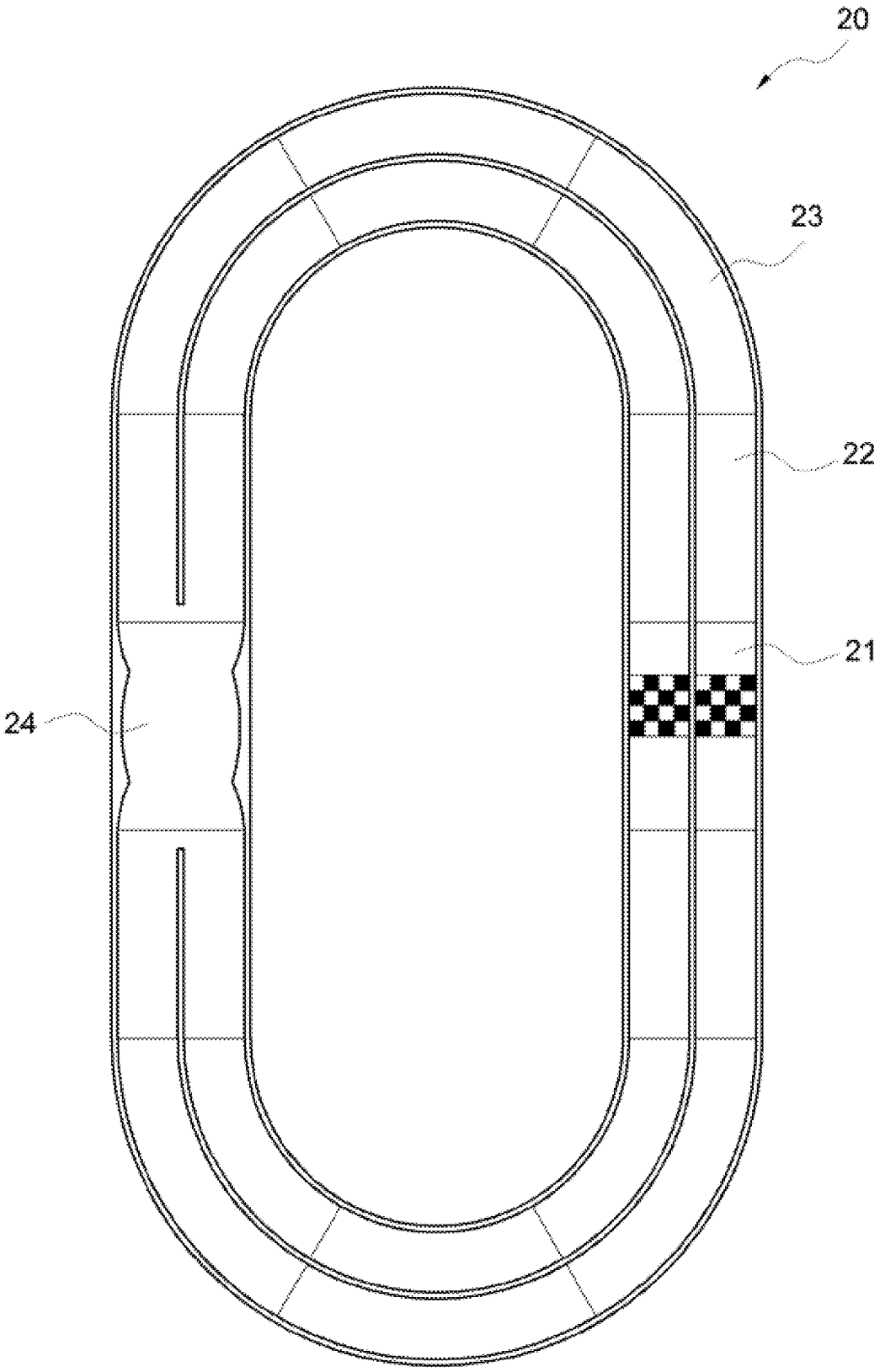
FIG. 2 is a plan view showing a racing track according to the prior art.
Figure 3:
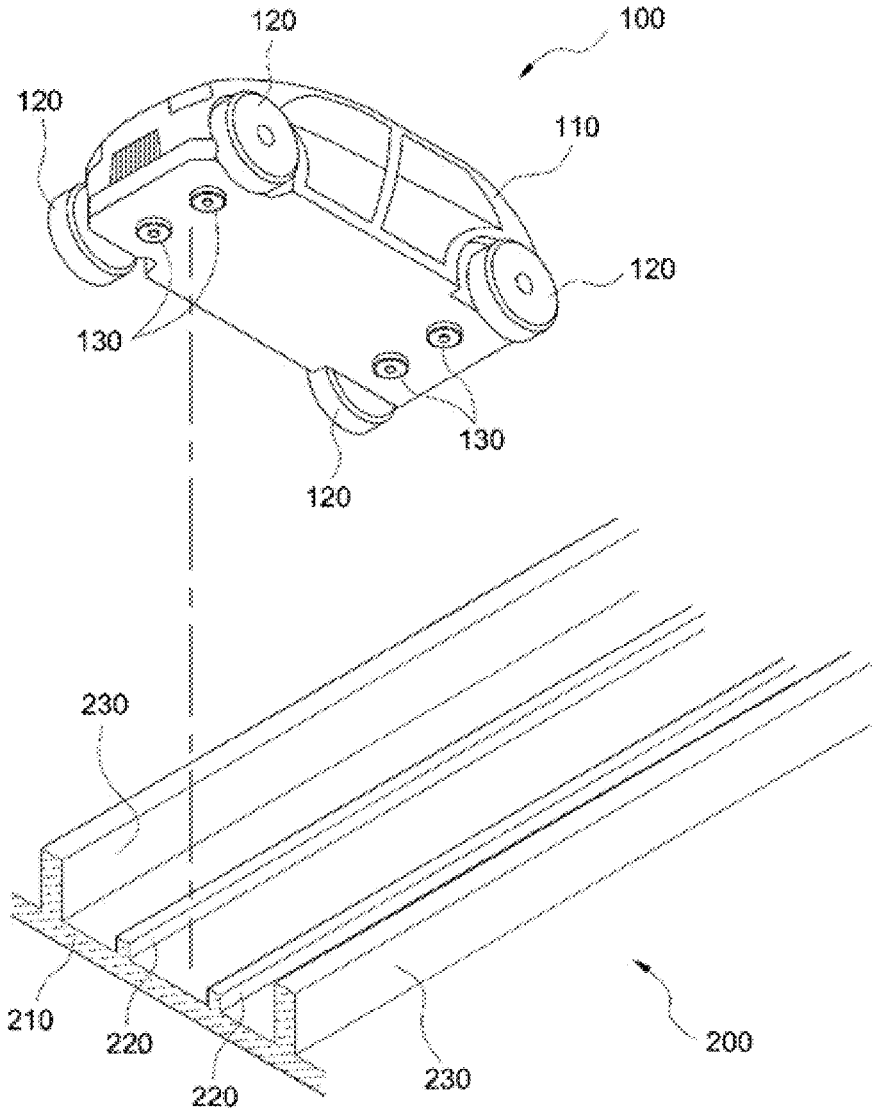
FIG. 3 is a perspective view showing a first embodiment of a traveling toy according to the present disclosure.
Figure 4:
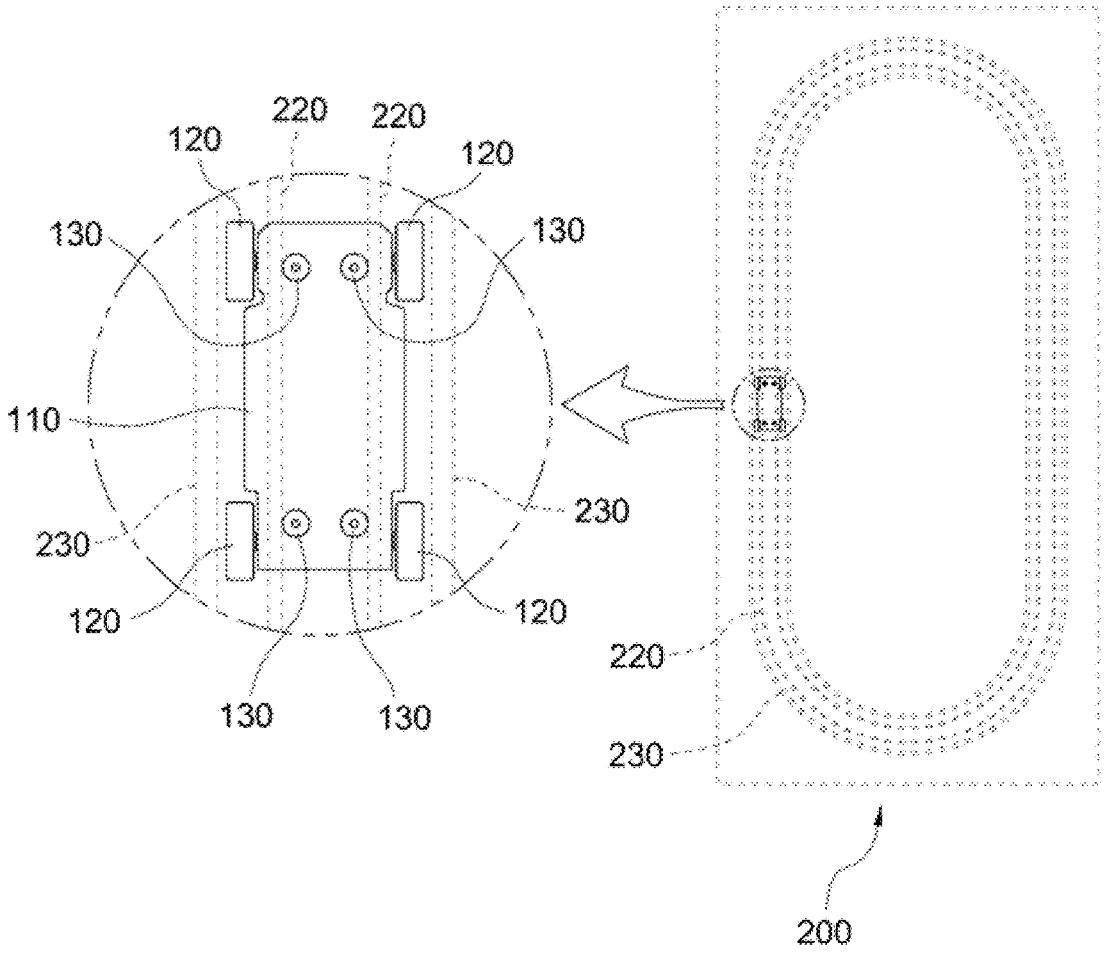
FIG. 4 is an exemplary view illustrating a process in which the traveling toy according to FIG. 3 moves along a track.
Figure 5:
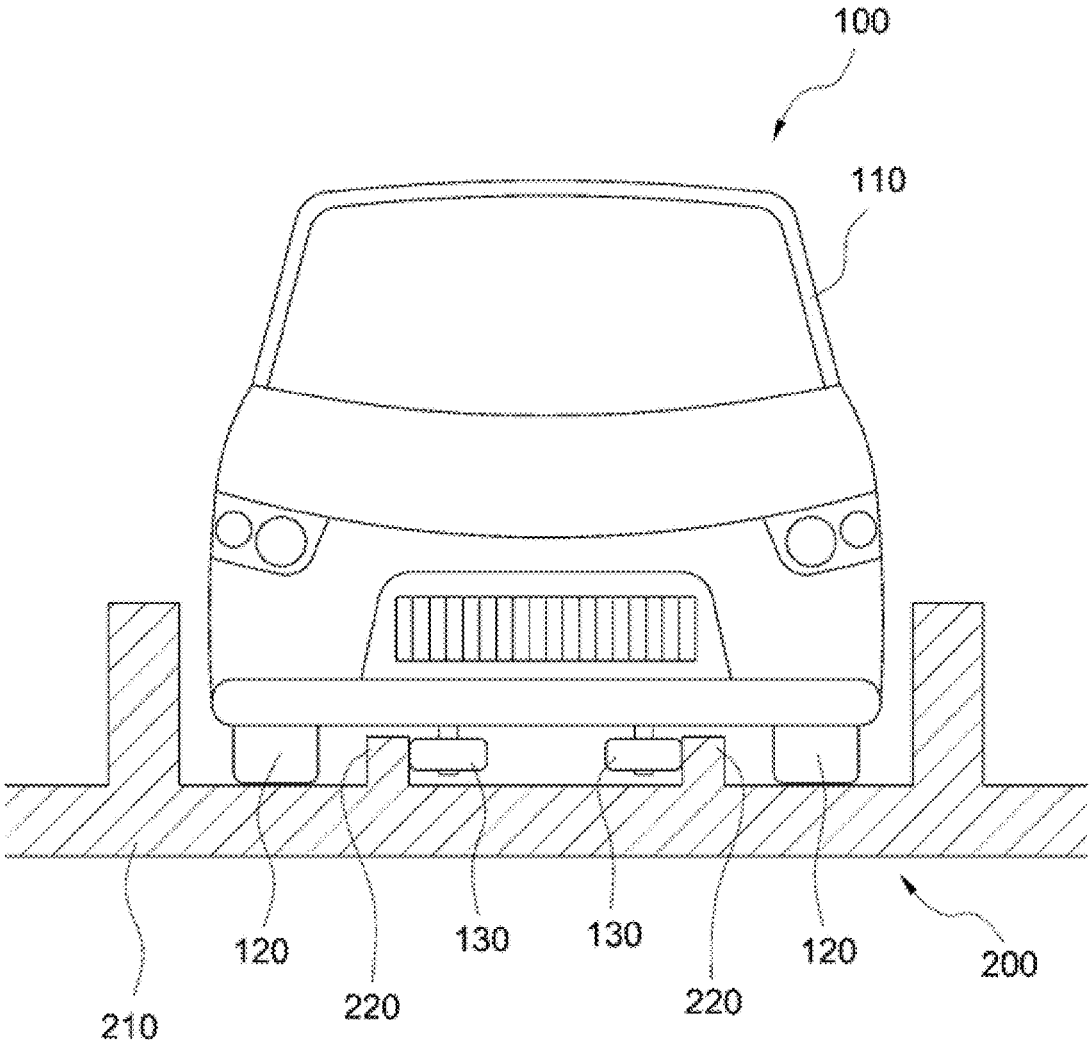
FIG. 5 is a front view showing the state in which the traveling toy according to FIG. 3 is mounted on a track.
Figure 6:
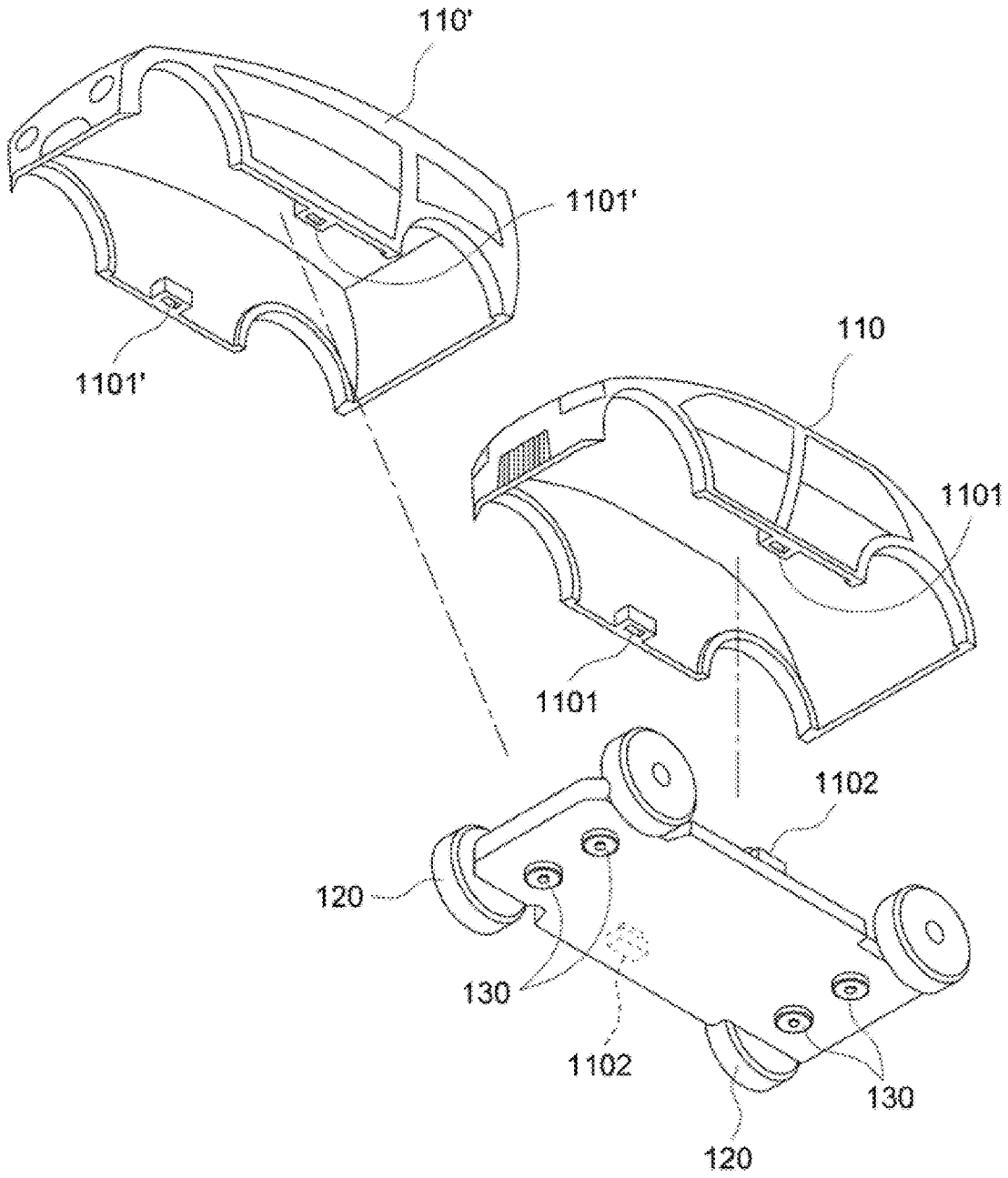
FIG. 6 is an exploded perspective view showing a process of changing the shape of a toy body of the traveling toy according to FIG. 3.

FIG. 3 is a perspective view showing a first embodiment of a traveling toy according to the present disclosure, FIG. 4 is an exemplary view illustrating a process in which the traveling toy according to FIG. 3 moves along a track, and FIG. 5 is a front view showing the state in which the traveling toy according to FIG. 3 is mounted on a track;

As illustrated in FIGS. 3 to 5, a traveling toy 100 according to the first embodiment includes multiple wheels 120 and multiple auxiliary wheels 130, which are mounted on a toy body 110 having a predetermined shape, and is configured to be able to travel along a track 200 that provides a predetermined route.

In addition, the traveling toy 100 includes a driving unit (not shown) including a motor or the like so as to transmit power to the wheels 120, so that the traveling toy 100 can be operated.

Although the toy body 110 is configured in a vehicle shape, the present disclosure is not limited thereto, and the toy body 110 may be implemented in various shapes.

In addition, the toy body 110 is configured to be separable from a lower body, so that the toy body 110 can be replaced with another toy body 110'.

That is, the upper part of the toy body 110 is configured to be separable from the lower part provided with the wheels 120 and the auxiliary wheels 130, the upper part of the separably configured toy body 110 is provided with upper fixing portions 1101, and the lower part of the separably configured toy body 110 may be provided with lower fixing portions 1102, so that the upper and lower parts can be fixed through the coupling of the upper fixing portions 1101 and the lower fixing portions 1102.

The upper fixing portions 1101 and the lower fixing portions 1102 may be formed by hooks and engagement grooves to be coupled through press-fitting or may be configured to be engaged with each other by attraction force using magnets.

Therefore, the user may replace the installed toy body 110 with another toy body 110' having a different shape as needed.

Reference numeral 1101' denotes upper fixing portions 1101' provided on the toy body 110' of another shape, and the upper fixing portions are engaged with lower fixing portions 1102 in the lower body.

The auxiliary wheels 130 are installed at predetermined intervals on the bottom surface of the toy body 110 so as to freely rotate and mate with the rail units 220 provided on the tracks 200, so that the traveling toy 100 can be guided according to a route provided by the track 200.

That is, the auxiliary wheels 130 are in contact with the side surfaces of the rail unit 200 of the track 200 while the traveling toy 100 is traveling on the track 200, thereby supporting the traveling body 100, so that the traveling toy 100 can travel along the track 200 without deviating from the route.

The track 200 is configured to form a predetermined route along which the traveling toy 100 can travel, and includes a plate-shaped base portion 210, rail units 220 protruding from the base portion 210 at a predetermined height, and side wall portions 230 protruding from both side ends of the base portion 210 at a predetermined height.

Second Embodiment

Figure 7:
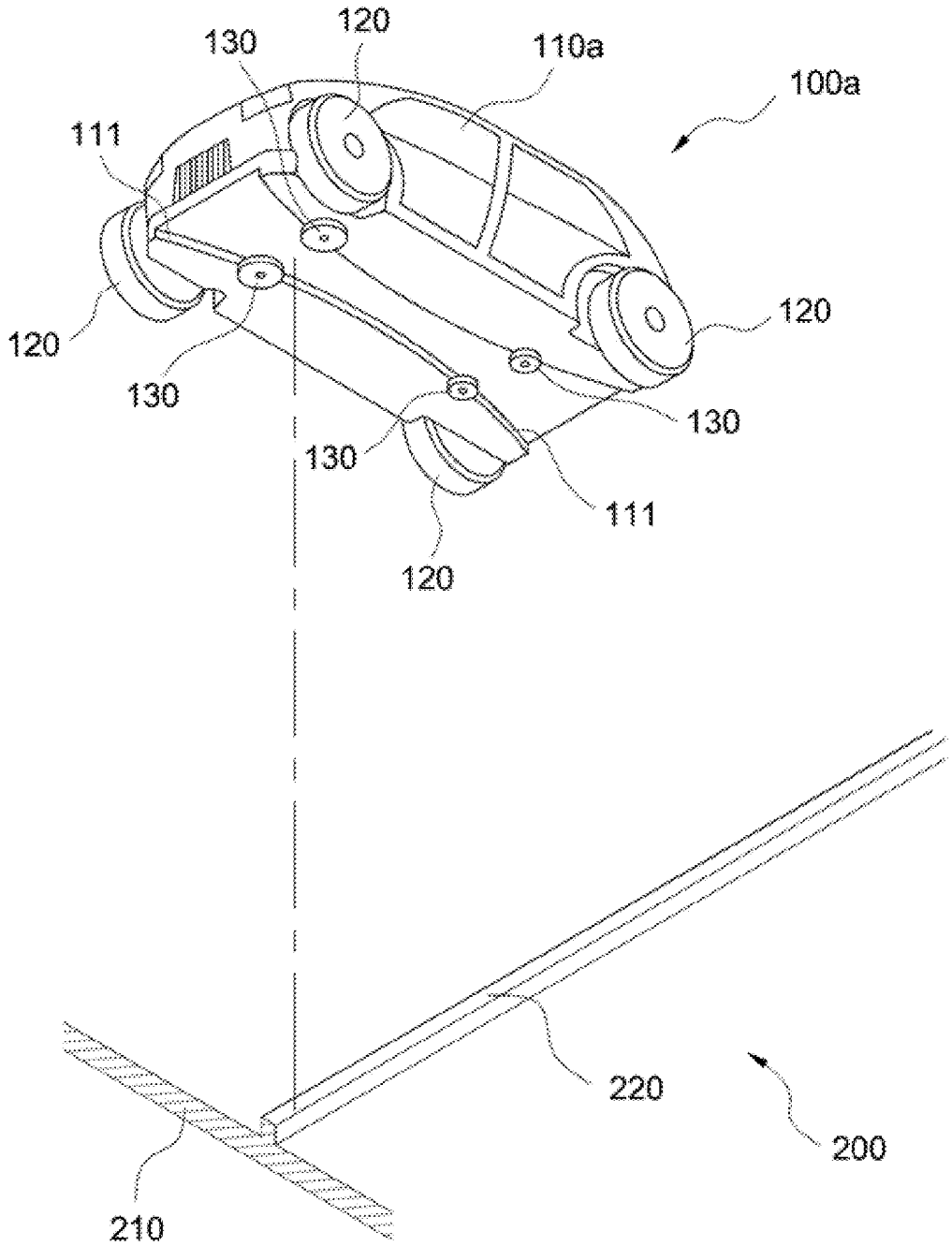
FIG. 7 is a perspective view showing a second embodiment of the traveling toy according to the present disclosure.
Figure 8:
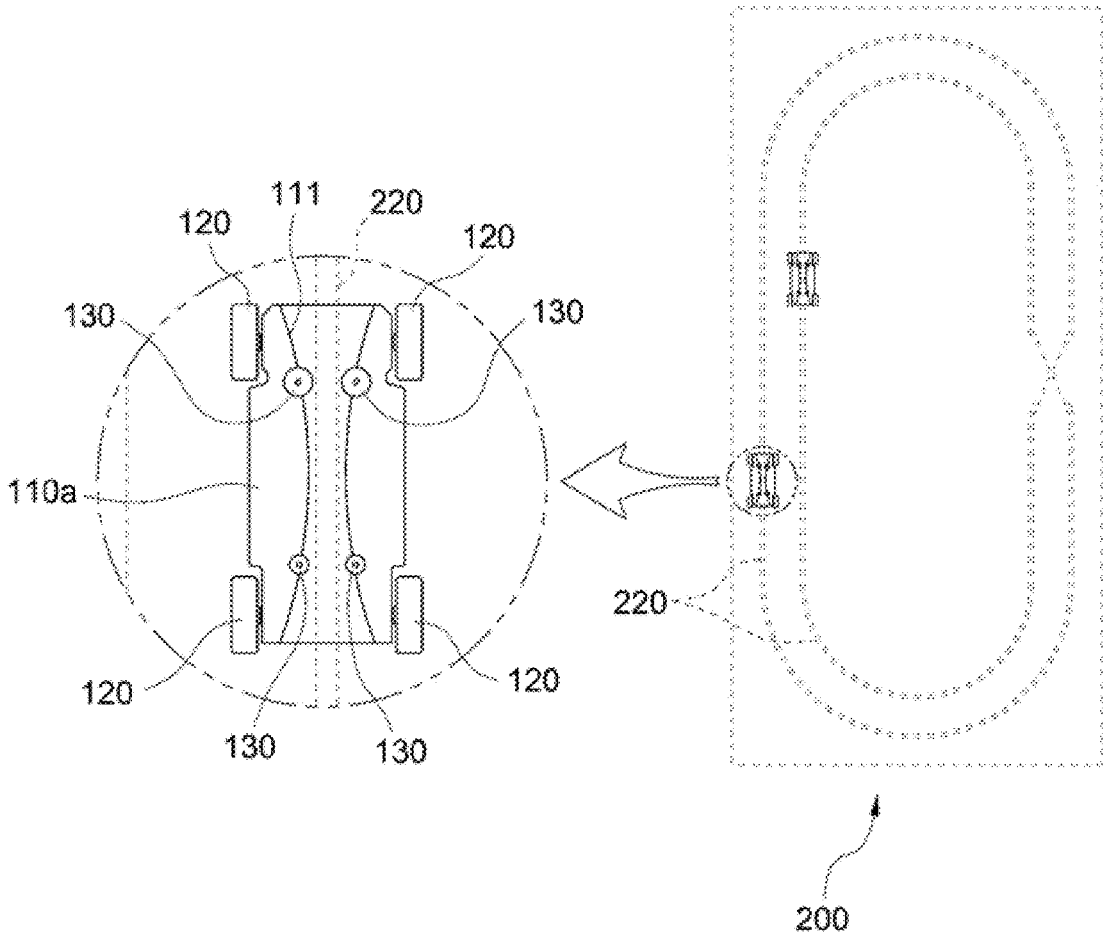
FIG. 8 is an exemplary view showing the state in which the traveling toy according to FIG. 7 changes the position of auxiliary wheels along the track.
Figure 9:
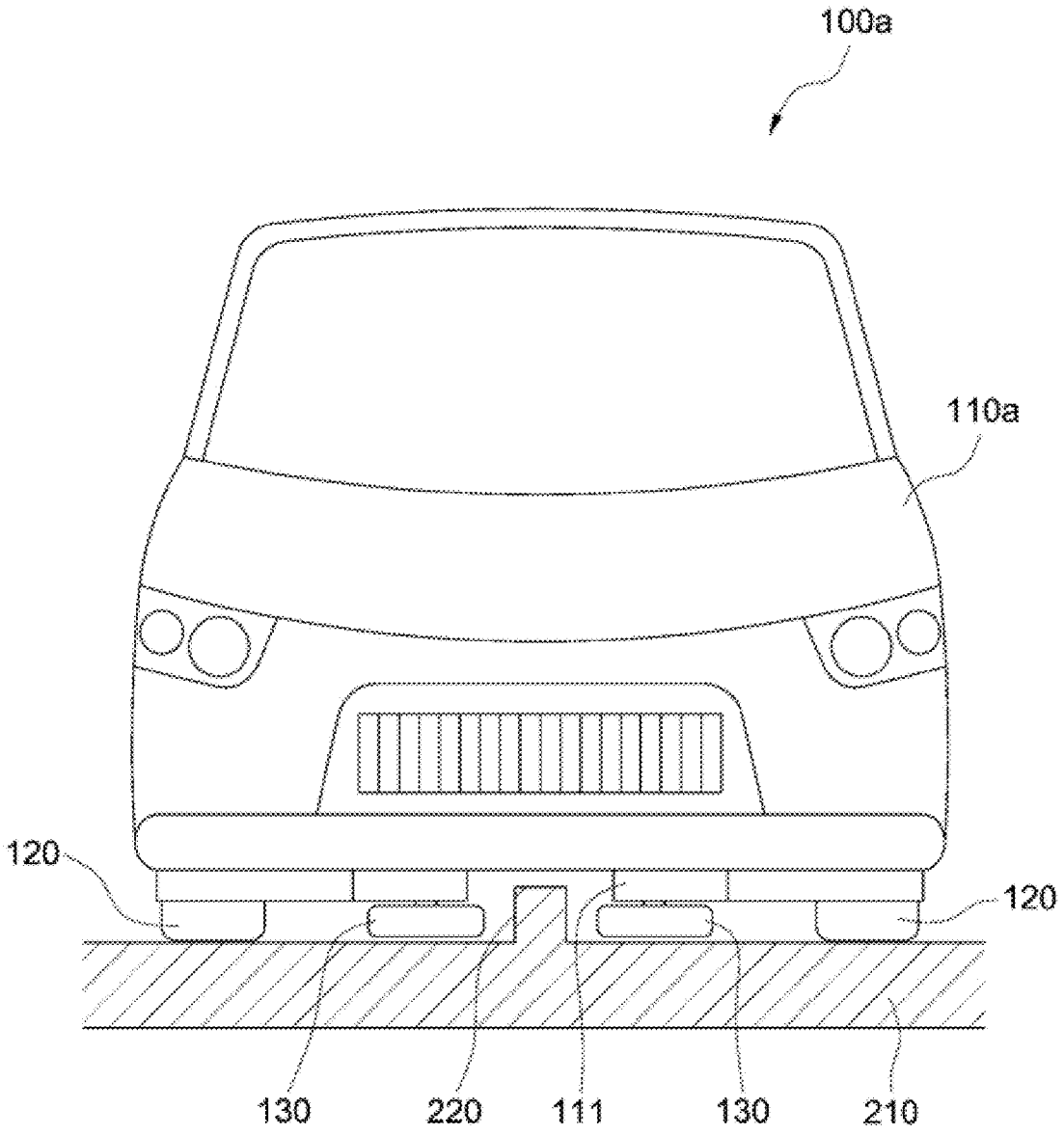
FIG. 9 is a front view showing the state in which the traveling toy according to FIG. 7 is mounted on a track.

FIG. 7 is a perspective view showing a second embodiment of a traveling toy according to the present disclosure, FIG. 8 is an exemplary view showing the state in which the traveling toy according to FIG. 7 changes the position of auxiliary wheels along the track, and FIG. 9 is a front view showing the state in which the traveling toy according to FIG. 7 is mounted on a track.

As shown in FIGS. 7 to 9, a traveling toy **100*a* according to the second embodiment includes multiple wheels 120 mounted on a toy body 110*a* having a predetermined shape, and multiple auxiliary wheels 130 mounted on the bottom surface of the toy body 110*a* at predetermined intervals and configured to mate with a rail unit 220 installed in the track 200 and to guide the traveling toy 100 along a route provided by the track 200. A guide portion 111 is formed on the bottom surface of the toy body 110*a* to form a path through which the rail unit 220 of the track 200** passes.

In other words, the traveling toy **100*a* according to the second embodiment is different in configuration from the traveling toy according to the first embodiment in that the guide portion 111 is formed on the bottom surface of the toy body 110*a* as a groove portion through which the rail unit 220** passes.

The guide portion 111 allows the rail unit 220 of the track 200 to be easily introduced into the lower part of the toy body **110*a* while the traveling toy 100*a* travels, and guides the introduced rail unit 220 to more easily come into contact with the auxiliary wheels 130**.

It will be apparent to a person ordinarily skilled in the art that the toy body **110*a* may be configured to be separable from the lower body so that the toy body 110*a* can be replaced with a toy body 110'** having a different shape as that in the first embodiment.

Third Embodiment

Figure 10:
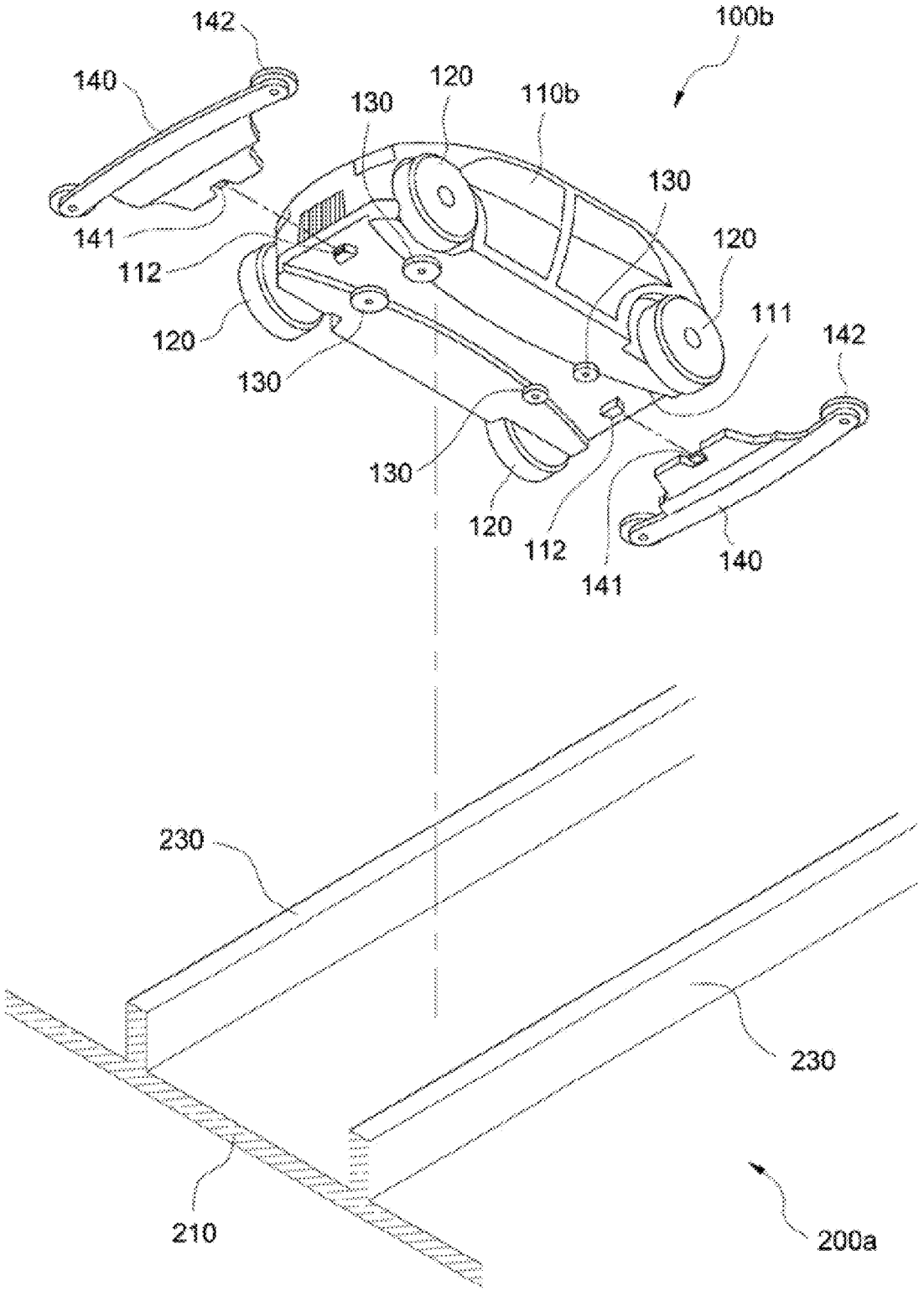
FIG. 10 is a perspective view showing a third embodiment of the traveling toy according to the present disclosure.

FIG. 10 is a perspective view showing a third embodiment of a traveling toy according to the present disclosure, FIG.

Figure 12:
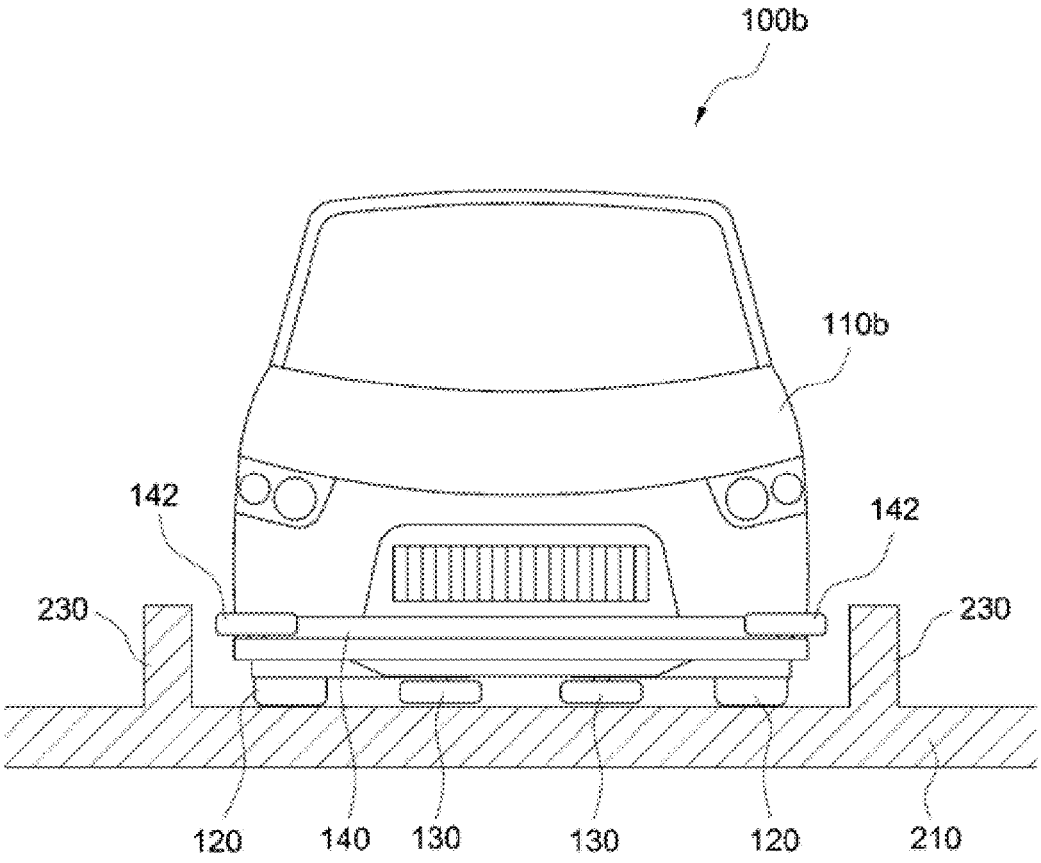
FIG. 12 is a front view showing the state in which the traveling toy according to FIG. 10 is mounted on a track.

11 is an exemplary view showing the state in which the traveling toy according to FIG. 10 changes the positions of auxiliary wheels along the track, and FIG. 12 is a front view showing the state in which the traveling toy according to FIG. 10 is mounted on a track.

Figure 11:
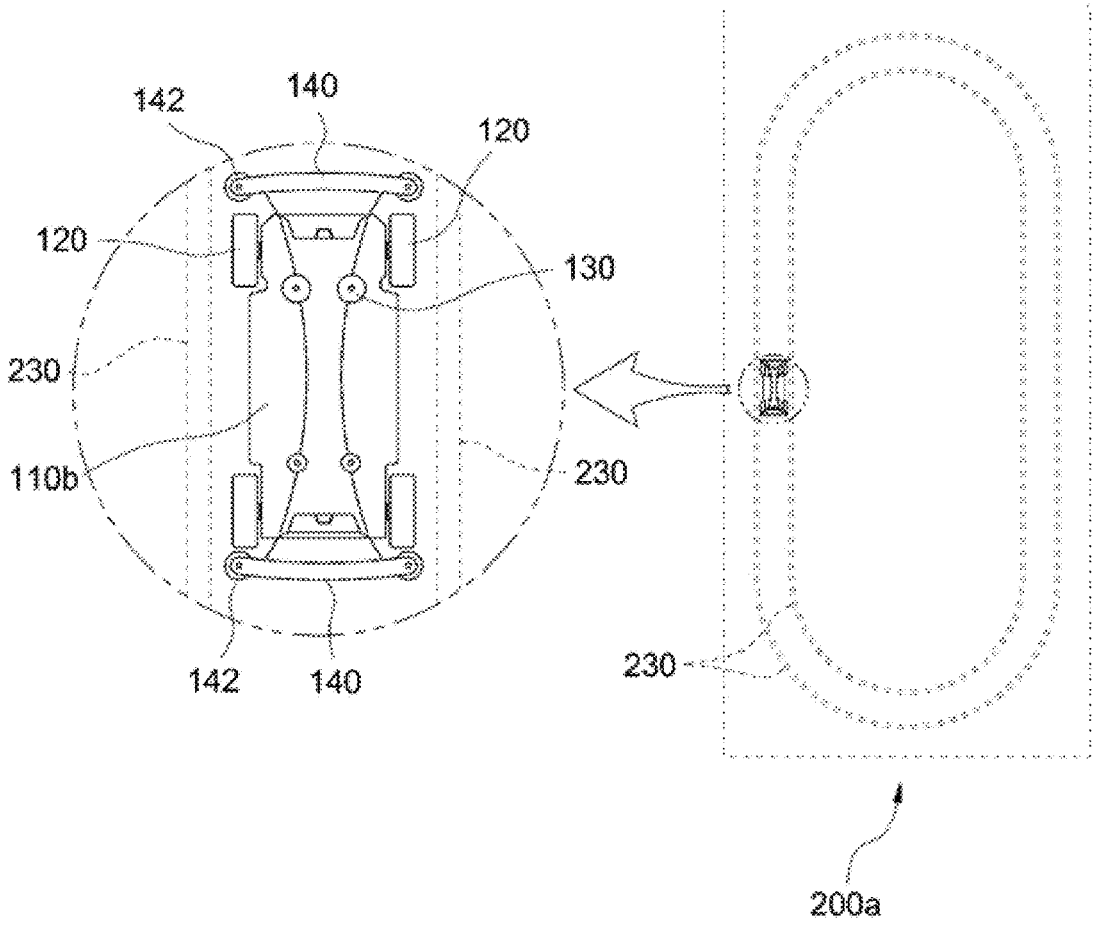
FIG. 11 is an exemplary view showing the state in which the traveling toy according to FIG. 10 changes the position of auxiliary wheels along the track.

As shown in FIGS. 10 to 12, a traveling toy 100*b* according to the third embodiment includes multiple wheels 120 mounted on a toy body 110*b* having a predetermined shape, multiple auxiliary wheels 130 mounted on the bottom surface of the toy body 110*b* at predetermined intervals, and first auxiliary wheels 140 configured to mate with side wall portions 230 provided on the track 200*a* and to guide the traveling toy 100*b* along the route provided by the track 200.

The traveling toy 100*b* according to the third embodiment is different from the traveling toy according to the second embodiment in that engagement grooves 112 are formed at the front and rear sides of the bottom surface of the toy body 110*b* and the first auxiliary wheels 140 are provided at the front and rear sides of the traveling toy 100*b* via the engagement grooves 112.

In other words, the traveling toy 100*b* according to the third embodiment is configured such that, when the track 200*a* includes only side wall portions 230 protruding at opposite side ends of the base portion 210 at a predetermined height, the traveling toy 100*b* can be guided to travel on the track 200*a*.

Each of the first auxiliary wheels 140 includes an engagement portion 141 provided at one side thereof to fix the first auxiliary wheel 140 by interference-fitting the engagement portion 141 into the coupling groove, and wheels 142 provided at the opposite ends thereof to be freely rotatable.

Accordingly, the first auxiliary wheels 140 guide the traveling toy 100*b* to move along the track 200*a* by being in contact with the side wall portions 230 while the traveling toy 100*b* travels on the track 200*a*.

It will be apparent to a person ordinarily skilled in the art that the toy body 110*b* may be configured to be separable from the lower body so that the toy body 110*b* can be replaced with a toy body 110' having a different shape as that in the first embodiment.

Fourth Embodiment

Figure 13:
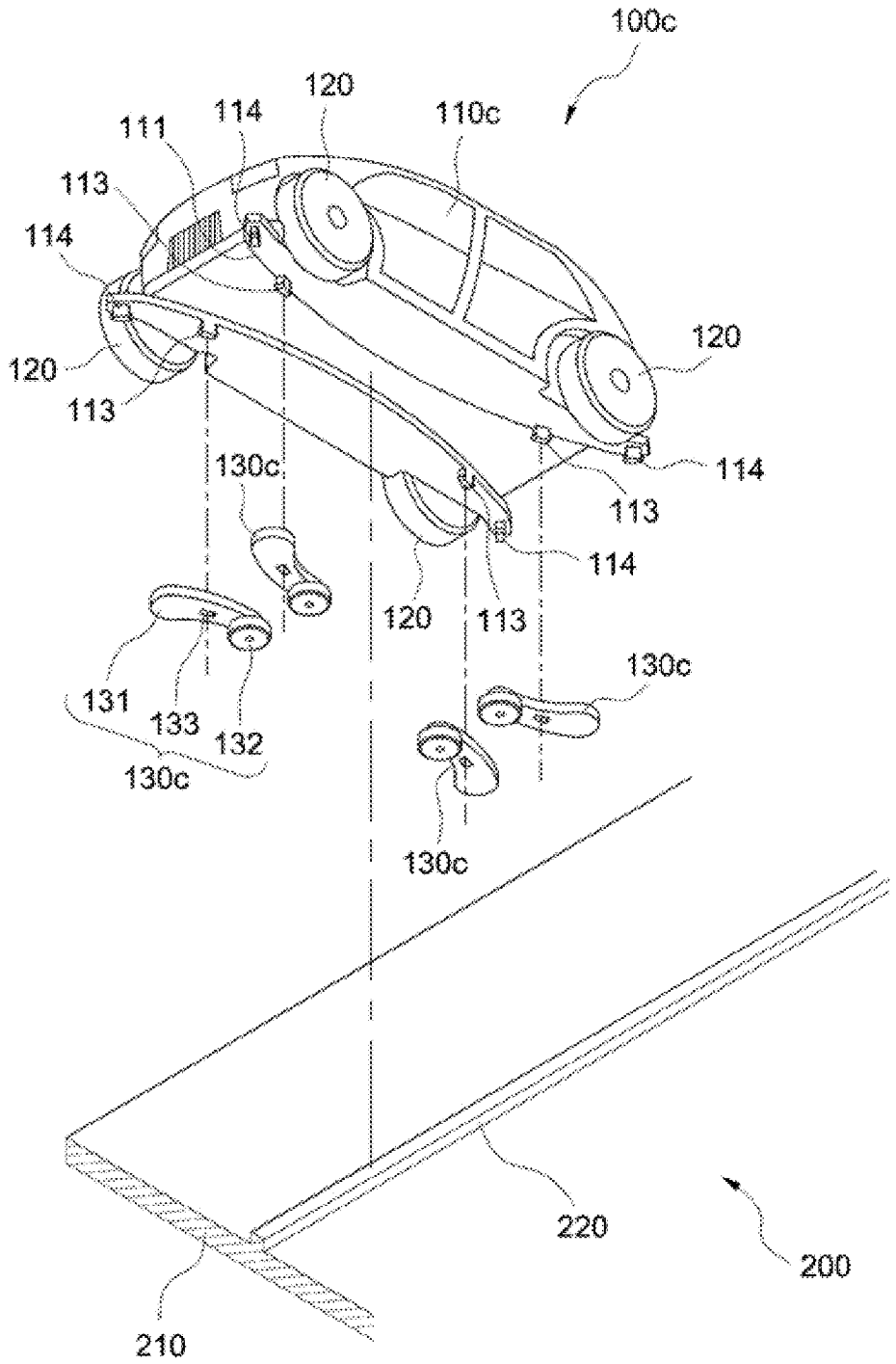
FIG. 13 is a perspective view showing a fourth embodiment of the traveling toy according to the present disclosure.
Figure 14:
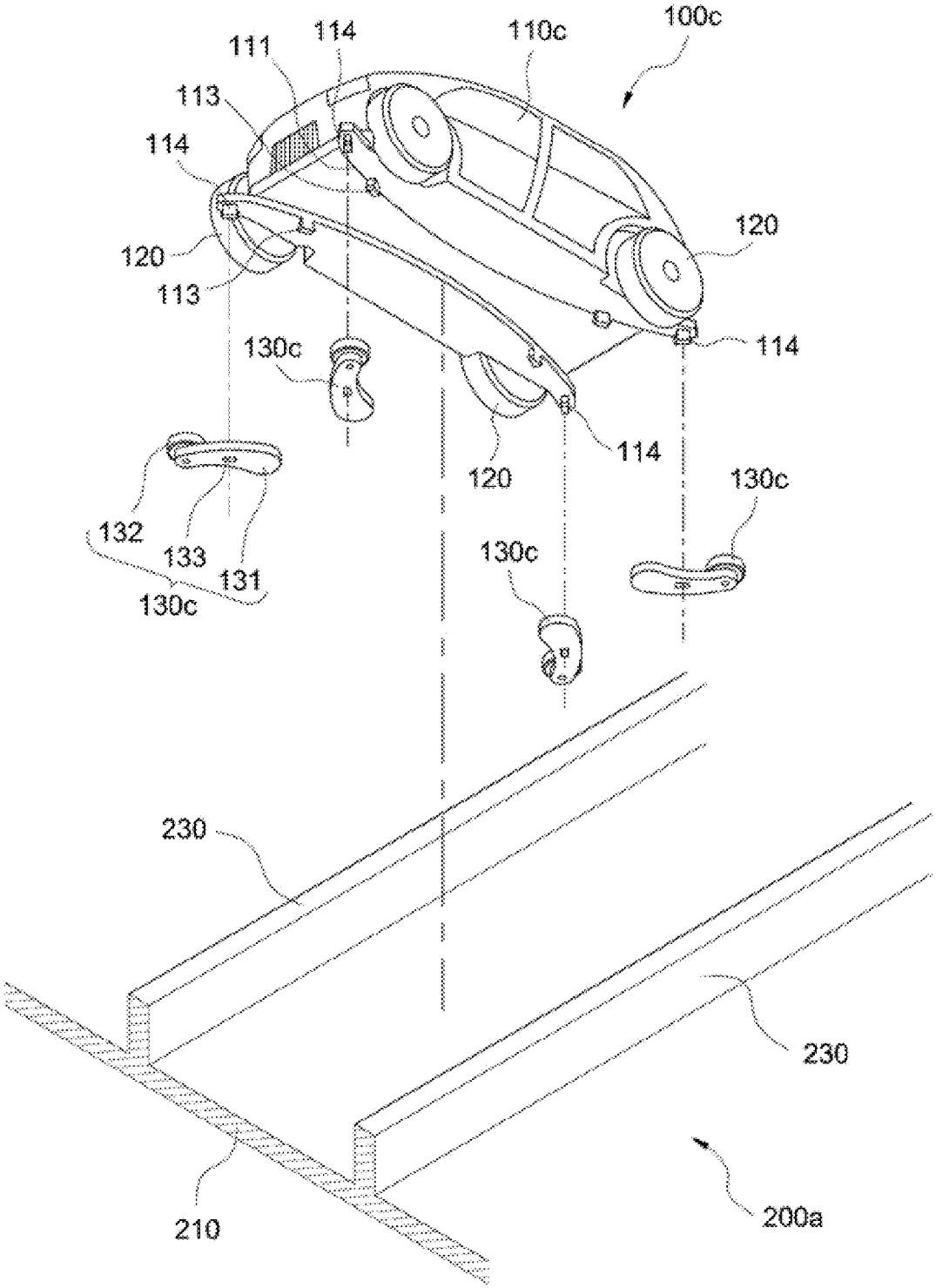
FIG. 14 is a perspective view showing a process of changing the positions of auxiliary wheels of the traveling toy according to FIG. 13.
Figure 15:
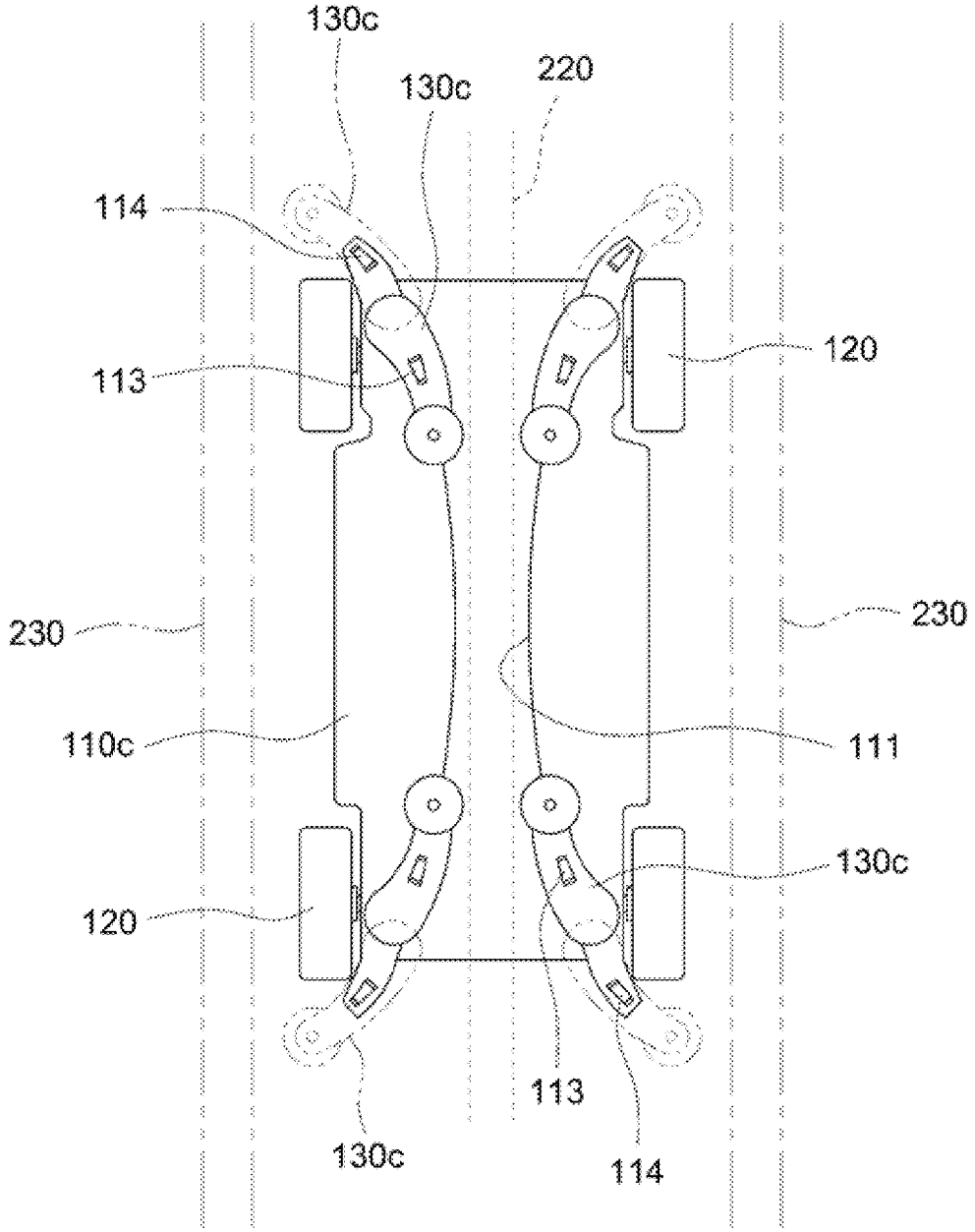
FIG. 15 is an exemplary view showing the state in which the traveling toy according to FIG. 13 changes the position of auxiliary wheels along the track.

FIG. 13 is a perspective view showing a fourth embodiment of a traveling toy according to the present disclosure, FIG. 14 is a perspective view showing a process of changing the positions of auxiliary wheels of the traveling toy according to FIG. 13, and FIG. 15 is an exemplary view showing the state in which the traveling toy according to FIG. 13 changes the positions of auxiliary wheels along the track.

As shown in FIGS. 13 to 15, a traveling toy 100*c* according to the fourth embodiment includes a toy body 110*c* having a predetermined shape and provided with a guide portion 111 on the bottom surface thereof, multiple wheels 120 mounted on the toy body 110*c* to provide driving force, and multiple auxiliary wheels 130*c* detachably mounted on the bottom surface of the toy body 110*c* at predetermined intervals and configured to mate with a rail unit 220 provided on the track 200 and to guide the traveling toy 100*c* along the route provided by the track 200.

The traveling toy 100*c* according to the fourth embodiment is different from the configuration of the second embodiment in that the auxiliary wheels 130*c* are variably set on the bottom surface of the toy body 110*c* such that, depending on whether the traveling toy 100*c* travels along the rail unit 220 of the track 200 or along the side wall portions 230, the auxiliary wheels 130*c* are separated from the toy body 110*c* to be set to a first position where the auxiliary wheels 130*c* come into contact with the rail unit 220 or to be set to a second position where the auxiliary wheels 130*c* come into contact with the side wall portions 230.

That is, first hooks 113 and second hooks 114 are provided on each of the front and rear sides of the toy body 110*c* such that each of the auxiliary wheels 130*c* can be fixed at the first position or the second position.

In addition, each of the auxiliary wheels 130*c* includes a wheel 132 provided to be freely rotatable at one side of an auxiliary wheel body 131, and the auxiliary wheel body 131 is provided with fastening grooves 133, which can be fixedly engaged with each of the first and second hooks 113 and 114.

That is, in the case in which the traveling toy moves along the rail unit 220 of the track 200, when the auxiliary wheels 130*c* are installed to be engaged with the first hooks 113, respectively, as shown in FIG. 13, the auxiliary wheels 130*c* are located at the first position at which the auxiliary wheels 130*c* face each other toward the inside of the lower part of the toy body 110*c*, so that the traveling toy 100*c* can travel along the rail unit 220, and when the auxiliary wheels 130*c* are installed to be engaged with the second hooks 114, respectively, as shown in FIG. 14, the auxiliary wheels 130*c* are located at the second position at which the wheels 132 protrude in the forward and rearward directions of the toy body 110*c*, so that the traveling toy 100*c* can travel along the side wall portions 230.

In addition, the auxiliary wheels 130*c* at the second position are installed such that the wheels 132 protrude toward the side wall portions 230 more than the size in the width direction of the toy body 110*c*, whereby the auxiliary wheels 130*c* are capable of coming into contact with the side surfaces 230 of the track 200.

Therefore, after confirming whether the traveling toy 100*c* travels along the rail 220 or along the side walls 230, the auxiliary wheels 130*c* are attached to a changed position, whereby the traveling toy 100*c* is capable of traveling regardless of the track 200.

It will be apparent to a person ordinarily skilled in the art that the toy body 110*c* may be configured to be separable from the lower body so that the toy body 110*c* can be replaced with a toy body 110' having a different shape as that in the first embodiment.

Fifth Embodiment

Figure 16:
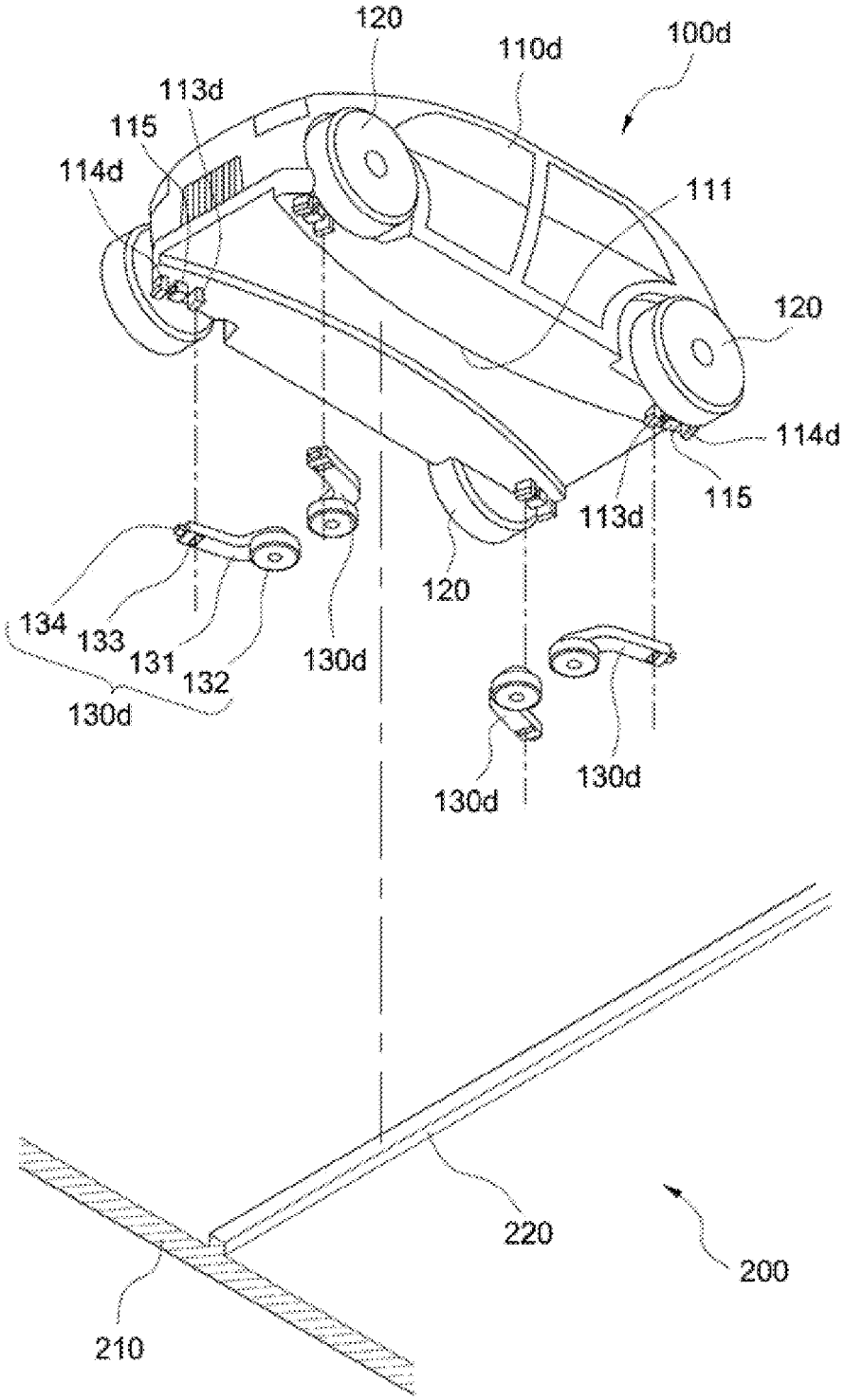
FIG. 16 is a perspective view showing a fifth embodiment of the traveling toy according to the present disclosure.
Figure 17:
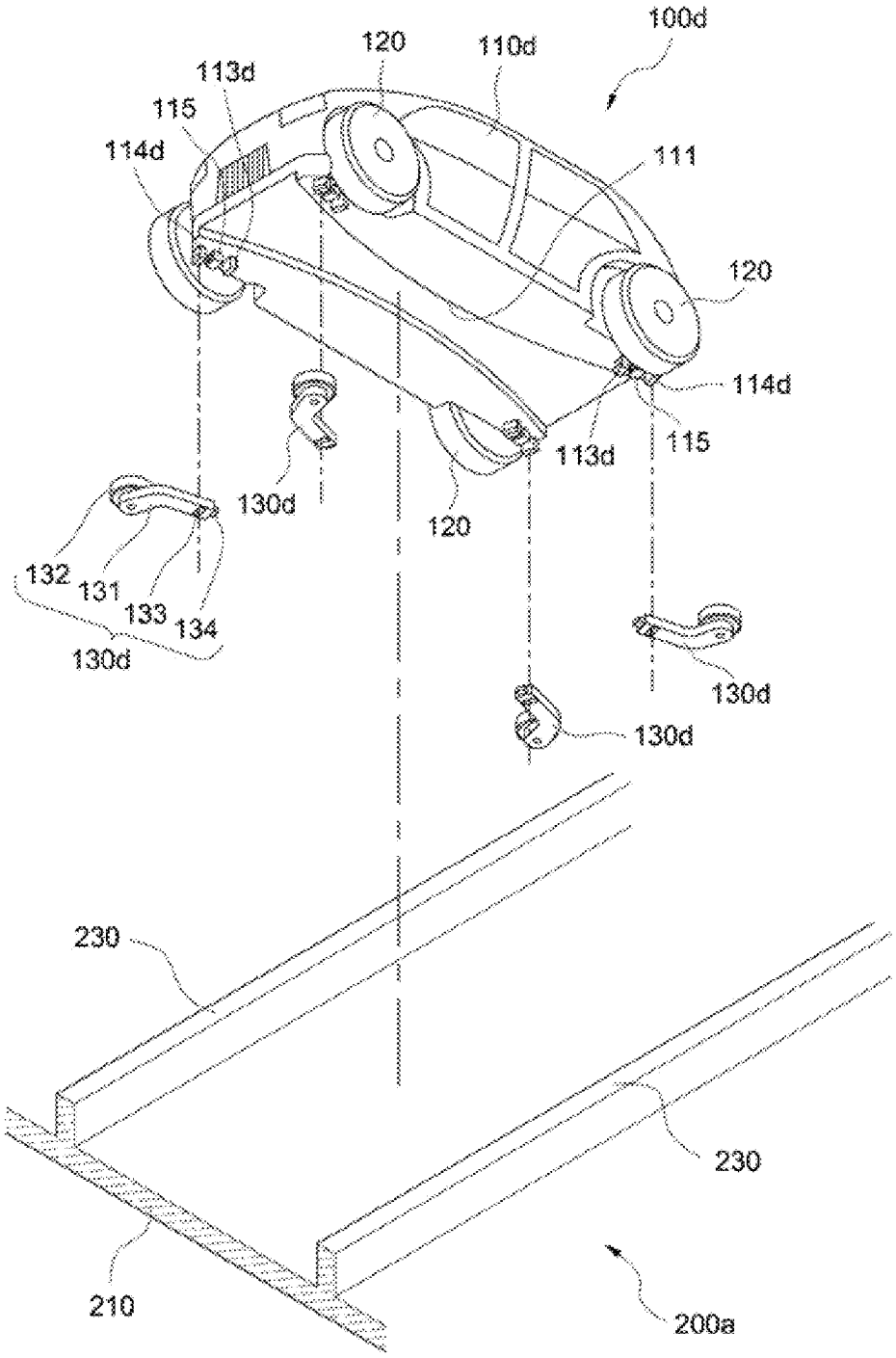
FIG. 17 is a perspective view showing a process of changing the positions of auxiliary wheels of the traveling toy according to FIG. 16.
Figure 18:
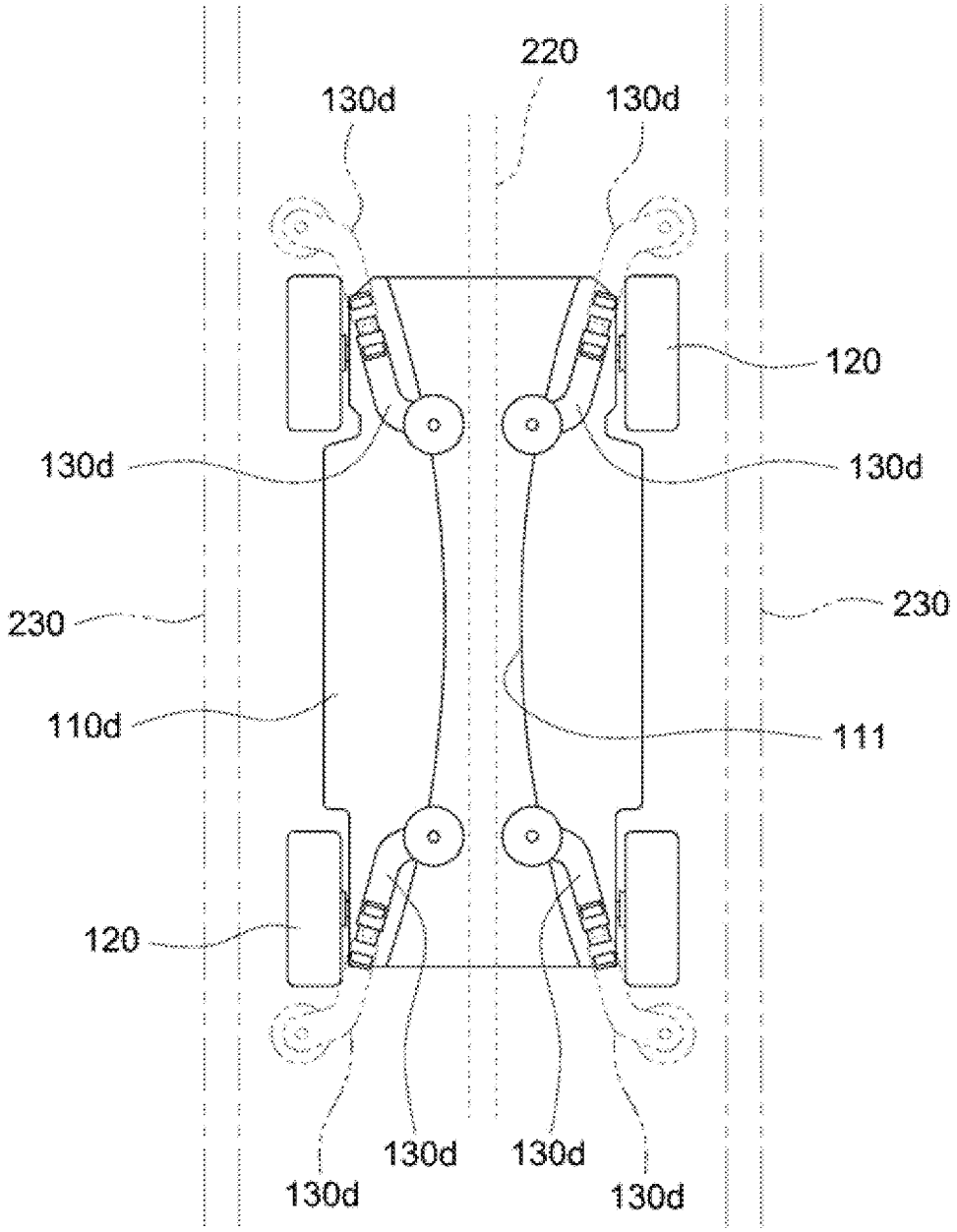
FIG. 18 is an exemplary view showing the state in which the traveling toy according to FIG. 16 changes the position of auxiliary wheels along the track.

FIG. 16 is a perspective view showing a fifth embodiment of a traveling toy according to the present disclosure, FIG. 17 is a perspective view showing a process of changing the positions of auxiliary wheels of the traveling toy according to FIG. 16, and FIG. 18 is an exemplary view showing the state in which the traveling toy according to FIG. 16 changes the position of auxiliary wheels along the track.

As shown in FIGS. 16 to 18, a traveling toy 100*d* according to the fifth embodiment includes a toy body 110*d* having a predetermined shape and provided with a guide portion 111 on the bottom surface thereof, multiple wheels 120 mounted on the toy body 110*d* to provide driving force, and multiple auxiliary wheels 130*d* detachably mounted on the bottom surface of the toy body 110*d* and configured to mate with a rail unit 220 provided on the track 200 and to guide the traveling toy 100*d* along the route provided by the track 200.

The traveling toy 100*d* according to the fifth embodiment is different from the configuration of the traveling toy according to the fourth embodiment in terms of the configuration of first and second hooks 113*d* and 114*d* for fixing the auxiliary wheels 130*d* to the bottom surface of the toy body 110*c*, fastening portions 115, and the auxiliary wheels 130*d*.

That is, in order to ensure that each of the auxiliary wheels 130*d* can be more firmly attached and supported, the first hooks 113*d*, the second hooks 114*d*, and the fastening portions 115 are sequentially installed on the lower part of the toy body 110*d* and each of the auxiliary wheels 130*d* is configured to be capable of being fastened to the first hook 113*d*, the second hook 114*d*, and the fastening portion 115.

Each of the auxiliary wheels 130*d* includes an auxiliary wheel body 131, a wheel 132 installed on one side of the auxiliary wheel body 131 to be freely rotatable, a fastening groove provided on the other side of the auxiliary wheel body 130 to be engaged with the first hook 113*d* or the second hook 114*d*, and an insertion portion 134 formed at the distal end to be engaged with the fastening portion 115.

Thus, when the auxiliary wheels 130*d* are installed to be engaged with the first hooks 113*d*, respectively, as shown in FIG. 16, the auxiliary wheels 130*d* are located at the first position at which the auxiliary wheels 130*d* face each other toward the inside of the lower part of the toy body 110*d*, so that the traveling toy 100*d* can travel along the rail unit 220, and when the auxiliary wheels 130*d* are installed to be engaged with the second hooks 114*d*, respectively, as shown in FIG. 17, the auxiliary wheels 130*d* are located at the second position at which the wheels 132 protrude in the forward and rearward directions of the toy body 110*d*, so that the traveling toy 100*d* can travel along the side wall portions 230.

In addition, the auxiliary wheels 130*d* at the second position are installed such that the wheels 132 protrude toward the side wall portions 230 more than the size in the width direction of the toy body 110*d*, whereby the auxiliary wheels 130*d* are capable of coming into contact with the side surfaces 230 of the track 200.

It will be apparent to a person ordinarily skilled in the art that the toy body 110*d* may be configured to be separable from the lower body so that the toy body 110*d* can be replaced with a toy body 110' having a different shape as that in the first embodiment.

Sixth Embodiment

Figure 19:
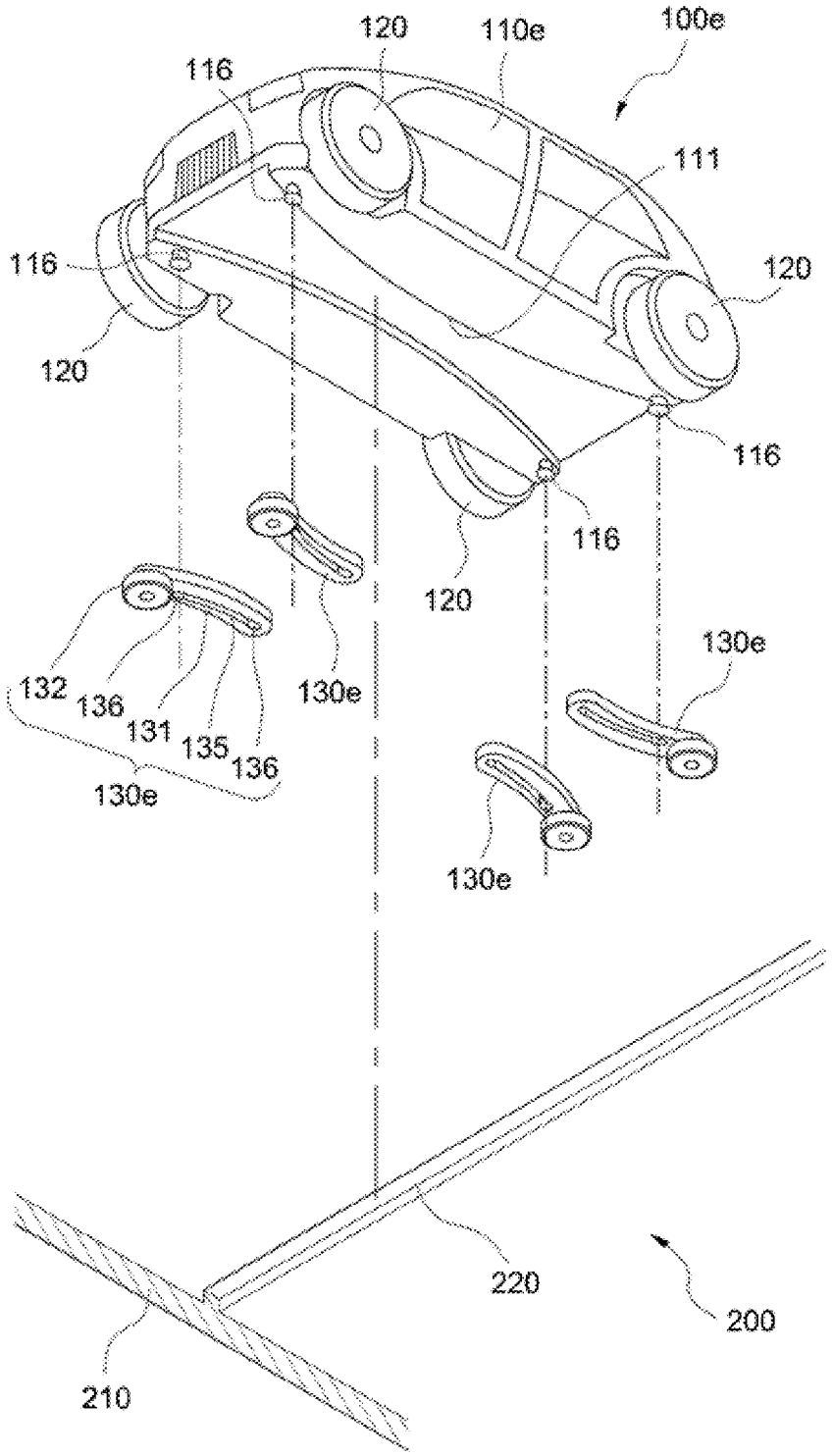
FIG. 19 is a perspective view showing a sixth embodiment of the traveling toy according to the present disclosure.
Figure 20:
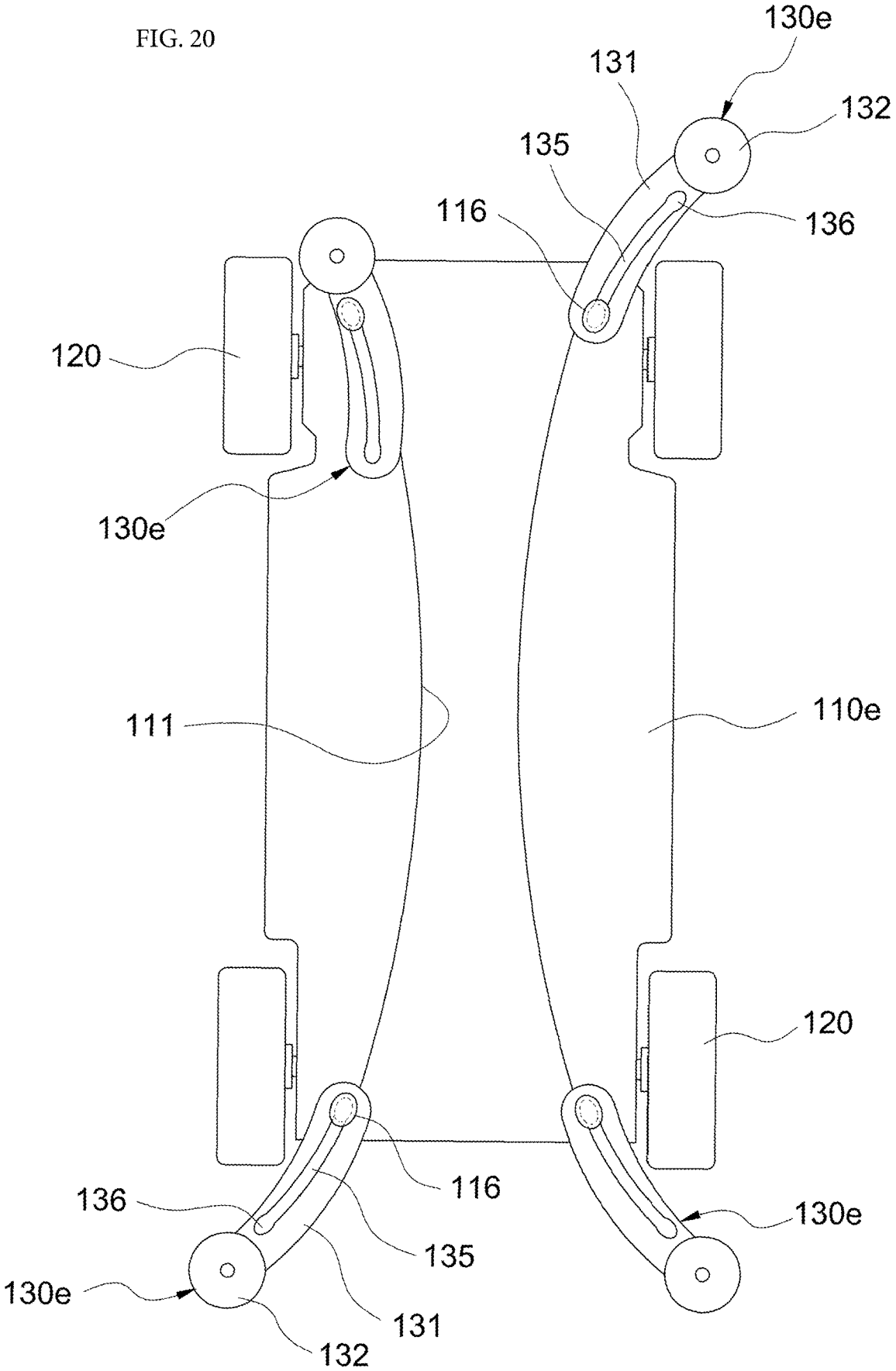
FIG. 20 is an exemplary view showing a process of changing the positions of auxiliary wheels of the traveling toy according to FIG. 19.
Figure 21:
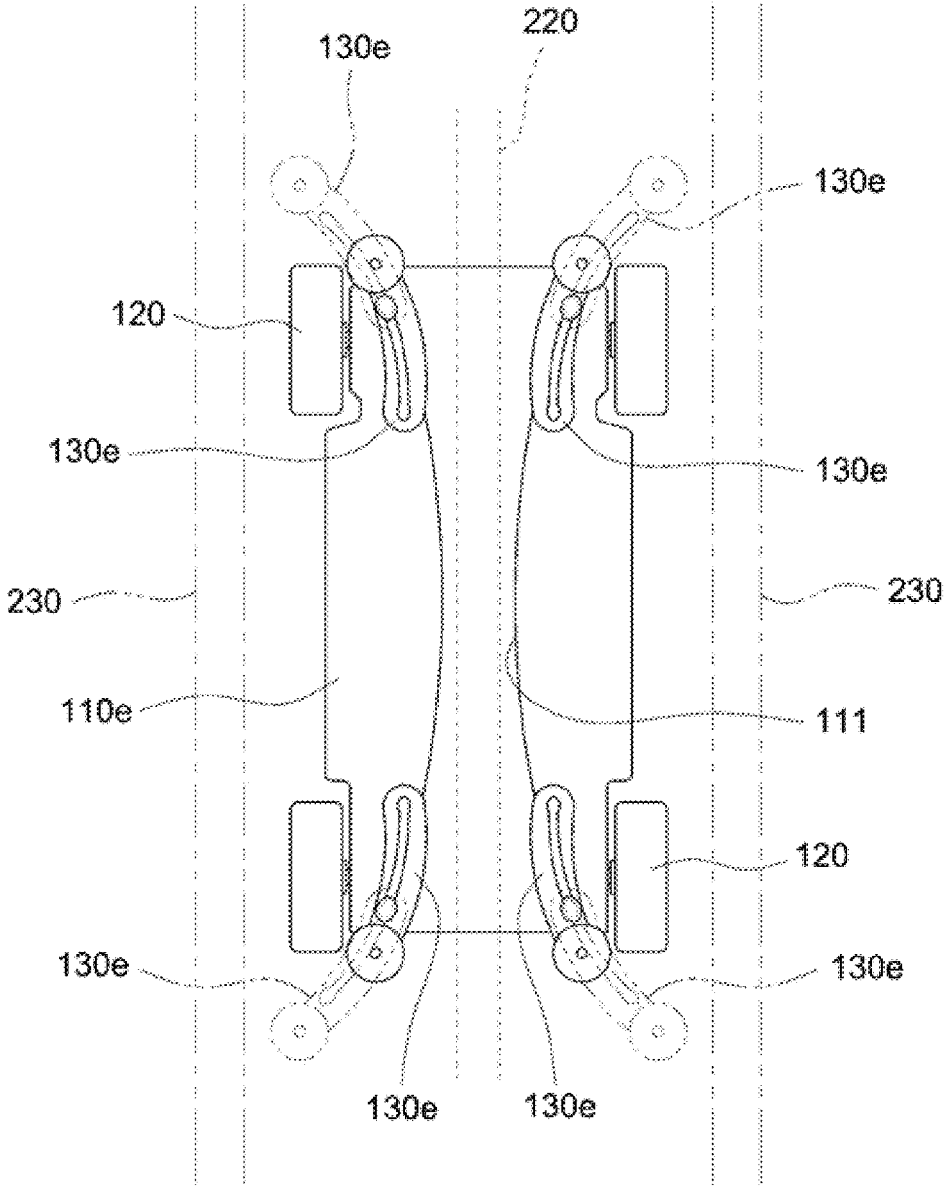
FIG. 21 is an exemplary view showing the state in which the traveling toy according to FIG. 19 changes the position of auxiliary wheels along the track.

FIG. 19 is a perspective view showing a sixth embodiment of a traveling toy according to the present disclosure, FIG. 20 is an exemplary view showing a process of changing the positions of auxiliary wheels of the traveling toy according to FIG. 19, and FIG. 21 is an exemplary view showing the state in which the traveling toy according to FIG. 19 changes the position of auxiliary wheels along the track.

As shown in FIGS. 19 to 21, a traveling toy 100*e* according to the sixth embodiment includes a toy body 110*e* having a predetermined shape and provided with a guide portion 111 on the bottom surface thereof, multiple wheels 120 mounted on the toy body 110*e* to provide driving force, and multiple auxiliary wheels 130*e* slidably mounted on the bottom surface of the toy body 110*e* at predetermined intervals and configured to mate with a rail unit 220 or side wall portions 230 provided on the track 200 and to guide the traveling toy 100*e* along the route provided by the track 200.

The traveling toy 100*e* according to the sixth embodiment is different from the configuration of the traveling toy according to the fifth embodiment in the configuration in which the auxiliary wheels 130*e* are slidably moved.

That is, protrusions 116 are formed on the bottom surface of the toy body 110*e* and the auxiliary wheels 130*e* are installed to be slidable along the protrusions 116, respectively.

Each of the auxiliary wheels 130*e* includes an auxiliary wheel body 131, a wheel 132 installed on one side of the auxiliary wheel body 131 to be freely rotatable, a movement groove 135 formed along the central portion of the auxiliary wheel body 131, and a fastening groove 136 fastened to a protrusion 116 through press-fitting.

Thus, as shown in FIG. 20, at a first position at which the auxiliary wheels 130*e* face each other toward the inside of the lower part of the toy body 110*e*, the traveling toy 100*e* can travel along the rail unit 220, and when the auxiliary wheels 130*e* are slid to a second position at which the wheels 130 protrude in the forward and rearward directions of the toy body 110*e*, the traveling toy 100*e* can travel along the side wall portions 230.

In addition, the auxiliary wheels 130*e* at the second position are installed such that the wheels 132 protrude toward the side wall portions 230 more than the size in the width direction of the toy body 110*e*, whereby the auxiliary wheels 130*e* are capable of coming into contact with the side surfaces 230 of the track 200.

It will be apparent to a person ordinarily skilled in the art that the toy body 110*e* may be configured to be separable from the lower body so that the toy body 110*e* can be replaced with a toy body 110' having a different shape as that in the first embodiment.

Seventh Embodiment

Figure 22:
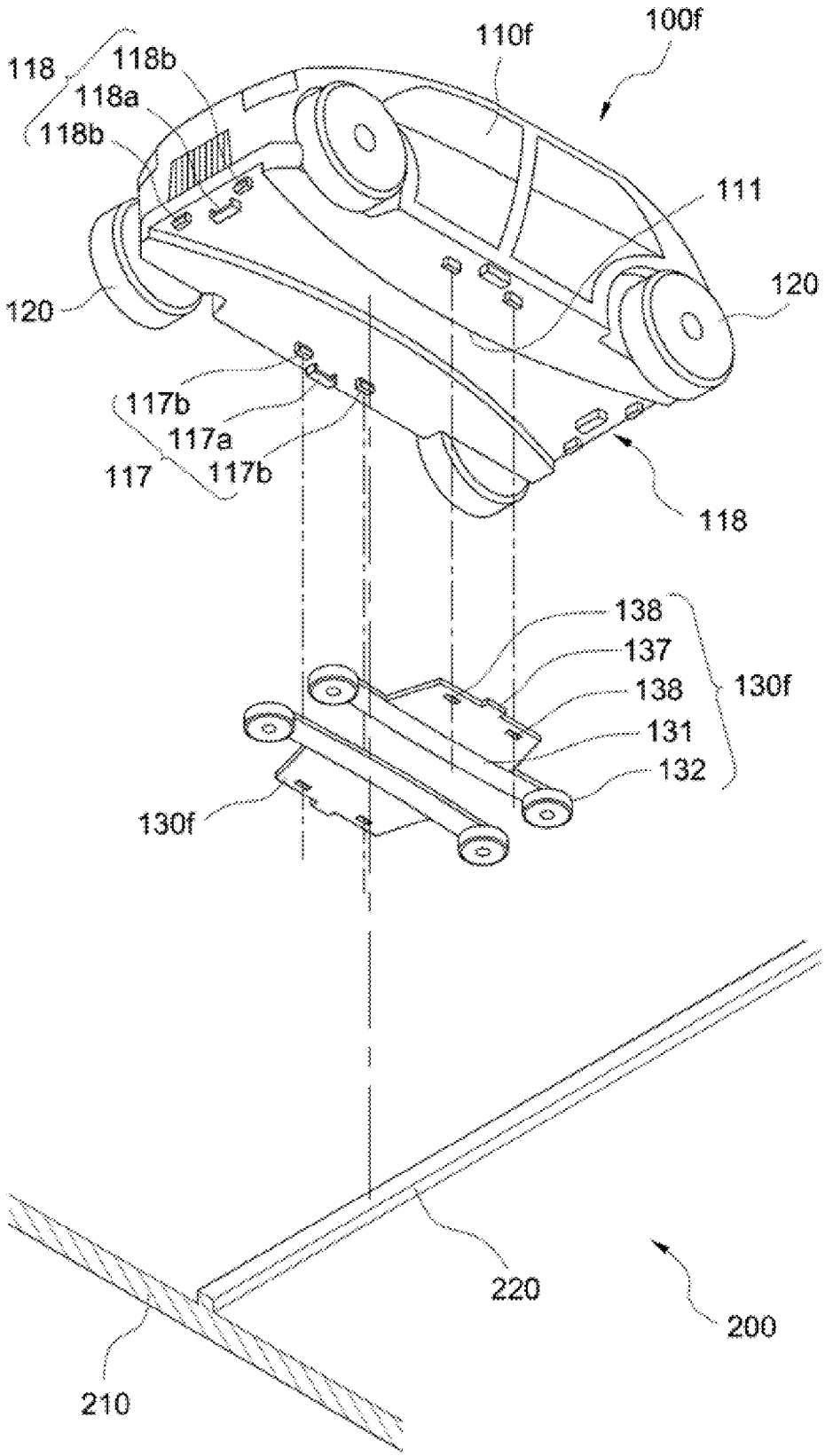
FIG. 22 is a perspective view showing a seventh embodiment of the traveling toy according to the present disclosure.
Figure 23:
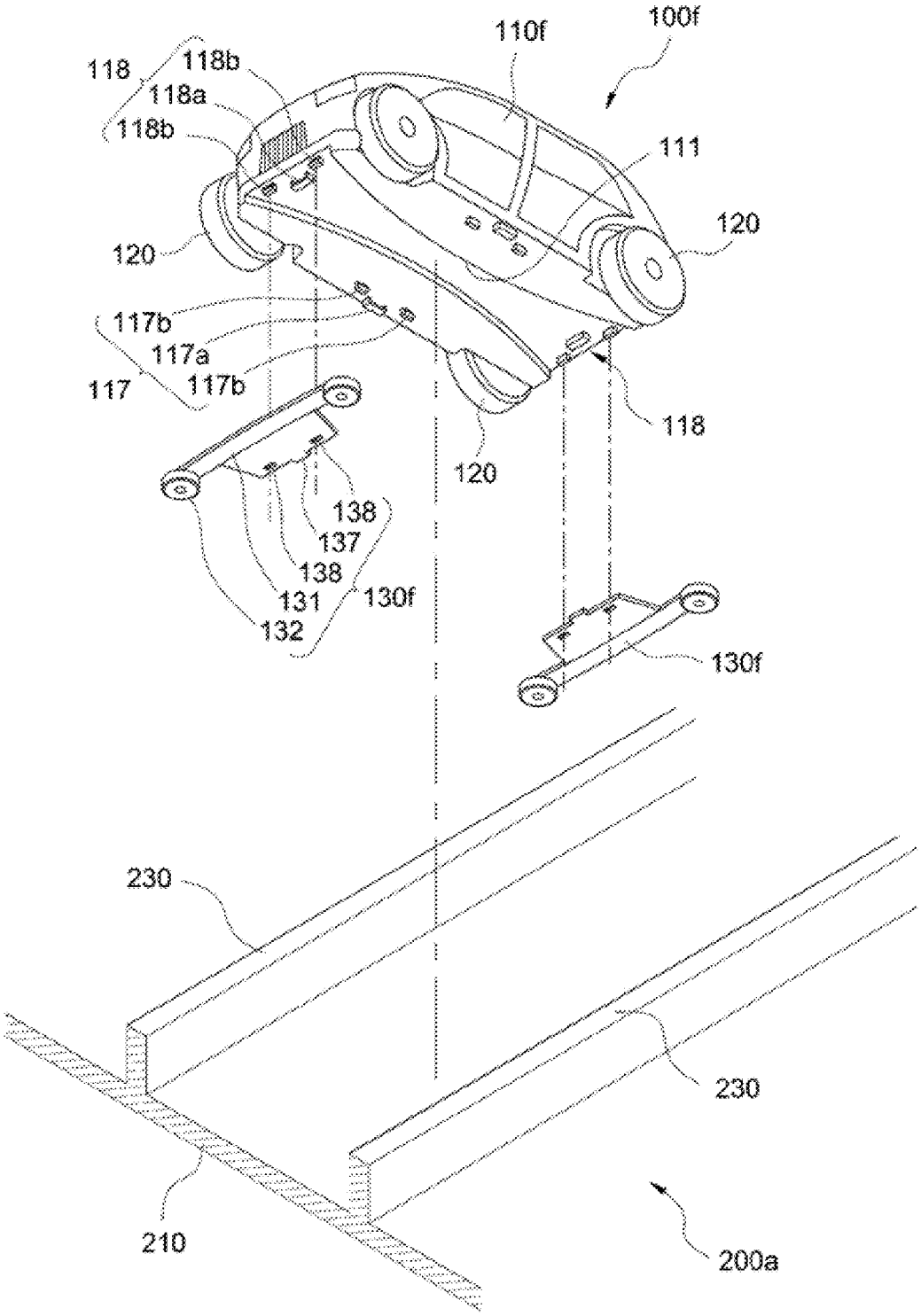
FIG. 23 is an exemplary view showing a process of changing the positions of auxiliary wheels of the traveling toy according to FIG. 22.
Figure 24:
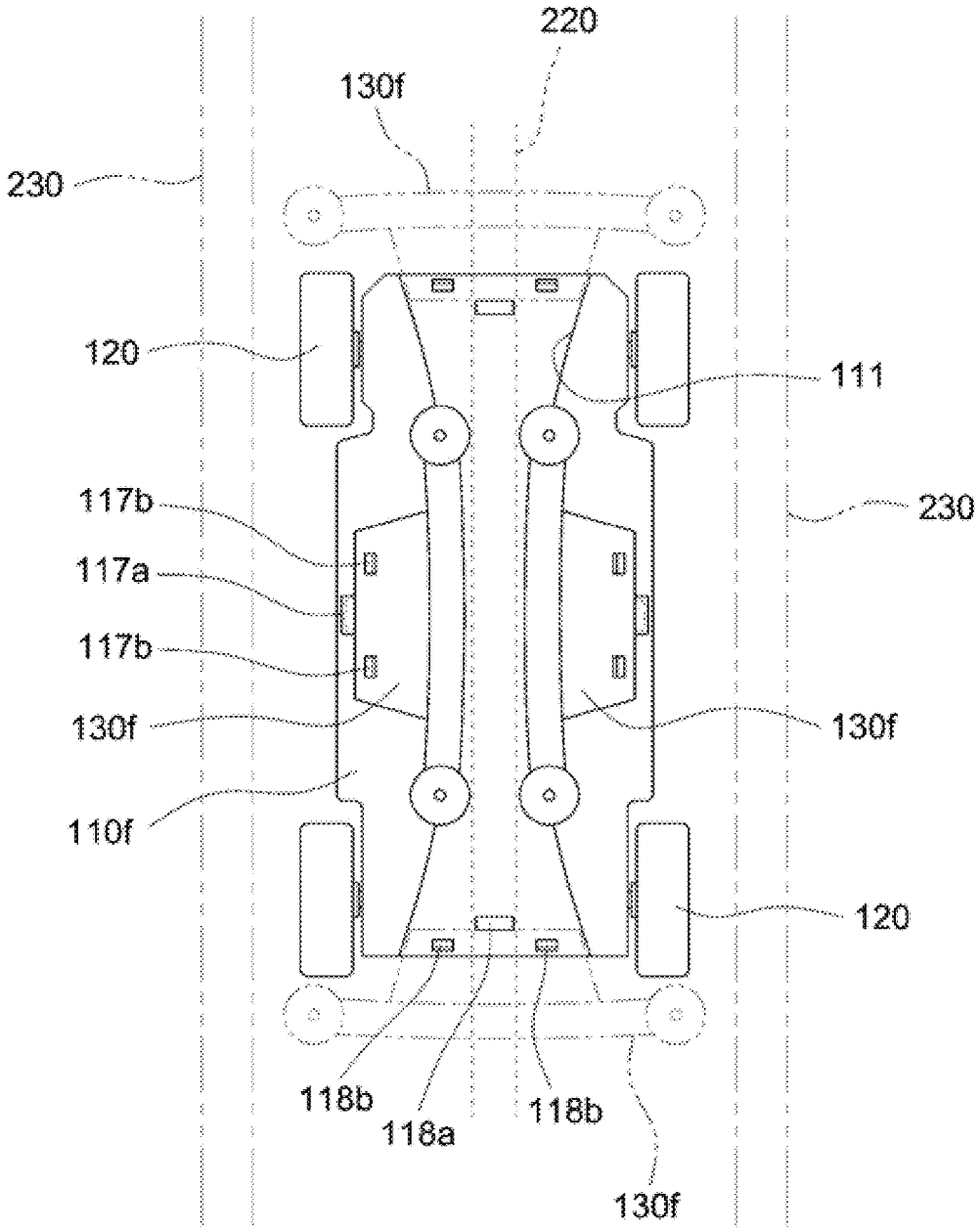
FIG. 24 is an exemplary view showing the state in which the traveling toy according to FIG. 22 changes the position of auxiliary wheels along the track.

FIG. 22 is a perspective view showing a seventh embodiment of a traveling toy according to the present disclosure, FIG. 23 is an exemplary view showing a process of changing the positions of auxiliary wheels of the traveling toy according to FIG. 22, and FIG. 24 is an exemplary view showing the state in which the traveling toy according to FIG. 22 changes the positions of auxiliary wheels along the track.

As shown in FIGS. 22 to 24, a traveling toy 100*f* according to the seventh embodiment includes a toy body 110*f* having a predetermined shape and provided with a guide portion 111 on the bottom surface thereof, multiple wheels 120 mounted on the toy body 110*f* to provide driving force, and multiple auxiliary wheels 130*f* detachably mounted on the bottom surface of the toy body 110*f* and configured to mate with a rail unit 220 provided on the track 200 and to guide the traveling toy 100*f* along the route provided by the track 200.

The traveling toy 100*f* according to the seventh embodiment is different from the configuration of the traveling toy according to the fifth embodiment in terms of the configuration of first and second fixing portions 117 and 118 for fixing the auxiliary wheels 130*f* to the bottom surface of the toy body 110*f*, and the auxiliary wheels 130*f*.

That is, each of the first fixing portions 117 includes a fastening groove 117*a* and protrusions 117*b* such that the auxiliary wheels 130*f* can be closely fixed to the bottom surface of the toy body 110*f* to face each other, and a pair of first fixing portions is provided on the bottom surface of the toy body 110*f* at the opposite sides in the width direction.

In addition, each of the second fixing portions 118 includes a fastening groove 118*a* and protrusions 118*b* such that the auxiliary wheels 130*f* can be fixed to protrude to the front and rear sides of the toy body 110*f* to face each other, and a pair of second fixing portions is provided on the front and rear portions of the toy body 110*f*.

Each of the auxiliary wheels 130*f* includes a wheel body 131, a wheel 132 installed on one side of the auxiliary wheel body 131 to be freely rotatable, an insertion portion 137 coupled to the fastening groove 117*a* or 118*a* of the first fixing portion 117 or the second fixing portion 118, and fastening grooves 138 fastened to the protrusions 117*b* or 118*b* of the first fixing portion 117 or the second fixing portion 118.

Thus, when the auxiliary wheels 130*f* are installed to be engaged with the first fixing portions 117, respectively, as shown in FIG. 23, the auxiliary wheels 130*f* are located at the first position at which the auxiliary wheels 130*f* face each other toward the inside of the lower part of the toy body 110*f*, so that the traveling toy 100*f* can travel along the rail unit 220, and when the auxiliary wheels 130*f* are installed to be engaged with the second fixing portions 118, respectively, as shown in FIG. 24, the auxiliary wheels 130*f* are located at the second position at which the wheels 132 protrude in the forward and rearward directions of the toy body 110*f*, so that the traveling toy 100*f* can travel along the side wall portions 230.

It will be apparent to a person ordinarily skilled in the art that the toy body 110*f* may be configured to be separable from the lower body so that the toy body 110*f* can be replaced with a toy body 110' having a different shape as that in the first embodiment.

Eighth Embodiment

Figure 25:
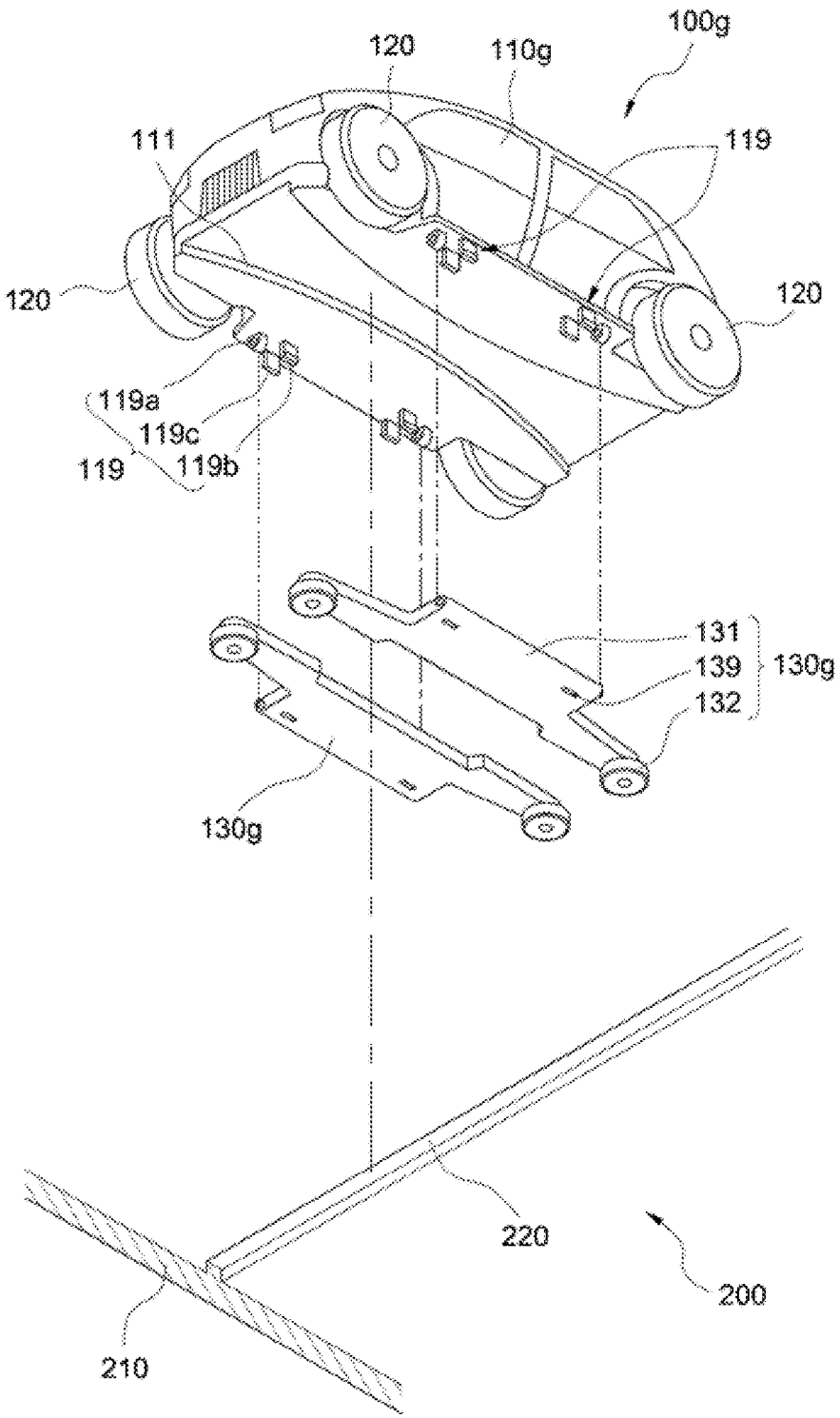
FIG. 25 is a perspective view showing an eighth embodiment of the traveling toy according to the present disclosure.
Figure 26:
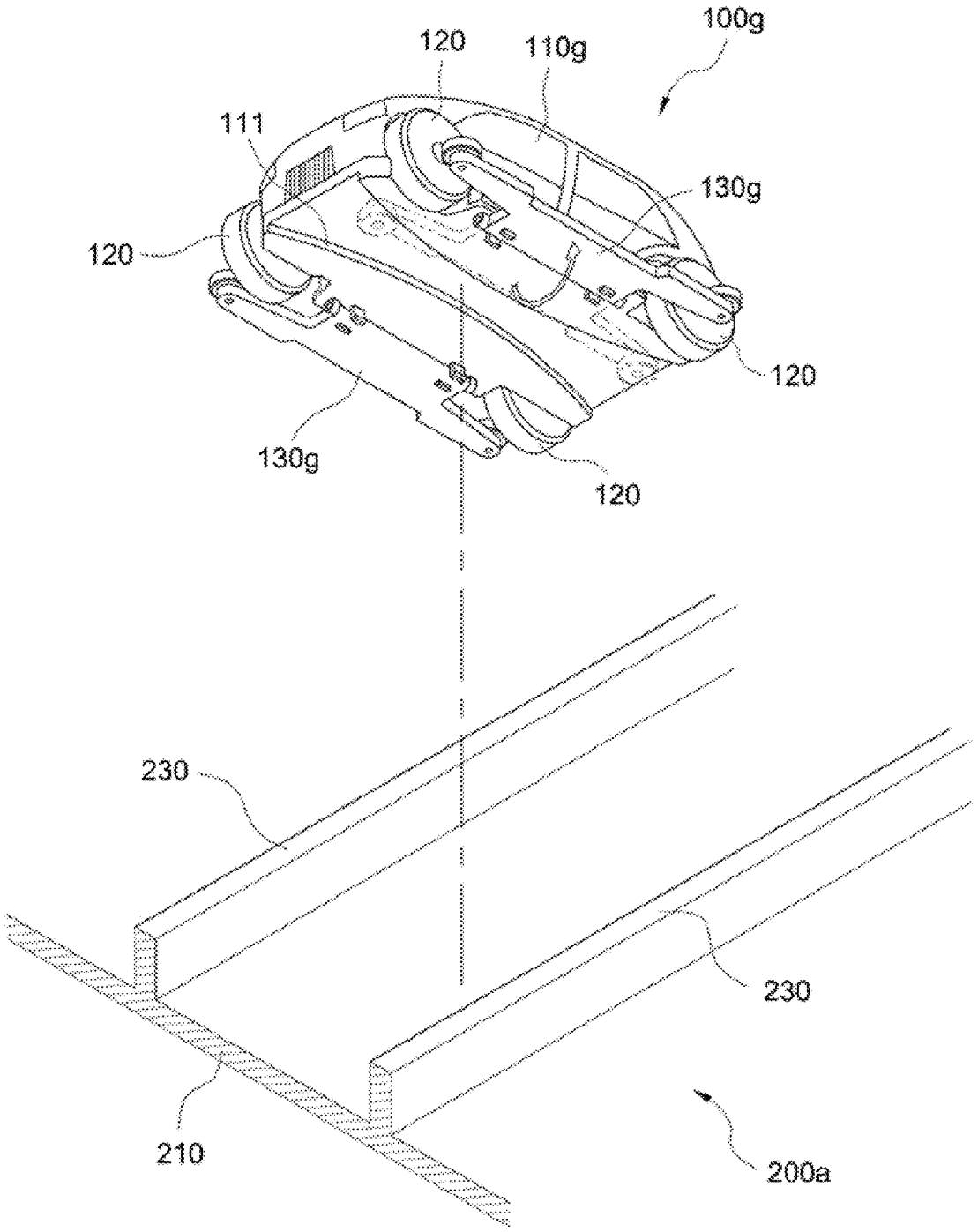
FIG. 26 is an exemplary view showing a process of changing the positions of auxiliary wheels of the traveling toy according to FIG. 25.
Figure 27:
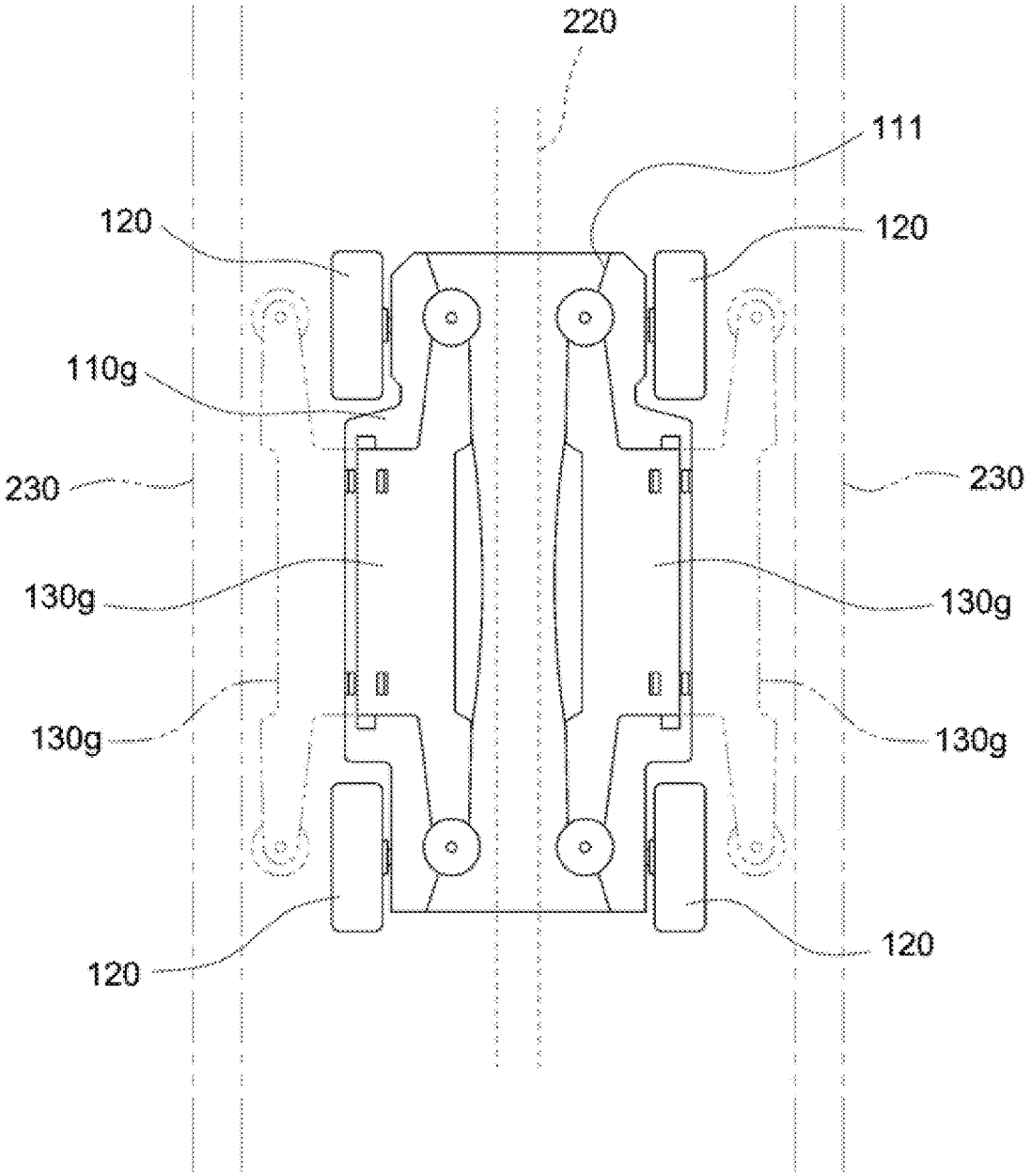
FIG. 27 is an exemplary view showing the state in which the traveling toy according to FIG. 25 changes the position of auxiliary wheels along the track.
Figure 28:
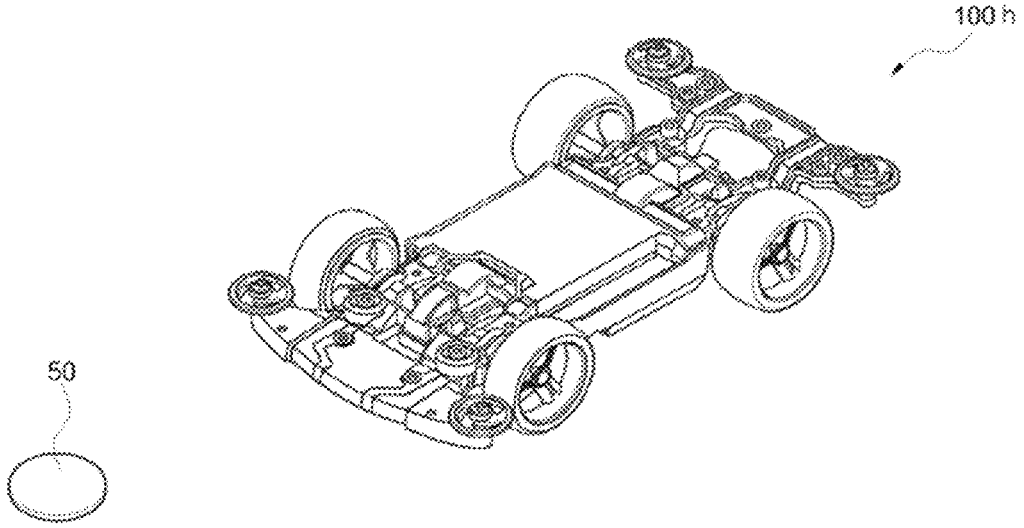
FIG. 28 is a perspective view showing a ninth embodiment of the traveling toy according to the present disclosure.
Figure 29:
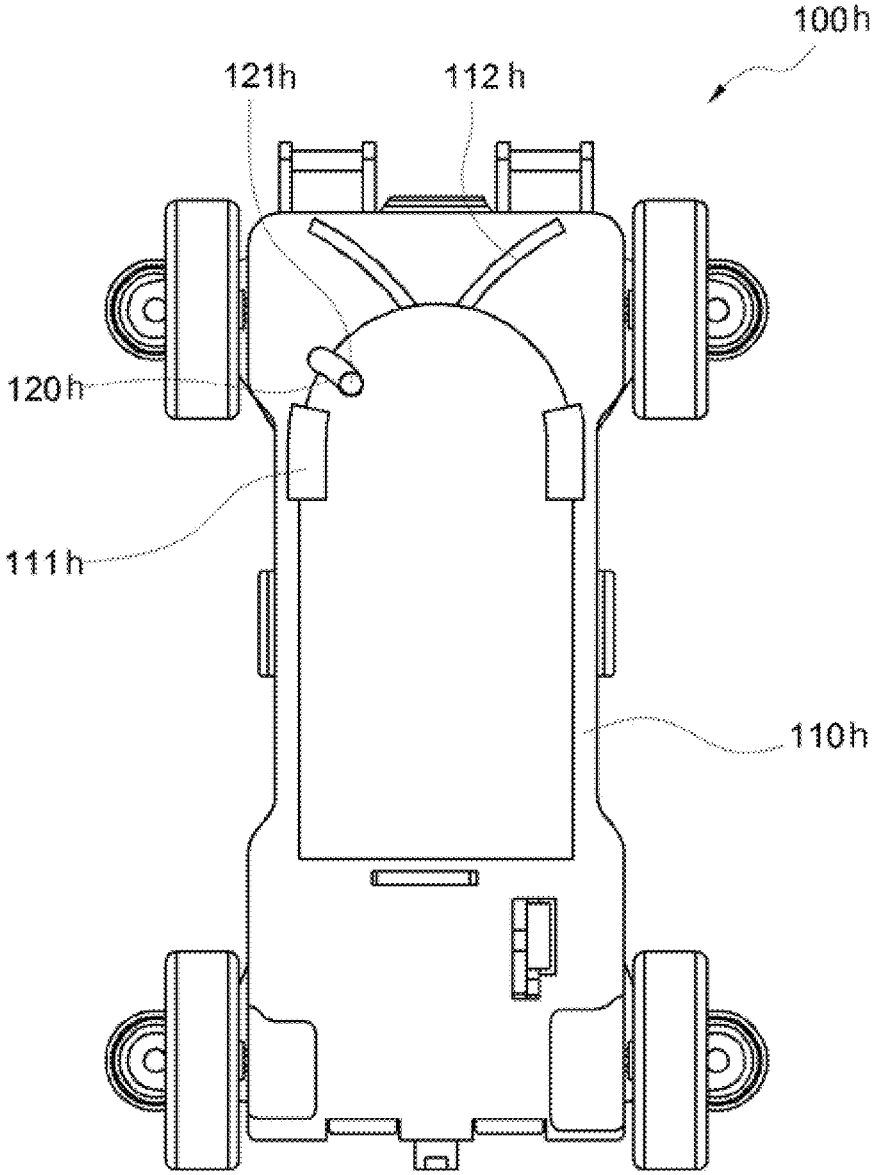
FIG. 29 is a plan view showing the lower configuration of the traveling toy according to FIG. 28.
Figure 30:
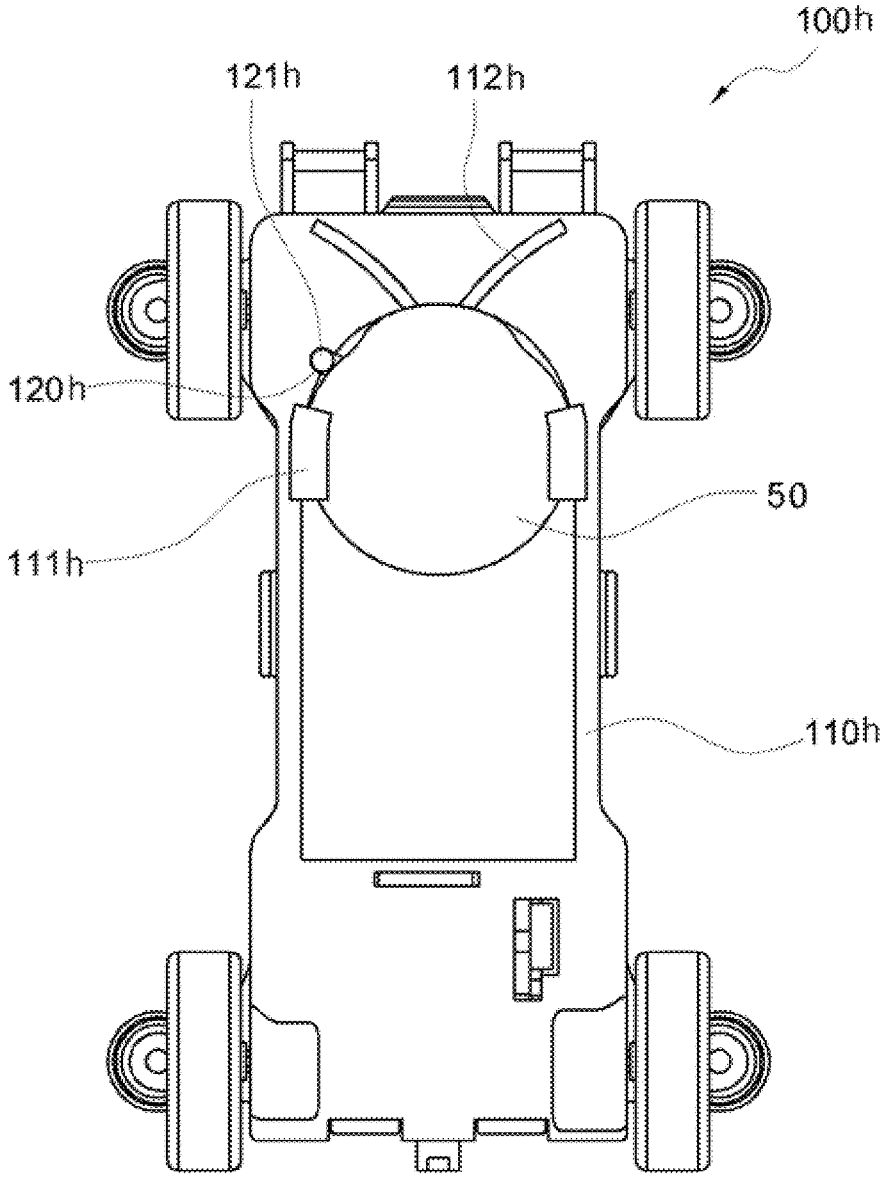
FIG. 30 is another plan view showing the lower configuration of the traveling toy according to FIG. 28.
Figure 31:
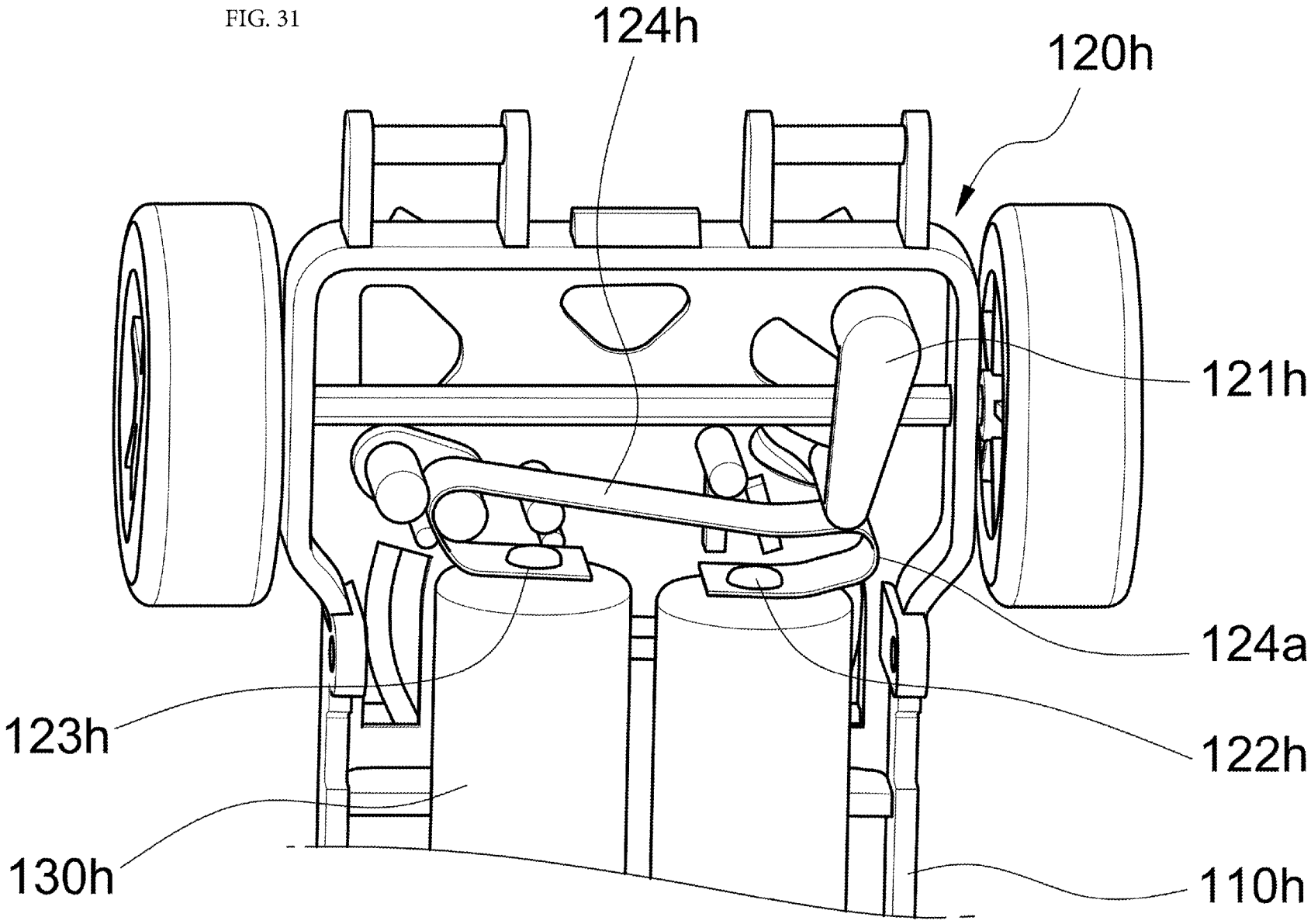
FIG. 31 is an exemplary view showing a switch configuration of the traveling toy according to FIG. 28.

FIG. 25 is a perspective view showing an eighth embodiment of a traveling toy according to the present disclosure, FIG. 26 is an exemplary view showing a process of changing the positions of auxiliary wheels of the traveling toy according to FIG. 25, and FIG. 27 is an exemplary view showing the state in which the traveling toy according to FIG. 25 changes the position of auxiliary wheels along the track.

As shown in FIGS. 25 to 27, a traveling toy 100*g* according to the eighth embodiment includes a toy body 110*g* having a predetermined shape and provided with a guide portion 111 on the bottom surface thereof, multiple wheels 120 mounted on the toy body 110*g* to provide driving force, and multiple auxiliary wheels 130*g* rotatably mounted on the bottom surface of the toy body 110*g* and configured to mate with a rail unit 220 provided on the track 200 and to guide the traveling toy 100*g* along the route provided by the track 200.

The traveling toy 100*g* according to the eighth embodiment is different from the configuration of the traveling toy according to the seventh embodiment in terms of the configuration of rotationally fixing portions 119 for fixing the auxiliary wheels 130*g* to the bottom surface of the toy body 110*g* and the auxiliary wheels 130*g*.

That is, the traveling toy 100*g* according to the eighth embodiment is provided with rotationally fixing portions 119 configured to rotatably support the auxiliary wheels 130*g* to the bottom surface of the lower part of the traveling toy 100*g* to be fixed at a predetermined position.

Each of the rotationally fixing portions 119 includes a hinge portion 119*a*, a first hook 119*b* configured to fix the auxiliary wheel 130*g* to maintain a first position, and a second hook 119*c* configured to support the auxiliary wheel 130*g* to maintain a second position.

Each of the auxiliary wheels 130*g* includes an auxiliary wheel body 131, a wheel 132 installed on one side of the auxiliary wheel body 131 to be freely rotatable, and fastening grooves 139 fastened to the first and second hooks 119*b* and 119*c*.

Thus, when the auxiliary wheels 130*g* are installed to be rotatable about the hinge portions 119*b* so as to be engaged with the first hooks 119*b*, respectively, as shown in FIG. 25, the auxiliary wheels 130*g* are located at the first position at which the auxiliary wheels 130*g* face each other toward the inside of the lower part of the toy body 110*g*, so that the traveling toy 100*g* can travel along the rail unit 220, and when the auxiliary wheels 130*g* are installed to be engaged with the second hooks 119*c*, respectively, as shown in FIG. 26, the auxiliary wheels 130*g* are located at the second position at which the wheels 132 protrude to the outside of the opposite side surfaces of the toy body 110*d*, so that the traveling toy 100*g* can travel along the side wall portions 230 as in FIG. 27.

It will be apparent to a person ordinarily skilled in the art that the toy body 110*g* may be configured to be separable from the lower body so that the toy body 110*g* can be replaced with a toy body 110' having a different shape as that in the first embodiment.

Ninth Embodiment

As shown in FIGS. 28 to 31, a traveling toy 100*h* according to a ninth embodiment is a toy including auxiliary wheels so that, when power is supplied, a driving unit operates and the traveling toy 100*h* is movable along the track. The traveling toy 100*h* includes a housing 110*h*, a switch 120*h*, a power supply unit 130*h*, and an item 50.

The traveling toy 100*h* is formed in a car shape as a whole, and, like a well-known traveling toy, may include a battery included in the body, a driving unit such as a motor, wheels rotating when the driving force is supplied through the driving unit, and at least one auxiliary wheel configured to guide the traveling toy 100*h* through contact with the track such that the traveling direction of the traveling toy 100*h* is changed while the traveling toy 100*h* travels on the track.

The housing 110*h* is a component constituting the body of the traveling toy 100*h*. The housing 110*h* includes fixing protrusions 111*h* and a guide groove 112*h* formed on the lower surface of the lower part thereof, and multiple auxiliary wheels are installed on opposite side surfaces of the housing 110*h*.

In addition, the auxiliary wheels may be fixedly installed on the lower part or upper part of the traveling toy 100*h*, or may be configured in a variable structure in which the auxiliary wheels are separated or moved from the traveling toy 100*h* so as to be shifted from a first position to a second position on the traveling toy 100*h*.

The fixing protrusions 111*h* are spaced apart from the bottom surface of the housing 110*h* by a predetermined distance and support the item 50 so as to be in close contact with the bottom surface of the housing 110*h* of the traveling toy 100*h*.

That is, when the item 20 is inserted between the fixing protrusions 111*h*, the fixing protrusions 111*h* fix the item 20 such that the item 50 is not detached while the traveling toy 100*h* travels.

In addition, the fixing protrusions 111*h* are configured such that the item 50 can be separated in a direction opposite the traveling direction of the traveling toy 100*h* when the fixing protrusions 111*h* come into contact with any stopper (not shown) or the item 50.

The guide grooves 112*h* are formed in the longitudinal direction of the traveling toy 100*h* so as to guide the item 50 supported by the fixing protrusions 111*h* to come into contact with an external object (e.g., a stopper), and are formed in the bottom surface of the housing 110*h* in the traveling direction of the traveling toy 100*h*.

The switch 120*h* is configured to switch on/off the traveling toy 100*h* such that driving power is supplied. When the switch 120*h* comes into contact with any object at an ON position, the switch 120*h* is turned to an OFF position by elastic force to terminate the traveling of the traveling toy 100*h*. The switch 120*h* is installed at one side of the bottom surface of the housing 110*h* such that the switch 120*b* is displaced depending on whether the item 50 installed on the bottom surface of the housing 110*h* is detached or not so as to cause power to be supplied to the traveling toy 100*h*. The switch 120*h* includes a switching lever 121*h*, a first electrode 122*h*, a second electrode 123*h*, a leaf spring 124*h*, and an elastic portion 124*h'*.

The switching lever 121*h* is displaced from the OFF position to the ON position by the item 50 attached to one side of the traveling toy 100*h* so as to press the first electrode 122*h* of the leaf spring 124*h*, thereby causing the first electrode 122*h* and the second electrode 123*h* to be electrically connected to a power supply unit 130*h*.

In addition, the switching lever 121*h* may be forcibly disposed at the ON position or the OFF position by the user's operation.

The leaf spring 124*h* is configured to cause the first and second electrodes 122*h* and 123*h* to be electrically connected to or separated from the power supply unit 130*h* depending on the position of the switching lever 121*h*. In the OFF state, at least one of the electrode 122*h* and the second electrode 123*h* is maintained in the state of being separated from the power supply unit 130*h*, and in the ON state, the switching lever 121*h* is displaced by the item 50 to press a portion of the leaf spring, the first electrode 122*h* and the second electrode 123*h* are electrically connected to the power supply unit 130*h*.

The elastic portion 124*h*' is provided at a distal end of the leaf spring 124*h* and is compressed when the switching lever 121*h* is moved to the ON position by the item 50. When the item 50 is separated, the elastic portion 124*h*' is stretched to cause the leaf spring 124*h* to be returned to the original position by elastic force such that the switching lever 121 is located at the OFF position. At the same time, the elastic portion 124*h*' provides elastic force such that the first electrode 122*h* is separated from the power supply unit 130*h*.

The power supply unit 130*h* is a battery, and may be a primary battery or a secondary battery.

Figure 32:
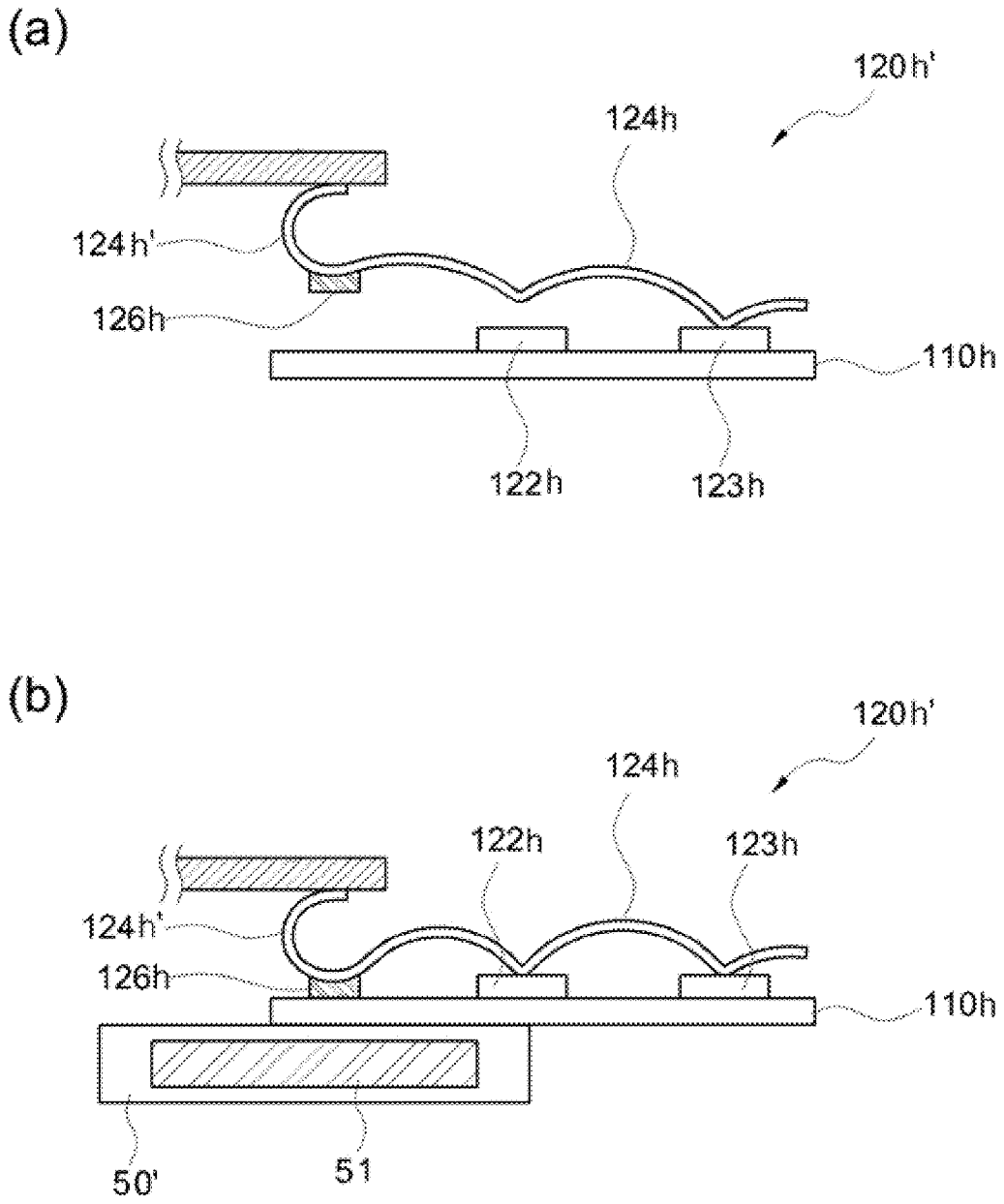
FIG. 32 is an exemplary view showing another switch configuration of the traveling toy according to FIG. 28.
Figure 33:
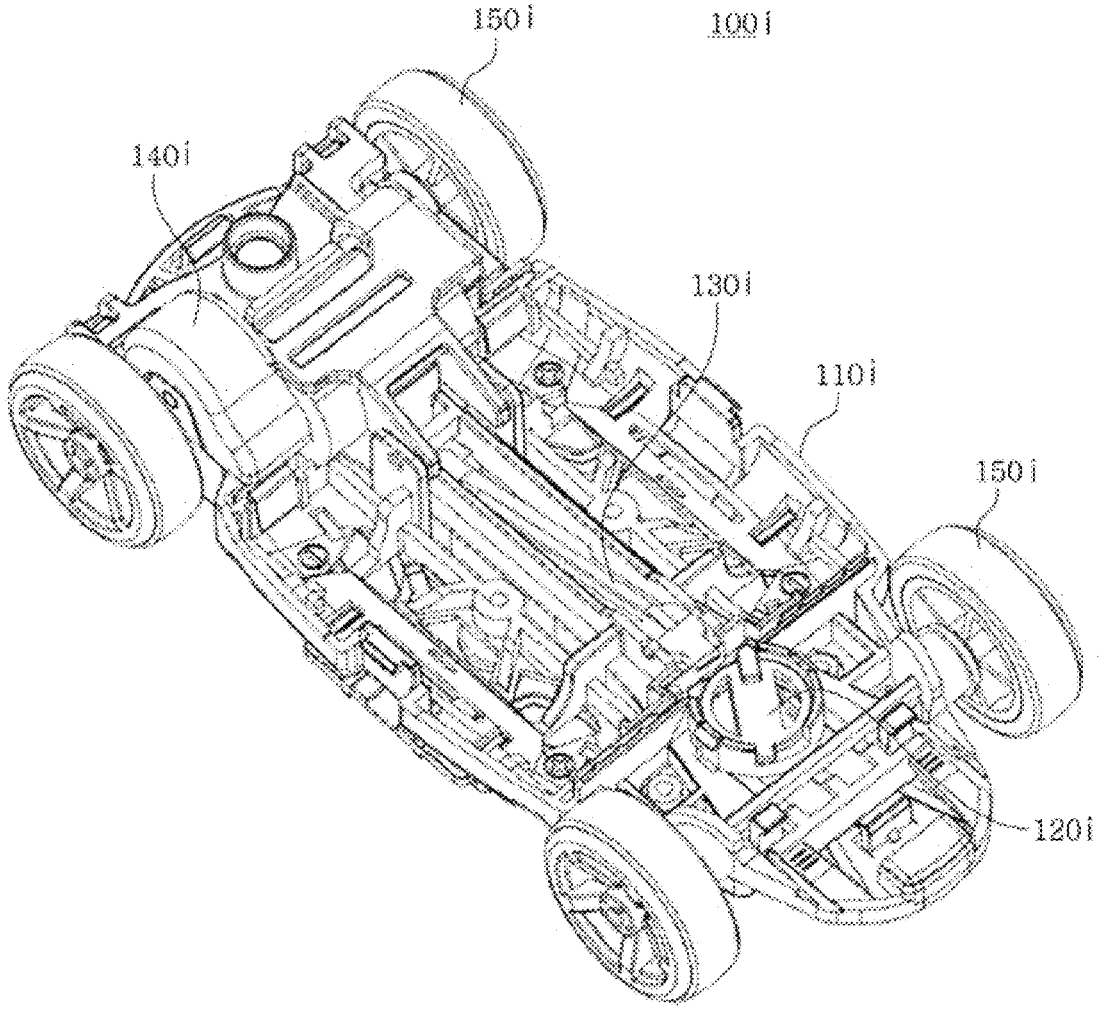
FIG. 33 is a perspective view showing a tenth embodiment of the traveling toy according to the present disclosure.
Figure 34:
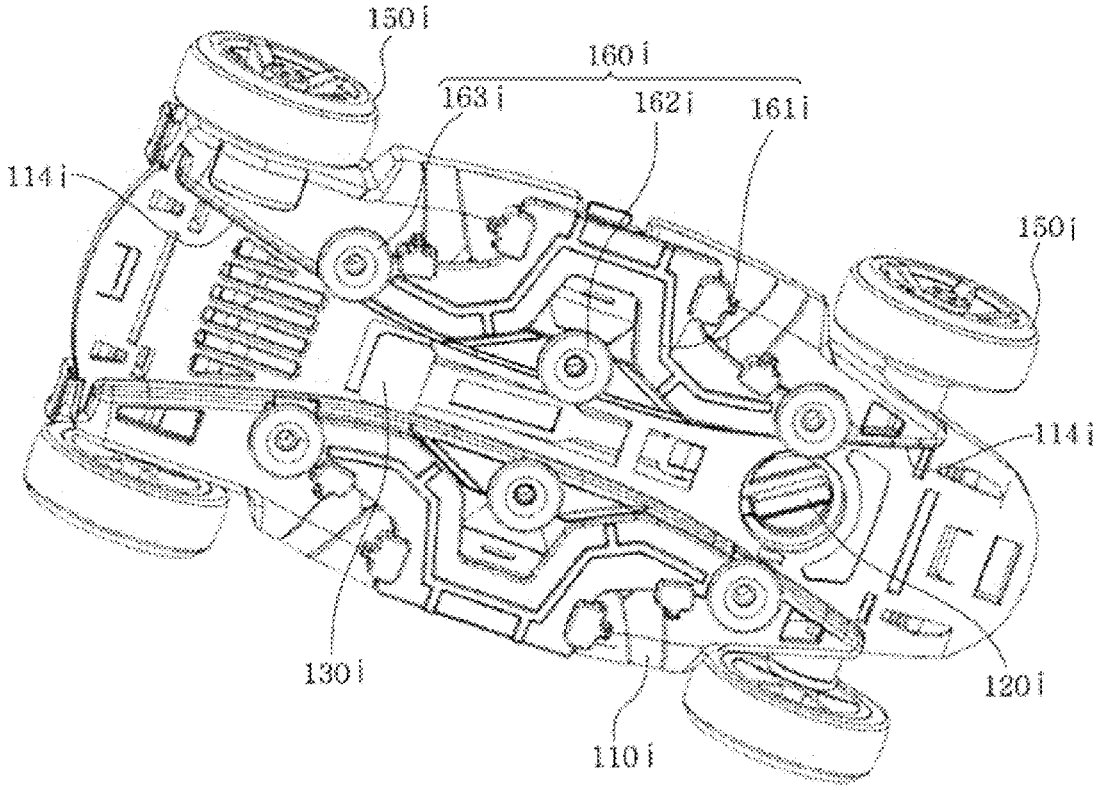
FIG. 34 is a perspective view showing the bottom side of the traveling toy according to FIG. 33.
Figure 35:
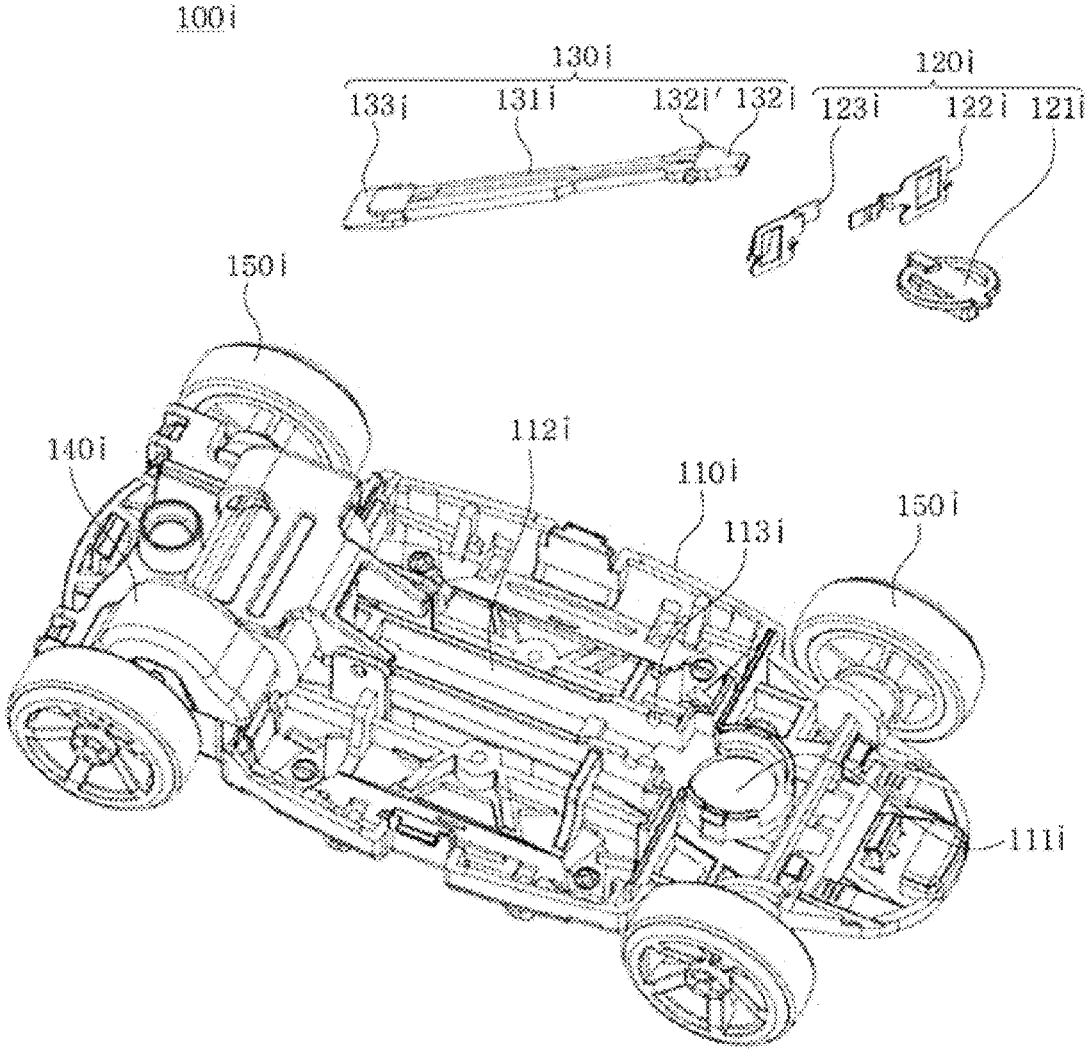
FIG. 35 is an exploded perspective showing a switch unit of the traveling toy according to FIG. 33.
Figure 36:
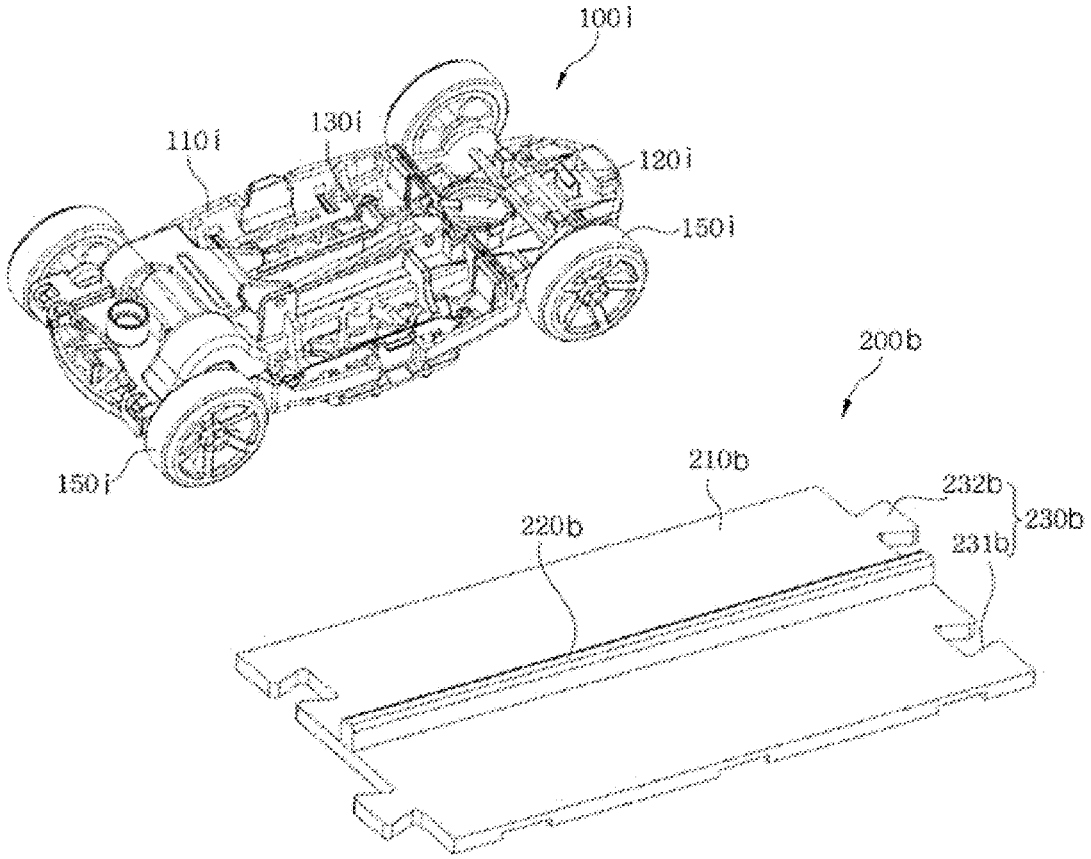
FIG. 36 is a perspective view illustrating an operation process of the traveling toy according to FIG. 33.
Figure 37:
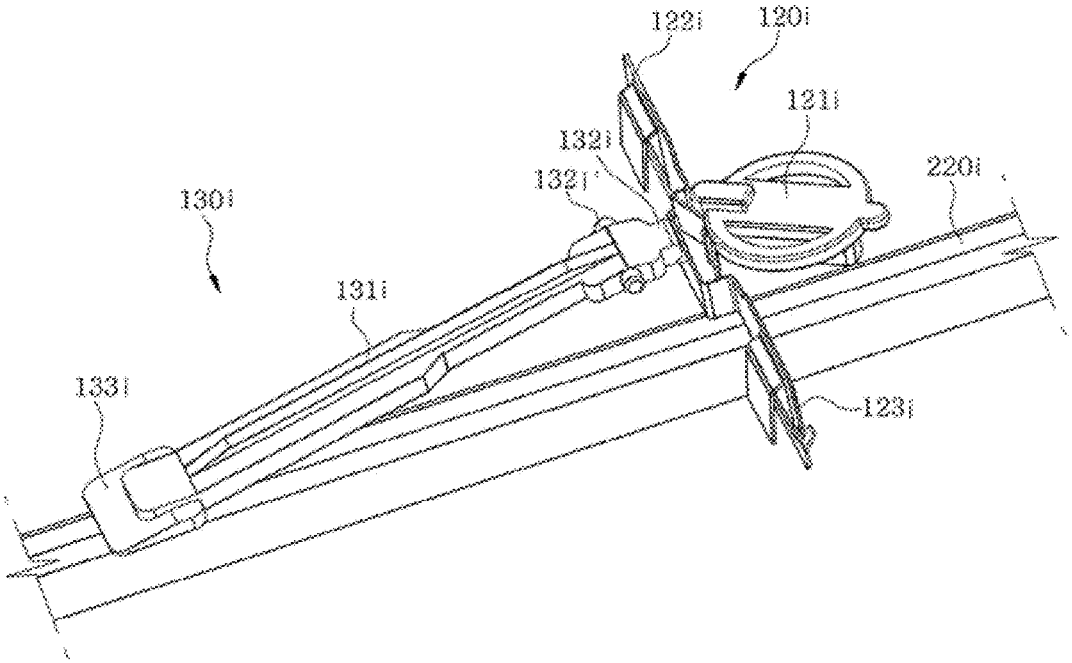
FIG. 37 is a perspective view showing an operation process of the switch unit of the traveling toy according to FIG. 33.
Figure 38:
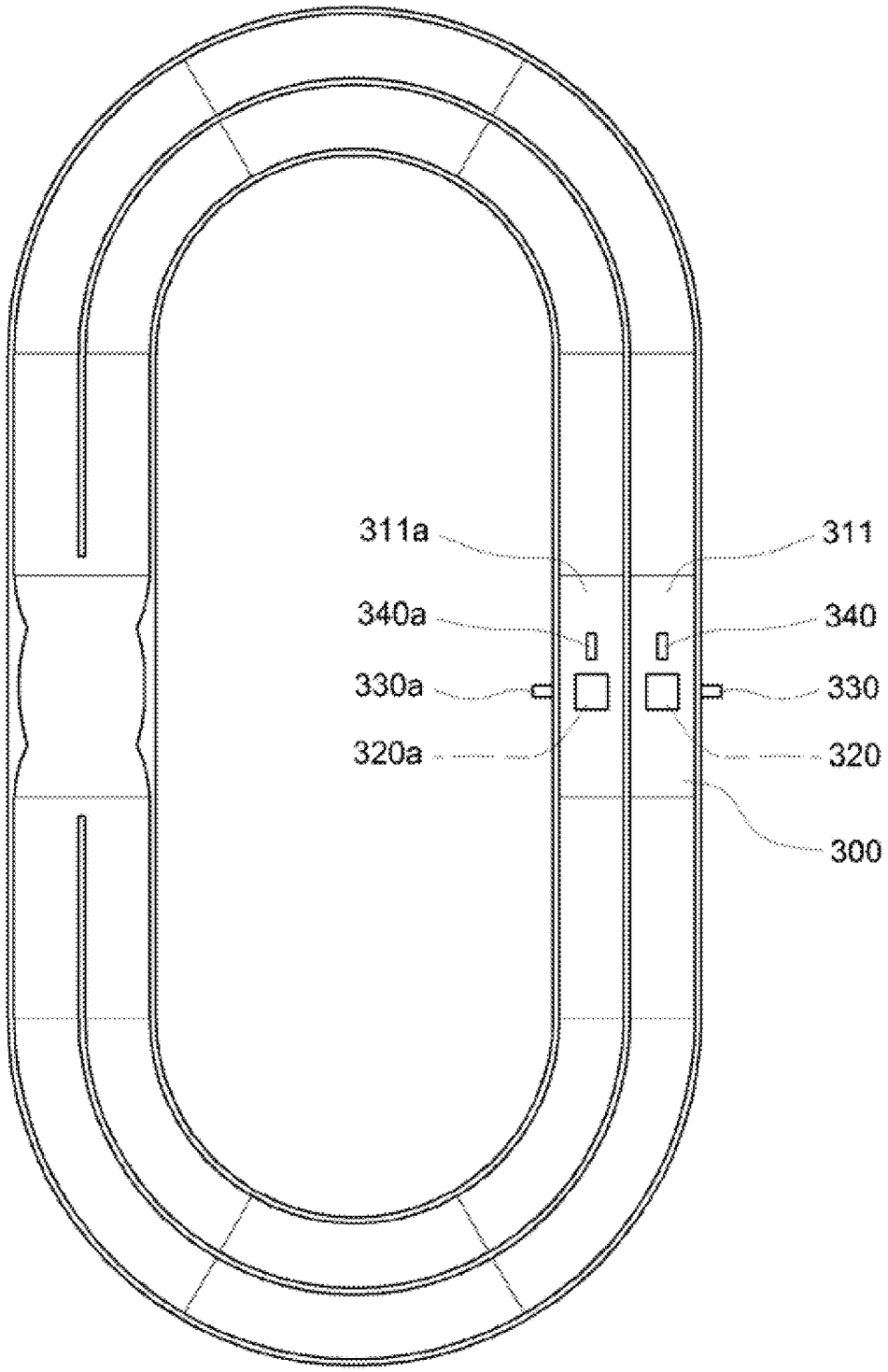
FIG. 38 is a plan view showing a play apparatus using a traveling toy according to the present disclosure.
Figure 39:
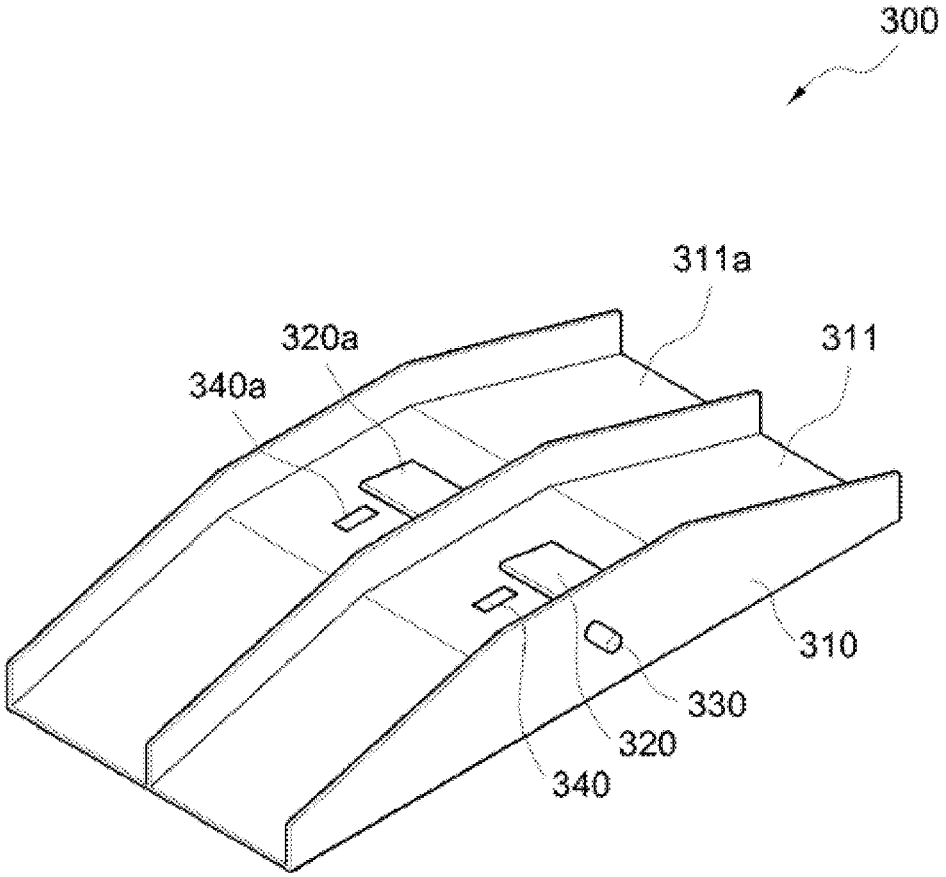
FIG. 39 is a perspective view showing a finish track of the play apparatus using a traveling toy according to FIG. 38.
Figure 40:
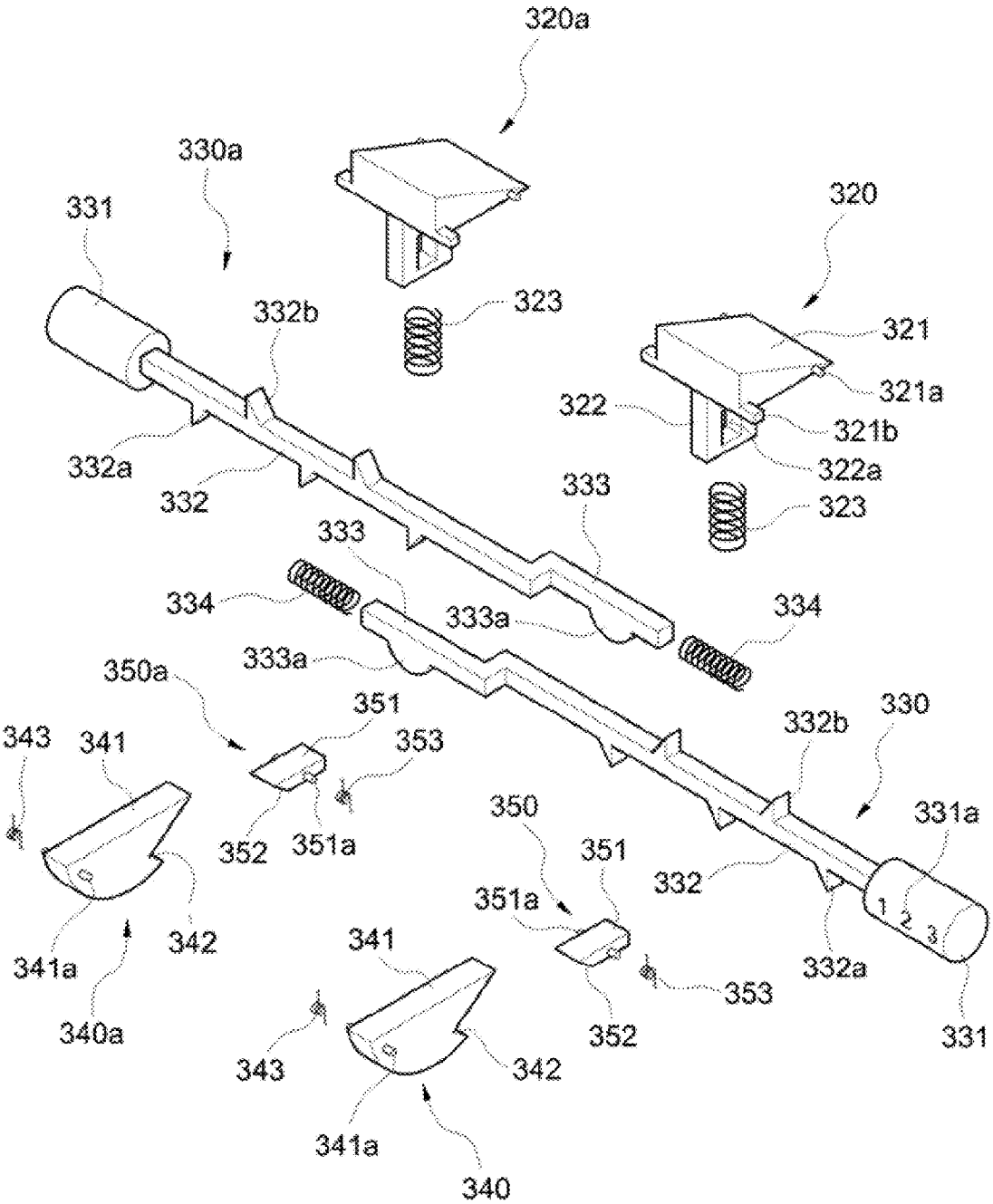
FIG. 40 is an exploded perspective view showing the configuration of the finish track according to FIG. 39.
Figure 41:
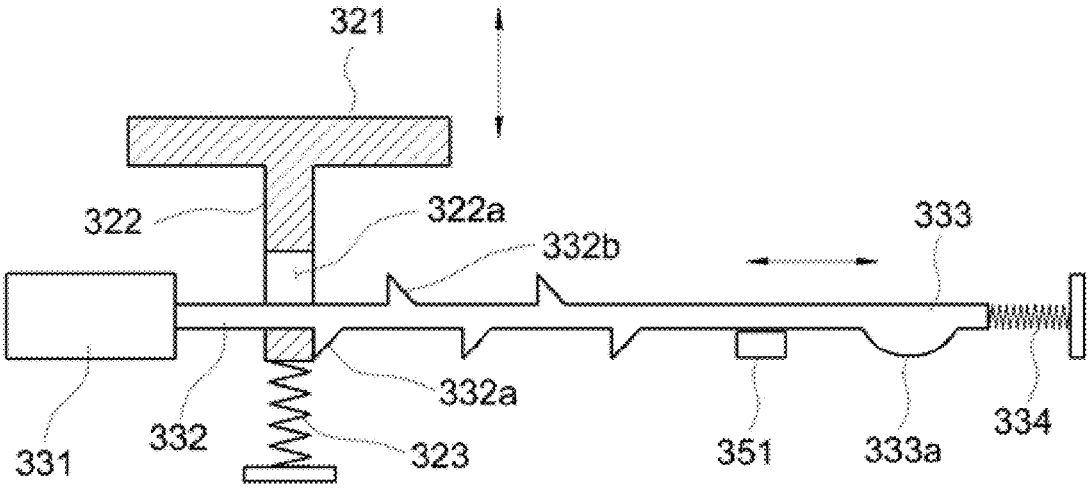
FIG. 41 is an exemplary view showing a counter operation process of the finish track according to FIG. 39.

In the present embodiment, the switch 120*h* using the switching lever 121*h* is described as an embodiment, but the present disclosure is not limited thereto. The switch 120*h* may be constituted by a magnetic field switch 120*h*' as shown in FIG. 32.

That is, as shown in FIGS. 32A and 32B, the switch 120*h*' is configured such that a magnetic switching lever 126*h* is provided on the leaf spring 124*h* and forms a magnetic field with an item 50' attached to the bottom surface of the housing 110*h* of the traveling toy 100*h* so as to be displaced from the OFF position to the ON position, thereby causing the first electrode 122*h* and the second electrode 123*h* to be electrically connected to the power supply unit.

The leaf spring 124*h* is displaced such that the first and second electrodes 122*h* and 123*h* are electrically connected to each other depending on the change of the ON/OFF position of the magnet 126*h*.

In addition, the elastic portion 124*h*' is provided at one end of the leaf spring 124*h* such that the elastic portion 124*h*' is stretched when the magnet 126*h* is located at the ON position, and when the item 50' is separated and thus the magnetic field disappears, the elastic portion 124*h*' is compressed to provide elastic force so as to cause the magnet 126*h* to be located at the OFF position.

The item 50 may be made of a paper material, a plastic resin material, or the like. The item 50 may have various shapes such as a polygonal shape, a disk shape, an elliptical shape, and a ring shape, and is configured to be attachable to/detachable from the lower part of the traveling toy 100*h*.

In addition, the item 50 may have an arbitrary figure, symbol, letter, shape, character or the like, which may be formed on the outer surface thereof through printing, embossing, or engraving.

When the item 50 is attached to the lower part of the housing 110*h* of the traveling toy 100*h*, the circumference of the item 50 compresses the switching lever 121*h* of the switch 120*h* such that the switching lever 121*h* of the switch 120*h* is displaced from the OFF position to the ON position.

In addition, when the item 50 is separated from the housing 110*h*, the force for compressing the switching lever 121*h* disappears such that the switching lever 121*h* is returned to its original position.

Meanwhile, when the magnetic switching lever 126*h* is installed in the switch 120*h*' as shown in FIGS. 32A and 32B, a magnetic body 51 may be installed inside the item 50' such that a magnetic field can be formed between the item 50' and the magnetic switching lever 126*h*.

In the present embodiment, the item 50 or 50' is configured to be supported by the traveling toy 100*h* through the fixing protrusions 111*h*. However, the present disclosure is not limited thereto, and a magnet may be embedded in the item 50'. The item may form a magnetic field at any position in the traveling toy 100*h* with the embedded magnet such that the item maintains the state of being attached to a predetermined position on the traveling toy 100*h*.

Tenth Embodiment

As shown in FIGS. 33 to 37, a traveling toy 100*i* according to a tenth embodiment is configured to operate and travel when the switch is turned on through the contact with the track using the weight of the traveling toy 100*i* so as to supply power, and the traveling toy 100*i* is provided with auxiliary wheels so as to be movable along a track. The traveling toy 100*i* includes a body unit 110*i*, a body switch unit 120*i*, a switch unit 130*i*, a driving unit 140*i*, wheels 150*i*, and auxiliary wheels 160*i*.

The body unit 110*i* is a component that forms the body and the outer appearance of the traveling toy 100*i* and is formed in a car shape as a whole. The body unit 110*i* includes a body switch installation groove 111*i*, a switch installation groove 112*i*, rotary shaft installation grooves 113*i*, and a guide portion 114*i*.

In the present embodiment, the outer appearance of the traveling toy is described as a car shape for the convenience of description. However, the present disclosure is not limited thereto, and the outer shape of the traveling toy may be changed into various shapes such as an animal shape, an insect shape, and the shape of a transportation component such as a ship, a train, and an airplane, as long as the traveling toy has a shape having wheels 150*i* so as to be movable along the track.

The body switch installation groove 111*i* is formed in a cylindrical bore shape on the front side of the body unit 110*i* such that an ON/OFF switching operation can be performed on the body switch unit 120*i*.

The switch installation groove 112*i* is formed in a rectangular shape along the longitudinal center of the body unit 110*i* such that an on/off switching operation can be performed on the switch unit 130*i*, and the rotary shaft installation grooves 113*i* are formed such that a rotary shaft 132*i*' is installed therein so as to make the switch unit 130*i* rotatable.

The guide portion 114*i* is a groove formed in the longitudinal direction in the bottom surface of the body unit 110*i* and guides the rail unit 220*b* of the track 200*b* to pass therethrough.

That is, the guide portion 114*i* guides the traveling toy 100*i* to move along a route formed through the rail unit 220*b*.

The body switch unit 120*i* is configured to perform an ON/OFF switching operation such that the traveling toy 100*i* is supplied with driving power according to a user's setting. The body switch unit 120*i* includes a body switch lever 121*i*, a first contact 122*i*, and a second contact 123*i*.

The body switch lever 121*i* is a disk-shaped member having a protrusion on one side, and is rotated in a forward or reverse direction according to the user's manipulation such that the protrusion compresses and displaces the first contact 122*i*, thereby causing the first contact 122*i* to come into electrical contact with the second contact 123*i*.

The first contact 122*i* is a plate-shaped metal member, one side of which is fixed to the body unit 110*i* and the other side of which is displaced depending on the forward or reverse rotation of the body switch lever 121*i* so as to come into electrical contact with the second contact 123*i*, whereby the body switch unit is turned ON such that driving power is supplied to the driving unit 140*i* or the switch unit performs the OFF operation such that driving power is interrupted.

The second contact 123*i* is a plate-shaped metal member which is disposed opposite the first contact 122*i* at a position spaced from the first contact 122*i* by a predetermined distance. One side of the second contact 123*i* is fixed to the body unit 110*i* and the other side of the second contact 123*i* is displaced according to the movement of the switch unit 130*i* so as to come into electrical contact with the first contact 122*i*, whereby the body switch unit is turned ON such that driving power is supplied to the driving unit 140*i* or the switch unit is turned OFF so as to interrupt driving power.

The switch unit 130*i* is a component that performs an ON or OFF switching operation such that driving power is supplied to the traveling toy in the following manner: depending on whether or not one side of the switch lever 131*i* is in contact with the track 200*b*, when the other side of the switch lever 131*i* is displaced, the second contact 123*i* is moved to be brought into electrical contact with the first contact 122*i* or to be separated from the first contact 122*i*. The switch unit 130*i* includes a rod-shaped switch lever 131*i* having a predetermined length, a switch contact portion 132*i* formed on one side of the switch lever 131*i*, a rotary shaft 132*i*' coupled to the rotary shaft installation groove 113*i* so as to rotatably support the switch lever 131*i*, and a rail contact portion 133*i* which is provided on the other side of the switch lever 131*i* to come into contact with the rail unit 220*b* provided on the track 200.

That is, the switch unit 130*i* is formed in a lever structure in which, when the rail contact portion 133*i* comes into contact with the rail unit 220*b* and moves upwards about the rotary shaft 132*i*', the switch contact portion 132*i* moves downwards about the rotary shaft 321*i*'.

In addition, the switch unit 130*i* is configured such that the second contact 123*i* of the body switch unit 120*i* can be displaced. When the rail contact portion 133*i* of the switch unit 130*i* comes into contact with the rail unit 220*b*, the rail contact portion 133*i* is displaced upwards and the switch contact portion 132*i* of the switch unit 130*i* moves downwards so as to compress the second contact 123*i*.

When the second contact 123*i* is displaced through the compression of the switch contact portion 132*i*, it comes into electrical contact with the first contact 122*i*, whereby the switch unit is turned ON such that the driving power is supplied to the driving unit 140*i*.

In addition, when the rail contact portion 133*i* of the switch unit 130*i* is separated from the rail unit 220*b*, the switch contact portion 132*i* of the switch unit 130*i* is displaced downwards to be separated from the second contact 123*i* such that the OFF operation is performed such that the driving power supplied to the driving unit 140*i* is interrupted.

The driving unit 140*i* is installed in the body unit 110*i* and is configured to rotate the wheels 150*i* when the driving power is supplied thereto, so that the traveling toy 100*i* is capable of traveling. Preferably, the driving unit 140*i* is constituted with a motor.

The auxiliary wheels 160*i* are installed in the longitudinal direction on the bottom surface of the body unit 110*i*, preferably along the guide portion 114*i*, and are configured to mate with the rail unit 220*b* that passes through the guide portion 114*i* so as to allow the traveling toy 100*i* to move along the route provided by the track 200*b*. Each of the auxiliary wheels includes an auxiliary wheel body 161*i* and multiple auxiliary wheels 162*i* and 163*i*.

In addition, the auxiliary wheels 160*i* may be fixedly installed at predetermined positions in the body unit 110*i* or may be configured in a variable structure in which the auxiliary wheels 160*i* are separated or moved from the body unit 110*i* so as to be shifted from a first position to a second position on the body unit 110*i*.

The track 200*b* includes a rectangular bottom portion 210*b*, a rail unit 220*b* protruding in the longitudinal direction on the bottom portion 210*b*, and fastening parts 230*b* including a first fastening portion 231*b* and a second fastening portion 231*b* provided on the opposite sides of the bottom portion 210*b* to be coupled to a neighboring track such that the length of the track 210*b* is increased. The rail unit 220*b* of the track 200*b* passes through the guide portion 114*i* of the traveling toy 100*i* and comes into contact with the rail contact portion 133*i* of the traveling toy 100*i* such that the traveling toy is turned ON.

(Play Apparatus)

Next, a play apparatus using a traveling toy according to the present disclosure will be described.

As shown in FIGS. 38 to 43, a play apparatus using a traveling toy according to the present disclosure includes a traveling toy 100*h*, an item 200, and a track 300. The traveling toy 100*h* includes multiple wheels and auxiliary wheels mounted on a toy body having a predetermined shape to travel along a track providing a predetermined route, and when a switch installed on the bottom surface of the toy body to control ON/OFF of the driving power comes into contact with a stopper 340 or 340*a* to be turned OFF, the traveling of the traveling toy 100*h* is terminated.

The traveling toy 100*h* will be described with reference to the traveling toy 100*h* according to the ninth embodiment, and a detailed description thereof will be omitted.

The item 200 is detachably installed on the lower part of the traveling toy 100*h*. When the item 200 is attached to the lower part of the traveling toy 100*h*, the item 200 compresses the switch 120 so as to displace the switch 120 from the OFF position to the ON position, and when the item 200 collides with the stopper 340 or 340*a* of the track 300, the item 200 is separated from the traveling toy 100*h* so that the switch 120 is returned to the OFF position.

The track 300 is configured by forming a closed loop using a straight track, a curved track, a course change track, and a finish track 310.

The finish track 310 includes first and second travel courses 311 and course 311*a* arranged side by side, and first and second detectors 320*a* and 320*a*, each of which is provided on one of the first and second driving courses 311 and 311*a*, count the number of laps of the traveling toys 100*h*, which travel on the first and second traveling courses 311 and 311*a*, using the first counter 330 and the second counter 330*a*, respectively.

In addition, when the numbers of laps of the traveling toys 100 reach the predetermined number of laps, in the finish track 310, the first stopper 340 and the second stopper 340*a*, which are provided in the first and second traveling courses 311 and 311*a*, are operated to protrude.

The first and second detectors 320 and 320*a* are respectively installed on the first and second traveling courses 311 and 311*a* and are configured to detect whether or not the traveling toys 100*h*, which respectively travel on the first and second travel courses 311 and 311*a*, pass thereby. Each of the first and second detectors 320 and 320*a* includes an upper detector body 321, a lower detector body 322, and a detector spring 323.

The upper detector body 321 is a plate-shaped member having an inclined surface formed on the upper surface thereof, and includes a detector rotation shaft 321*a* formed at one side thereof such that the upper detector body 321 is rotatably coupled to a travel course.

In addition, a detector engagement protrusion 321*b* is formed on the other side of the upper detector body 321 such that the detector upper body 321 does not protrude upwards from the travel course beyond a predetermined range.

The lower detector body 322 is provide to extend downwards from the bottom surface of the upper detector body 321 by a predetermined length, and a detector through hole 322*a*, which is a long rectangular hole is formed in the vertically lower side of the detector lower body 322.

The detector spring 323 is provided between the bottom surface of the finish track 310 and the lower detector body 322 to provide elastic force to the upper detector body 321 and the lower detector body 322 such that the inclined surface of the upper detector body 321 protrudes on the travel course.

The first and second counters 330 and 330*a* are installed to be interlocked with the first and second detectors 320 and 320*a*, respectively, and are configured to count the numbers of laps of the traveling toys 100*a* when the traveling toys 100*h* pass through the first and second detectors 320 and 320*a*, respectively. Each of the first and second counters 330 and 330*a* includes a button portion 331, a counter body portion 332, a subsidiary counter body portion 333, and a counter spring 334.

The button portion 331 displays a lap number 331*a* on the outer surface thereof, and when the user pushes the button portion 331, the counter body portion 332, the subsidiary counter body portion 333, and the counter spring 334 are shifted.

The counter body 332 is formed to extend by a predetermined length to one side of the button portion 331 and is disposed to pass through the detector through hole 322*a* formed in the detector 320, and is structured to shift by a predetermined position due when the detector 320 is operated to move up and down. The counter body 332 includes first engagement protrusions 332*a* and second engagement protrusions 332*b*.

A plurality of first engagement protrusions 332*a* are installed at predetermined intervals in the longitudinal direction of the counter body portion 332 to selectively pass through the detector through hole 322*a* formed in the detector 320 or to maintain the engagement state with the detector through hole 322*a* such that the counter body portion 332 is maintained at a predetermined position or shifted.

That is, when the traveling toy 100*h* compresses the detector 320 while passing through the detector 320, the detector 320 moves downwards on the drawing sheet and the first engagement protrusions 332*a* pass through the detector through hole, whereby the number of laps of the traveling toy 100*h* is counted.

The second engagement protrusions 332*b* are provided on the counter body 332 at the position opposite the first engagement protrusions 332*a* and are configured to prevent the counter body portion 332 from being shifted by a predetermined distance or more. Preferably, each of the second engagement protrusions 332*b* is provided in the middle of the distance between adjacent first engagement protrusions 332*a*.

That is, in order to prevent the first engagement protrusions 332*a* from shifting more than necessary due to the elastic force of the counter spring 334 while passing through the detector through hole 322*a*, the second engagement protrusions 332*b* cannot pass through the detector through hole 322*a* such that the counter body portion 332 cannot be shifted by a predetermined distance or more.

The subsidiary counter body portion 333 extends from the distal end of the counter body portion 332 by a predetermined length, and is configured to compress a latch 350 to be locked or unlocked depending on the position where the counter body portion 332 is shifted by the elastic force of the counter spring 334. A latch compression portion 333*a* protrudes from the distal end of the subsidiary counter body portion 333.

The latch compression portion 333*a* allows the second stopper 340*a* provided on the neighboring travel course to be locked or unlocked.

When the counter body portion 332 is moved via the button portion 331, the counter spring 334 is compressed and provides an elastic force to shift the counter body portion 332 such that the counter body portion 332 is returned to its original position.

The first and second stoppers 340 and 340*a* are respectively installed on the first and second travel courses 311 and 311*a* to be spaced from the first and second detectors 320 and 320*a* by a predetermined distance. When each of the first and second counters 330 and 330*a* counts the number of laps and thus the counter operation is completed, the first and second stoppers 340 and 340*a* are unlocked to partially protrude to the first and second travel courses 311 and 311*a*. The first and second stoppers 340 and 340*a* are configured to turn OFF the switch such that the traveling of the traveling toys 100*h* is terminated. Each of the first and second stoppers 340 and 340*a* includes a stopper body 341 installed to be rotatable via the stopper rotary shaft 341*a*, a stopper engagement protrusion 342 formed at a side of the stopper body 341 as a protrusion, and a stopper spring 343 configured to provide an elastic force to maintain the stopper body 341 at a predetermined position.

The first and second latches 350 and 350*a* are configured to be operated such that the first and second stoppers 340 and

340*a* are locked or unlocked according to the operation of the first and second counters 330 and 330*a*. Each of the first and second latches 350 and 350*a* includes a latch body 351 rotatably installed via a latch rotary shaft 351*a*, an inclined surface 352 formed to mate with the stopper engagement protrusion 342, and a latch spring 353 configured to provide an elastic force such that the latch body 351 is maintained at a predetermined position.

Next, the operation process of the play apparatus using a traveling toy will be described.

The user pushes the button portion 331 provided on the finish track 310 to set the number of laps by a displayed lap number 331*a* (e.g., one lap), and the first and second stoppers 340 and 340*a* are disposed to be accommodated inside the first and second travel courses 311 and 311*a* so as to be in a locked state, and then the traveling toys 100*h* for traveling are placed on the first and second courses 311 and 311*a*, respectively.

At this time, each of the traveling toys 100*h* is provided with the item 200 on the bottom surface thereof such that the switch 120 is maintained in the ON state.

Then, the traveling toys 100*h* are placed on the first and second travel courses 311 and 311*a*, respectively, to start the traveling.

When the traveling toys 100*h* complete one lap along the track 300 and the traveling toy on the first travel course 311 first passes through the first detector 320, the first detector 320 is pushed and the counter body portion 332 is shifted by the elastic force of the counter spring 334.

As the counter body portion 332 is shifted, the subsidiary counter body portion 333 is also shifted, and the latch compression portion 333*a* of the subsidiary counter body portion 333 compresses the second latch 350*a* so that the second stopper 340*a* is unlocked.

That is, when the traveling toy 100*h* traveling on the first travel course 311 through the race passes first the finish track 310, the stopper 340*a* of the second travel course 311*a* is unlocked.

When the stopper 340*a* is unlocked, the stopper 340*a* comes into contact with the item 200 installed on the bottom surface of the traveling toy, which travels on the second travel course 311*a*, and thus the switch 120 is returned to the OFF position so that power supplied to the traveling toy 100*h* is interrupted and the traveling is terminated.

Therefore, when win or loss is decided, the winning vehicle may further travel one lap along the track and the losing vehicle may be stopped, so that the interest in the racing game can be further enhanced and the win or loss can be accurately discriminated.

Meanwhile, in the present embodiment, a counter for counting the number of laps is implemented through a mechanical configuration and the corresponding unlocking operation of the stopper is mechanically performed. However, the counter and the stopper may be configured using an electronic component material using a switch and an actuator.

As shown in FIGS. 44 and 45, a finish track according to another embodiment of the present disclosure includes first and second detectors 320 and 320*a*, an input unit 410, first and second counter switches 420 and 421, a controller 430, first and second actuators 440 and 441, first and second stoppers 340 and 340*a*, first and second latches 350, and 350*a*, and a display unit 450.

The first and second detectors 320 and 320*a* are provided on the first and second travel courses 311 and 311*a* (see FIG. 39) to detect whether or not the traveling toy 100*h* pass thereby.

The input unit 410 is configured to detect the number of laps of the traveling toy 100*h* from the user, and includes an input component such as a button, a micro switch, or a keypad.

The first and second counter switches 420 and 421 are installed under the first and second detectors 320 and 320*a*, respectively, so that the traveling toy 100*h* is connected to the first and second detecting units 320 and 320*a* so as to count the numbers of times of being pushed by the traveling toys 100*h* while the traveling toys 100*h* pass through the first and second detectors 320 and 320*a*, that is, the number of laps.

The controller 430 detects the number of laps input from the input unit 410 and the numbers of laps counted by the first and second counter switches 420 and 421, causes the numbers of laps counted by the first and second counter switches 420 and 421 to be displayed through the display unit 450, and compares the input numbers of laps and the counted numbers of laps to control the operation signals output from the first and second actuators 440 and 441 according to the comparison result.

The first and second actuators 440 and 441 are turned ON/OFF according to an operation signal output from the controller 430 to lock or unlock the latches.

The first and second actuators 440 and 441 are configured to be displaced when power is supplied thereto, and is preferably constituted with a solenoid valve, an electromagnet switch, or the like.

The first and second stoppers 340 and 340*a* are spaced apart from the first and second detectors 320 and 320*a* by a predetermined distance. When the first and second latches 350 and 350*a* are locked or unlocked according to the operation of the first and second actuators 440 and 441, the first and second stoppers 340 and 340*a* partially protrude to the first and second travel courses 311 and 311*a*.

The first and second latches 350 and 350*a* are displaced according to the operation of the first and second actuators 440 and 441 such that the first and second stoppers 340 and 340*a* are locked or unlocked.

The display unit 450 displays the number of laps according to a control signal output from the controller 430.

Thus, the first and second detectors 320 and 320*a* are cross interlocked with the first and second stoppers 340 and 340*a* provided on the first and second travel courses 311 and 311*a*, so that, when a traveling toy 100 that passes first through the first or second detector 320 or 320*a* is detected, the stopper on the travel course on which another traveling toy passes late is unlocked and the switch of the traveling toy that passes late is turned OFF, whereby the win or loss can be accurately discriminated.

(Track)

FIGS. 46 to 50 show a rail-type track of a play apparatus using a traveling toy according to the present disclosure. The rail-type track includes a track fixing unit 600 and a rail unit 700.

The track fixing unit 600 fixedly supports rail units 700 and 700*a* and is configured to mate a portion of the traveling toy 100*a*, which travels along the rail units 700 and 700*a*, so as to prevent the traveling toy 100*a* from deviating from the course thereof. The track fixing unit 600 includes a fixing unit body 610 and a support portion 620.

The fixing unit body 610 includes an insertion groove 611 into which the rail 700 is inserted and fixed and flanges 612 protruding to both sides of the distal end of the insertion groove 611 by a predetermined length.

The fixing unit body 610 is a rectangular member that prevents the rail 700 from moving and prevents the traveling toy 100*a* from escaping from the rail 700 in the course of passing through the fixing unit body 610.

The insertion groove 611 is formed in the longitudinal direction of the fixing unit body 610, so that the rail unit 700 can be fixed when the rail unit 700 is inserted into the insertion groove 611.

The insertion groove 611 is formed to have a cross-sectional shape of a cross section according to the shape of the rail unit 700 in the shape of "○", "□", or "T", and preferably in the shape of "○" depending on the shape of the rail unit 700.

The flanges 612 are configured to prevent the traveling toy 100*a* from escaping from the rail unit 700 in the course of passing through the fixing unit body 610, and are formed to protrude from both sides of the distal end of the insertion groove 611 by a predetermined length.

The support portion 620 is a plate-shaped member installed on both sides of the fixing unit body 610 to support the fixing unit body 610 to be fixed to the ground. The support portion 620 includes support portion coupling protrusions 621 and support portion coupling grooves 622 and extends from the center of the fixing unit body 610 by a predetermined length.

The support portion coupling protrusions 621 are formed at a distal end of the support portion 620 formed through embossing at one side of the fixing unit body 610 and are fixedly fitted into the support portion coupling grooves 622 of a neighboring track fixing unit 600'.

The support portion coupling grooves 622 are formed at a distal end of the support portion 620 formed through engraving at the other side of the fixing unit body 610 and are fixedly fitted to the support portion coupling protrusions 621 of a neighboring track fixing unit 600'.

In addition, the support portion 620 may have gentle inclined surfaces 620' formed at the opposite ends in the transverse direction, so that the impact generated due to the steps of the distal end portions may be reduced during the passage of the traveling toy 100*a* over the support portion 620.

The rail unit 700 is configured to form a travel course of the traveling toy 100*a* by being coupling to the track fixing unit 600, and is constituted with a string formed of a flexible material having a predetermined thickness.

That is, the rail unit 700 allows the user to easily constitute a track, and to constitute tracks having various shapes such as a straight line shape and a curved line shape, and may be wound and stored after being used.

In addition, the cross-sectional shape of the rail unit 700 may have a "○" shape as shown in FIG. 50A or "□" shown in FIG. 50B, and may have a cross-sectional shape of "T" shape although not shown.

Next, the operation of the track of the play apparatus using a traveling toy according to the present disclosure will be described with reference to FIGS. 51 and 52.

As shown in FIGS. 51 and 52, the user couples the track fixing units 600 at regular intervals or irregular intervals to the rail units 700 having a predetermined length.

After disposing the track fixing units 600 and the rail units 700 on the ground, the track fixing units 600 and the rail units 700 are arranged in a track having a shape desired by the user.

In addition, when multiple tracks are provided for racing, as in FIG. 49, another track fixing unit 600' is disposed on one side of the track fixing unit 600, and the support portion coupling protrusions 621 in the track fixing unit 600 621 and the support portion coupling grooves 622 in the other track fixing unit 600' are fastened to each other such that the track fixing units are arranged parallel to each other.

Meanwhile, the traveling toy 100*a* includes a driving unit (not shown) such as a motor, which is installed inside the toy body 110, and the driving force generated by the driving unit is transmitted through the wheels 120 such that the traveling toy 100*a* moves. In the traveling toy 100*a*, a guide portion 111, in which a groove is formed in the longitudinal direction of the toy body 110, is formed in the lower part such that the track fixing unit 600 and the rail unit 700 pass therethrough, and multiple auxiliary wheels 130 are mounted in the guide portion 111.

While the traveling toy 100*a* moves along the installed rail unit 700, the auxiliary wheels 130 are in contact with the opposite lateral sides of the rail unit 700, so that the traveling toy 100*a* can be moved without escaping from the rail unit 700.

When the traveling toy 100*a* passes through the track fixing unit 600, the wheels 120 ascend the support portion 620 of the track fixing unit 600, causing an impact on the traveling toy 100*a*.

The caused impact moves the traveling toy 100*a* upwards such that the traveling toy 100*a* escapes from the rail unit 700. However, the flanges 612 of the track fixing unit 600 come into contact with the auxiliary wheels of the traveling toy 100*a* so as to prevent the traveling toy 100*a* from being lifted upwards, thereby preventing the traveling toy 100*a* from escaping from the rail unit 700.

When disassembling the assembled track, the rail unit 700 is separated from the track fixing unit 600, and the separated rail unit 700 is wound and stored. Thus, the track can be easily disassembled.

FIGS. 53 and 54 show another embodiment of a rail-type track, which includes a track fixing unit 600*a* and a rail unit. The track fixing unit 600*a* is configured to fixedly support a rail and to mate with a portion of the traveling toy 100*a*, which travels along the rail, so as to prevent the traveling toy 100*a* from deviating from a route. The track fixing unit 600*a* includes a fixing unit body 610*a* and a support portion 620*a*.

The track is different in the position of the support portion 620*a*, and the support portion 620*a* is provided to extend in opposite lateral directions from one longitudinal end of the fixing unit body 610*a*.

Thus, when the traveling toy 100*a* (see FIG. 52) passes through the fixing unit 600*a*, the wheels 120 ascend the support portion 620 of the track fixing unit 600*a* to lift the traveling toy 100*a* upwards, the flanges 612 of the fixing unit 600*a* come into contact with the auxiliary wheels 130 of the traveling toy 100*a* so as to prevent the traveling toy 100*a* from being lifted upwards, thereby preventing the traveling toy 100*a* from escaping from the rail.

FIGS. 55 and 56 show another embodiment of the rail-type track. The track 700*b* includes a rail unit 710, a track coupling portion 720, and a track fixing unit 730, such that the traveling toy travels along an arbitrary course.

The track 700*b* constitutes a rail unit 710 in a line shape having a predetermined thickness and the rail unit 710 of the track 700*b* is made of a flexible material so as to form a freely changeable course. Preferably, the track 700*b* is integrated with the rail unit 710.

The rail unit 710 has a predetermined length and the rail part 710 and coupling component are formed at the opposite ends thereof such that the rail unit 710 forms a closed circuit or is coupled with a neighboring rail unit 700*b*' so as to increase the length thereof.

In addition, the cross section of the rail unit 710 may have various shapes such as a "◎" shape, a "○" shape, a "□" shape, a "▽" shape, and a "◇" shape.

The coupling component includes a track coupling portion 720 extending from one end of the rail unit 710 to a predetermined length, and a track coupling groove 721 provided at the other end of the rail unit 710 such that the track coupling portion 720 is inserted thereinto.

The track coupling portion 720 is made of a metal material or a magnetic material, and preferably a magnetic material.

The track 700*b* may further include a track fixing unit 730 configured to fixedly support the rail unit 710, which forms an arbitrary course. The track fixing unit 730 may be configured such that the track coupling portion 720 may be fixed through press fitting or the like, and may be formed of a magnet so as to be closely fixed to the track coupling portion 720 through a magnetic attraction force. Preferably, the track fixing unit 730 is formed of a magnet.

FIGS. 57 to 59 are views showing a launcher 800 of the play apparatus using a traveling toy according to the present disclosure. The launcher 800 is configured such that, when a lift unit 820, which is provided so as to be movable up and down, moves the traveling toy 100 upwards, a switch unit configured to control power to be supplied to the traveling toy 100 is spaced apart from the track 700*b* (see FIG. 55) so that power of the traveling toy is turned OFF, and when the lift unit 820 moves the traveling toy 100 downwards, the switch unit comes into contact with the track 700*b* so that the power of the traveling toy is turned ON. The launcher 800 includes a launcher body 810, lift units 820, a button unit 830, and a fixing unit 840.

The launcher body 810 is a plate-shaped member having a pair of launcher first installation grooves 811 provided on the upper surface thereof to accommodate the lift units 820, and an insertion portion 811*a* is formed at the distal end of each of the launcher first installation grooves 811 to insert a user's finger or the like so that the lift units 820 can be easily drawn out.

In addition, the launcher body 810 includes: a launcher first through hole 812 formed at one side of the launcher first installation grooves 811, a shaft 824 being installed in the launcher first through hole 812 so as to rotatably support the lift units 820; and a launcher second through hole 813 formed at the launcher first installation holes 811, the button unit 830 being installed in the launcher second through hole 813.

In addition, the opposite sides of the launcher body 810 are provided with coupling protrusions 814 configured to be coupled to and horizontally connected to neighboring launchers 800*a* and 800*b* and coupling grooves 814*a* corresponding to the shape of the coupling protrusions 814 are provided, and a cover unit 816 formed with an accommodation groove 816*a* in which support portions 831 of the button unit are movable is provided.

In addition, the launcher body 810 is formed with a launcher second installation groove 815 configured to have the fixing unit 840 installed therein, which fixedly supports the rail unit 710 (see FIG. 56) to the launcher unit 810.

The lift units 820 are rectangular plate members and are installed on the launcher body 810 so as to be movable up and down, and are configured such that, when the lift units 820 come into contact with the bottom of the traveling toy 100 and move the traveling toy 100 upwards, the traveling toy 100 is spaced apart from the track 700*b*, and when the lift units 820 move downwards, the traveling toy 100 is brought into contact with the track 700*b*. Each lift unit 820 includes a first lift unit body 821 and a second lift unit body 822 such that the lift unit 820 is partially bendable.

The lift unit first body 821 is formed at one side of the first lift unit body 821, such that the first lift unit body 821 is pivotally coupled to the second lift unit body 822 using a first rotary shaft 823, and the first lift unit body 821 is formed at the other side of the first lift unit body 821 such that the first lift unit body 821 is pivotally installed into the launcher body 810 via a shaft 824.

A lift unit third through hole 822*a* is formed at one side of the second lift unit body 822 such that the second lift unit body 822 is pivotally connected to the first lift unit body 821 via the first rotary shaft 823. That is, the lift units 820 may take a form in which the first lift unit bodies 821 and the second lift unit bodies 822 are bent about the first rotary shafts 823, for example, an upwardly bent structure having a "/\" shape in cross section, so that a part of the traveling toy 100 can be maintained in the state of being spaced apart from the launcher 800, whereby the traveling toy 100 is capable of maintaining the OFF state.

The button unit 830 is installed in the launcher body 810, and when the lift units 820 move to take the upwardly bent structure in the "/\" shape, the button unit 830 includes the support portions 831 that are maintained in the state of being mated with the distal ends of the second lift unit bodies 822 such that the lift units 820 maintain the "/\" shape.

In addition, the button unit 830 is configured such that one distal end protrudes to the outside through the launcher unit second through holes 813, and when the user pushes the protruding distal end, the support portion 831 horizontally moves to be separated from the second lift unit bodies 822, and the lift units 820, which have been maintained in the "/\" shape via the support portions 831, are flattened by the weight of the traveling toy 100.

That is, when the traveling toy 100 is brought into contact with the launcher body 810 through the operation of the button unit 830, the switch unit 130 of the traveling toy 100 comes into contact with the rail unit 710 to be switched ON.

The fixing unit 840 is configured to fixedly support the track 700*b* on the launcher body 810, and may fix the track 700*b* to the launcher body 810 through the press-fitting coupling with the track 700*b* and magnetic attraction force with the track 700*b*.

Therefore, the user can form various courses, the track can be easily assembled and disassembled, and track of various courses can be provided.

While descriptions have been made with reference to the embodiments of the present disclosure, a person ordinarily skilled in the art can understand that the present disclosure may be variously modified and changed without departing from the technical idea and scope of the present disclosure described in the claims.

In the course of describing the embodiments of the present disclosure, the thicknesses of the lines and the sizes of the components shown in the drawings may be exaggerated for clarity and convenience of explanation. Since the above-described terms are defined in consideration of the functions in the present disclosure and may vary depending on the intention of a user or an operator or custom, the interpretation of these terms should be made based on the contents of this specification.

The invention claimed is:

1. A traveling toy comprising:

a toy body including multiple wheels;

auxiliary wheels installed on the toy body and configured to come into contact with at least one of a rail unit or side wall portions installed on a track;

a body switch unit including, a body switch lever configured to operate according to a user's manipulation, a first contact configured to be displaced according to the operation of the body switch lever, and a second contact spaced apart from the first contact by a predetermined distance, in which one side surface of the second contact is electrically connected to the first contact depending on a displacement of the first contact; and a switch unit disposed on another side surface of the second contact and configured such that, when one side of a switch lever comes into contact with the rail unit installed on the track and another side of the switch lever is displaced, the second contact is displaced so as to be electrically connected to the first contact, thereby performing an ON/Off switching operation such that driving power of a battery is supplied to the traveling toy.

2. The traveling toy of claim 1, further comprising:

a switch configured to perform an ON/OFF operation to supply driving power, wherein the switch includes:

a magnetic switching lever installed on the bottom surface of the traveling toy, wherein the magnetic switching lever is configured to be displaced from an OFF position to an ON position by an item, which is attached to the bottom surface of the traveling toy and includes a magnetic body therein, and a magnetic field so as to connect a first electrode and a second electrode such that driving power is supplied;

a leaf spring configured to cause the first and second electrodes to be electrically connected to each other depending on the ON/OFF position of the magnetic switching lever; and an elastic unit installed on the leaf spring, wherein, when the switching lever is located at the ON position, the elastic unit is stretched and when the item is separated, the elastic unit is compressed to provide an elastic force such that the magnetic switching lever is located at the OFF position.

* * * * *